US006027265A

United States Patent [19]

Parker et al.

[11] Patent Number: 6,027,265

[45] Date of Patent: Feb. 22, 2000

[54] PRINTER HAVING IMPROVED PRINT HEAD MECHANISM AND METHOD

[75] Inventors: Kevin P. Parker, Berkeley, Calif.; Leo M. Fernekes, New York, N.Y.; Stefan Rublowsky, Brooklyn, N.Y.; Scott J. Kolb, New York, N.Y.; Christopher S. Cosentino, Staten Island, N.Y.

[73] Assignee: Powis Parker, Inc., Berkeley, Calif.

[21] Appl. No.: 08/950,040

[22] Filed: Oct. 14, 1997

[51] Int. Cl.[7] ..... B41J 2/00

[52] U.S. Cl. ..... 400/124.05; 400/605; 412/8; 101/93.03

[58] Field of Search ..... 400/124.01, 124.02, 400/124.03, 124.04, 124.05, 124.08, 124.09, 124.1, 124.11, 124.13, 124.19, 605; 347/2; 101/93.03; 412/8

[56] References Cited

U.S. PATENT DOCUMENTS

| | | | |
|---|---|---|---|
| D. 351,412 | 10/1994 | Noonan et al. . | |
| D. 354,303 | 1/1995 | Noonan et al. . | |
| D. 360,220 | 7/1995 | Noonan et al. . | |
| D. 362,459 | 9/1995 | Noonan et al. . | |
| D. 367,883 | 3/1996 | Banks et al. . | |
| 3,985,216 | 10/1976 | McIntosh . | |
| 4,027,761 | 6/1977 | Quaif | 400/124.05 |
| 4,162,131 | 7/1979 | Larson, Jr. et al. | 101/93.03 |
| 4,209,139 | 6/1980 | Alper . | |
| 4,280,404 | 7/1981 | Burrus et al. | 401/93.03 |
| 4,514,737 | 4/1985 | Suzuki | 346/76 |
| 4,653,941 | 3/1987 | Suzuki . | |
| 4,743,821 | 5/1988 | Hall | 400/124.05 |
| 4,802,781 | 2/1989 | Sheerer . | |
| 4,930,911 | 6/1990 | Sampson et al. . | |
| 5,039,237 | 8/1991 | Tanuma et al. | 400/124.05 |
| 5,039,238 | 8/1991 | Kikuchi et al. | 400/124.05 |
| 5,052,873 | 10/1991 | Parker et al. | 412/13 |
| 5,193,962 | 3/1993 | Parker et al. | 412/8 |
| 5,339,099 | 8/1994 | Nureki et al. | 346/76 |
| 5,364,216 | 11/1994 | Mandel | 412/34 |
| 5,370,467 | 12/1994 | Ikehata et al. . | |
| 5,413,422 | 5/1995 | Gray et al. . | |
| 5,441,589 | 8/1995 | Groswith, III et al. . | |
| 5,516,216 | 5/1996 | McDonough et al. | 400/124.01 |
| 5,684,931 | 11/1997 | Hagar | 400/605 |
| 5,724,075 | 3/1998 | Smith | 347/2 |

FOREIGN PATENT DOCUMENTS

| | | | |
|---|---|---|---|
| 0264965 | 11/1987 | Japan | 400/157.2 |
| 402002018A | 1/1990 | Japan | 400/124.03 |

OTHER PUBLICATIONS

"Temperature Compensation For Printers" IBM Tech. Disclosure Bulletin, vol. 27, No. 7B p. 4429–4430, Dec. 1984.

"Temperature and Voltage Compensation Circuit for Constant Energy Hammer Drivers," IBM Tech. Disclosure Bulletin, vol. 234, No. 11 p. 5513–5515, Apr. 1982.

U.S. Pat. application No. 08/949,867; Filing Date: Oct. 14, 1997; Binder Strip Printer and Method.

U.S. Pat. application No. 08/949,870; Filing Date: Oct. 14, 1997; Printer Having Interface Unit For Selecting Text Orientation.

*Primary Examiner*—Eugene Eickholt

*Attorney, Agent, or Firm*—Limbach & Limbach L.L.P.

[57] ABSTRACT

A printer having a platen for supporting a binder strip to be printed, a ribbon positioned adjacent the platen and print head mechanism having print pins, driver coils associated with each print pin and a heating element for heating the print pins. A driver applies energy to the coils such that a drive force is applied to the print pins up to the time the pins force the ribbon against the binder strip and for a fixed time thereafter. The driver is controlled by a print head controller so as to carry out printing on the binder strip.

29 Claims, 36 Drawing Sheets

92B
92A

USEFUL RANGE
532
534
DETECTOR AMPLITUDE (% FULL SCALE)
75%
37%
0
−1
−0.5
0
+0.5
+1
RELATIVE EMITTER/DETECTOR POSITION

PRINTER HAVING IMPROVED PRINT HEAD MECHANISM AND METHOD

FIELD OF THE INVENTION

The present invention relates generally to the field of printers and in particular to the printer having a dot matrix print head mechanism with heated print pins.

BACKGROUND ART

There is an increased demand for low cost printing of books and the like which can performed by a user as opposed to a commercial printer. Techniques have been developed for binding of sheets to form a book having characteristics that are similar to commercially bound books. One such technique, described in U.S. Pat. No. 5,052,873, the contents of which are hereby fully incorporated herein by reference, uses a binder strip having a thermally activated adhesive. The binder strip functions to bind the sheets together in the form of a book, with the strip being located along the spine of the bound book. Although books bound using this technique have become popular, it usually necessary to print descriptive information regarding the book, such as author, title and the like on the front and back covers of the book rather than on the spine (binder strip) of the book. Thus, for example, when the book is placed on a shelf, it is necessary to remove the book from the book read the descriptive information printed on the covers. Another approach is to print an adhesive-backed label using a label printing machine and applying the label to the spine (binder strip) of the bound book. A primary shortcoming of this approach is that the book is unprofessional in appearance.

It would be desirable to be able to print descriptive information on the binder strip before the book is bound. However, the physical characteristics of most binder strips are such that printing is very difficult. For example, binder strips frequently have a roughly textured surface which is not conducive to printing. In addition, binder strips are relatively thick due to the adhesive backing making printing difficult. This adhesive backing also causes many binder strips to curl to some extent around the primary axis of the strip further adding to the difficulty of printing. Also, it is necessary to very precisely locate the print on binder strip in order to eliminate any skew which can be visually detected between the printed matter and the edge of the strip. This is very difficult since the human eye is capable of detecting a very small amount of skew under these circumstances where the printed matter is positioned on a thin elongated strip. Further, the conventional printing inks are not always capable of adequately covering many binder strips. By way of example, if light colored print, such as white print, is to be placed on a dark colored binder strip, the underlying strip has a tendency to show through the printed matter. Adding to the difficulty is the fact that the actual binding process usually requires application of heat to the biding strip, with such high heat having adverse effects on some types of print.

There is a need for a printer having a print head mechanism which is capable of printing on binder strips so that bound books can be easily provided having an professional appearance. A printer in accordance with the present invention is capable of printing binder strips notwithstanding the above-noted and other difficulties associated with carrying out such printing. These and other advantages of the present invention will become apparent to those skilled in the art upon a reading of the following DETAILED DESCRIPTION OF THE INVENTION together with the drawings.

SUMMARY OF THE INVENTION

A printer suitable for printing on an elongated substrate such as a binder strip used in binding books is disclosed. The printer includes a platen configured to support the substrate during printing and a ribbon containing ink positioned adjacent the platen. Such ribbon may include, for example, a metallic hot foil ribbon.

The printer further includes a print head mechanism positioned relative to the platen and the ribbon and configured to transfer the ink from the ribbon to the substrate during printing. The print head mechanism includes a multiplicity of print pins configured to contact the ribbon and to force the ribbon against a substrate positioned on the platen. Each of the print pins has an associated driver coil which is configured to drive the print pin. The print head mechanism further includes a heating element for heating the pins, with the heating element preferably being a thermistor.

The subject printer further includes a print head driver configured to transfer drive energy to the driver coils. The drive energy is transferred such that a drive force is applied to the print pins up to a time at which the print pins have forced the ribbon against the substrate and for a predetermined minimum period after the time. A print head controller is included which is configured to control the print head driver so as to carry out printing on the substrate.

DETAILED DESCRIPTION OF THE INVENTION

Figure 1:
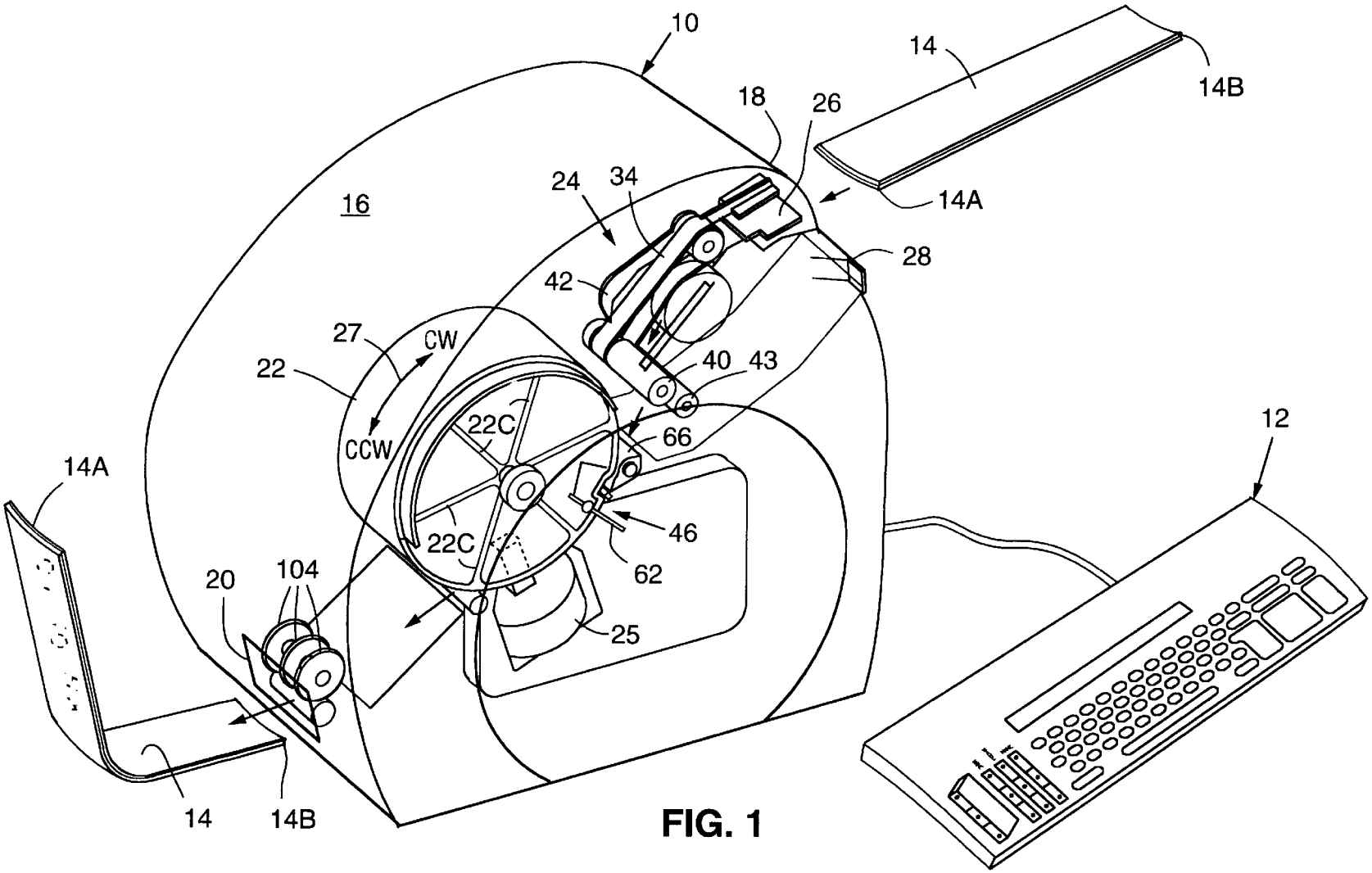
FIG. 1 is a perspective view of the subject Printer, including the control keyboard.

Referring now to the drawings, FIG. 1 is a simplified diagram of the subject printer, generally designated by the numeral 10. The printer includes a special control keyboard 12 which permits a user to input the printing information for printing on a binder strip 14. As will be explained in greater detail, such printing information includes the text (or graphics) to be printed, the print font to be used, the location of the printed matter on the binder strip and alignment of the print (vertical, horizontal or stacked) and other information.

The Printer 10 is preferably disposed in a housing 16 having a front opening 18 for receiving a binder strip 14 to be printed. A slot 19 (not depicted) located immediately below opening 16 is provided for ejecting the strip after printing as one of two eject options. A rear opening 20 is also located in the housing 16 through which the printed strip can be ejected as an alternative eject option.

After a user has entered the printing information using the control keyboard 12, the user inserts the binder strip 14 to be printed into the front opening 18. The convention used herein is that the ends of the binder strip are referred to herein as the leading edge 14A and the trailing edge 14B, with the leading edge 14A being the edge which is first introduced into the Printer 10 during the strip loading sequence. As will be explained later, the Printer 10 draws the strip 14 into the machine and makes a determination, among other things, that the strip is of a proper width and that the strip has been inserted with the adhesive side facing upwards. The strip 14 is then precisely positioned on a Drum 22 which supports the strip 14 for printing. A print head mechanism 25 is positioned adjacent the Drum 22, with the Drum and print head mechanism being moved relative to one another so that the desired information is printed on the desired location of the binder strip 14. Once the printing has been completed, the binder strip 14 is removed from the Drum 22 and ejected from the Printer through either the front housing slot 19 or rear housing opening 20.

OVERALL DESCRIPTION

Figure 2:
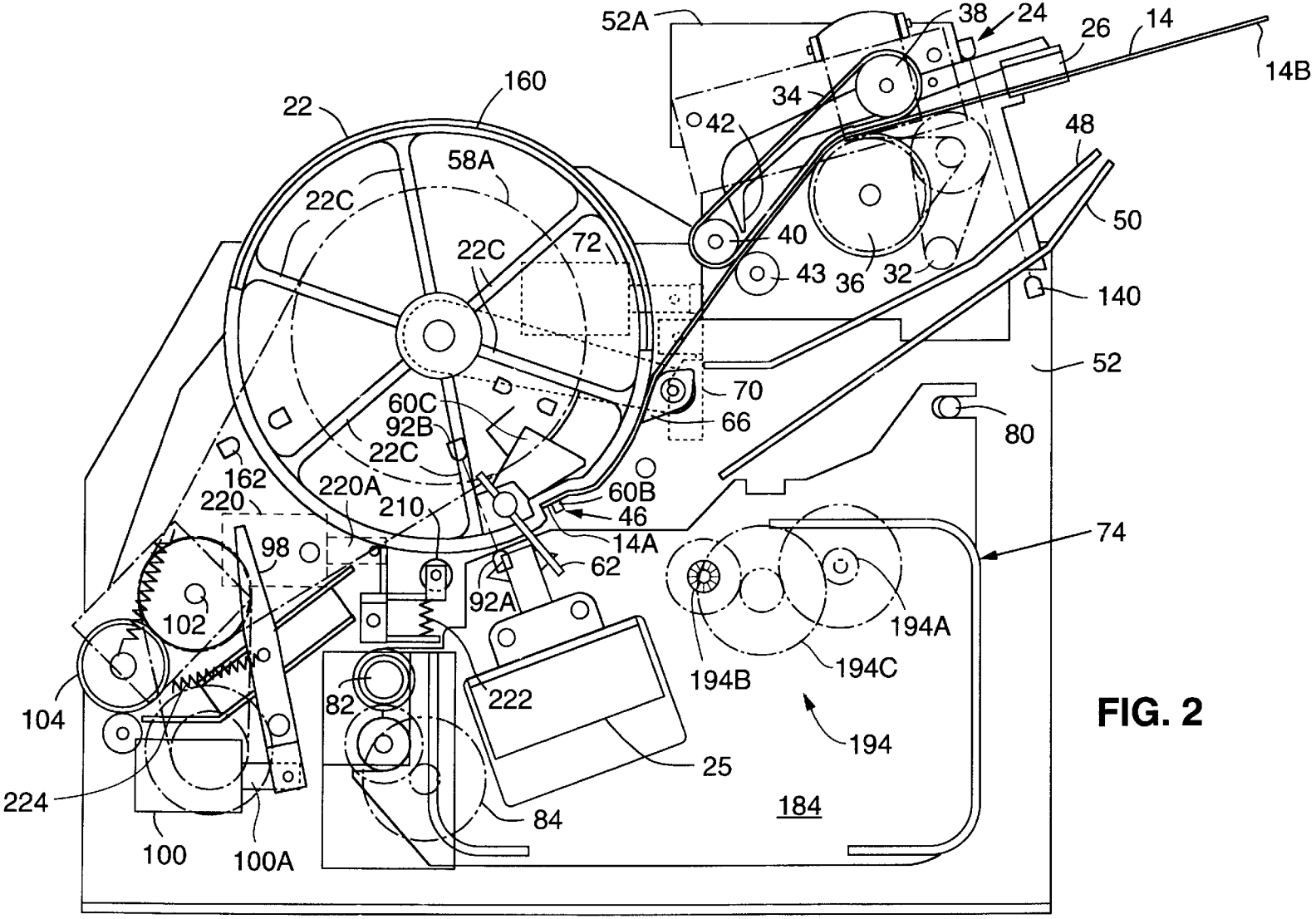
FIG. 2 is a side view of the subject Printer showing some of the major components.
Figure 3:
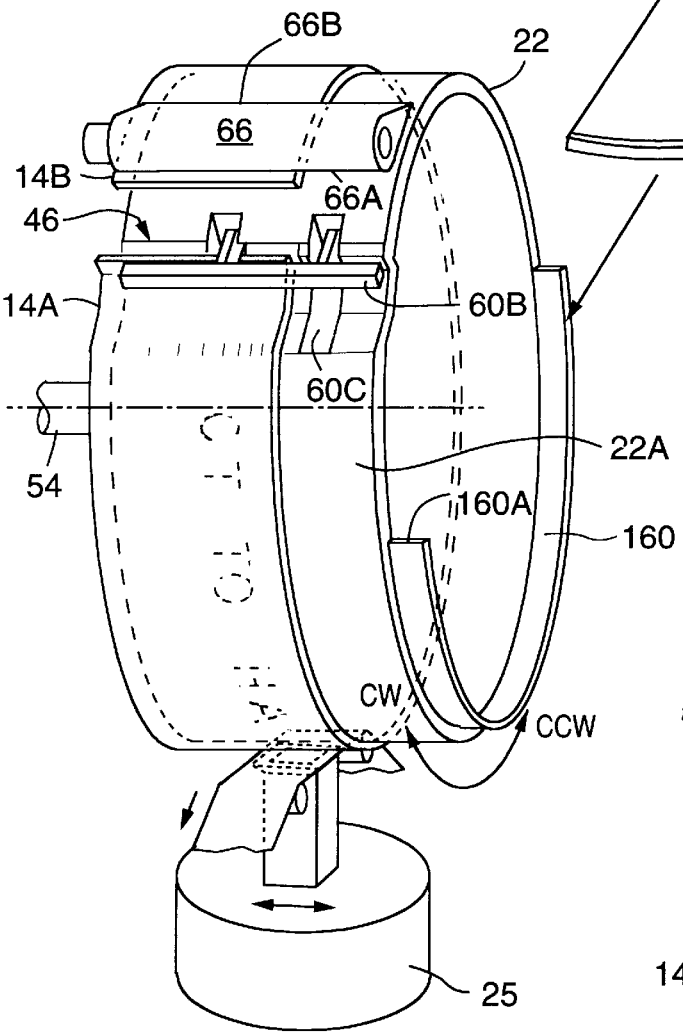
FIG. 3 is a perspective view of the Drum with a medium width binder strip mounted thereon.
Figure 4A:
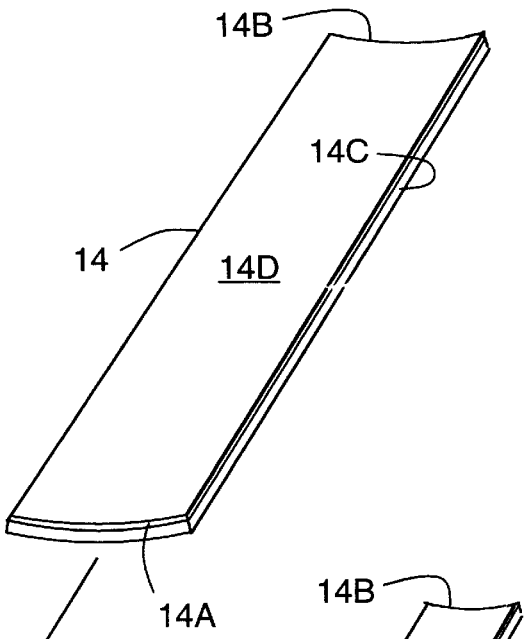
FIGS. 4A and 4B are perspective views of narrow and wide width binder strips, respectively.
Figure 4A:
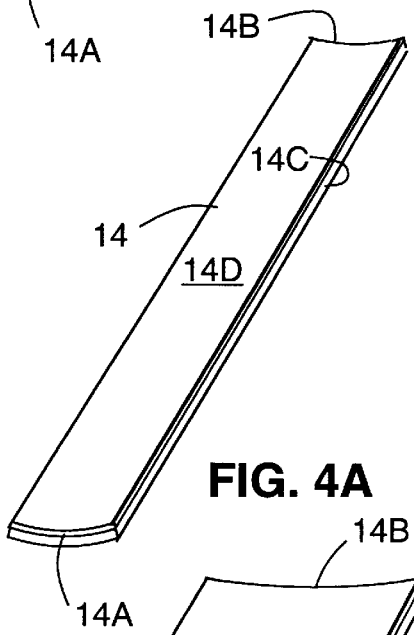
Figure 4B:
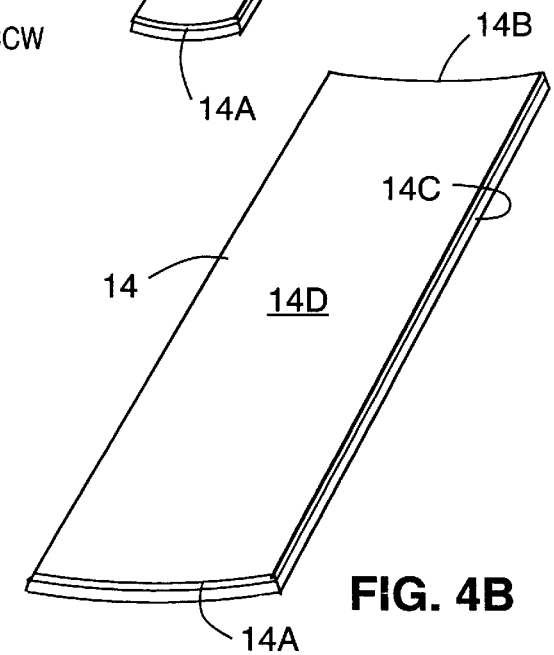
Figure 5:
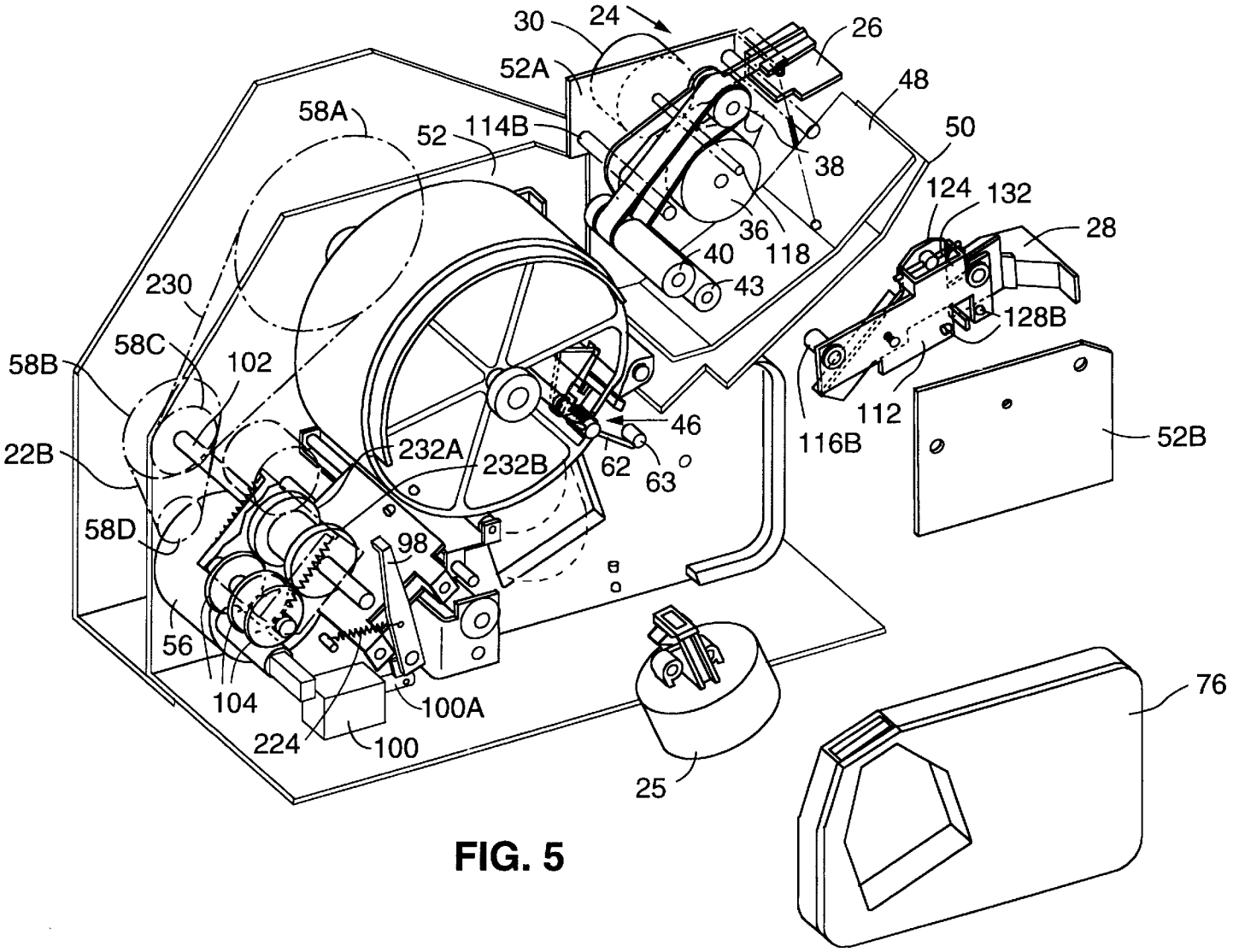
FIG. 5 is an exploded view of the subject Printer.

FIGS. 2 and 5 show additional details of the subject Printer 10 with the housing 16 removed. A Strip Load/Front Eject Assembly 24 (sometimes Strip Load Assembly 24) is positioned at the front of the Printer adjacent the front opening 18 of the housing (not depicted). The Strip Load Assembly 24 includes a pair of binder strip guides 26 and 28 which receive the binder strip 14 to be printed. The strip guides 26 and 28 each include guide portions 26A and 28A, respectively, which guide the binder strip 14 into the Printer. The binder strips 14 are typically available in various predetermined widths, with the particular width being determined by the thickness of the stack of sheets to be bound. These predetermined widths are usually designated "narrow", "medium" and "wide", with the user entering this information by way of the control keyboard 12. A strip guide carriage motor 30 is included in the Strip Load Assembly 24 for adjusting the spacing between the binder strip guides 26 and 28 to accommodate the width of the binder strip 14 to be inserted. As will be described later, sensors are included to confirm that the binder strip 14 inserted in the Strip Load Assembly 24 is of the proper width.

A strip drive motor 32 is included in the Strip Load Assembly 24 which drives a strip drive belt 34 through a series of rollers 36. The loaded strip 14 is gripped between the drive belt 34 and one of the rollers 36 and is pulled into the Printer by rotation of the belt and roller. As will be described in greater detail, Strip Load Assembly 24 has a sensor arrangement which performs part of a strip 14 length measurement by sensing respective ends 14A and 14B of the binder strip. A the binder strip 14 is driven towards the Drum 22, it is fed between a fixed roller 40 and a rotating blocking member 44 of the strip load assembly. The roller and blocking member function to detect binder strips 14 that have been loaded with the adhesive side improperly facing downward and to detect when two strips have been improperly loaded together, with this latter event sometimes occurring because the strips sometimes tend to stick together when removed from their packaging.

Assuming that the proper binder strip 14 has been correctly inserted into the Printer 10, the Strip Load Assembly 24 continues to guide the strip 14 to a Clamp Mechanism 46 mounted on the Drum 22. As will be explained, the Clamp Mechanism 46 functions to secure the leading edge 14A of the binder strip to the Drum 22. The Strip Load Assembly 24 further includes a pair of opposing guide members 48 and 50 which are positioned to receive a leading edge 14A of a binder strip when the strip commences to be ejected after printing. The guide members 48 and 50 direct the binder strip to the front slot 19 in the housing (not depicted) as the binder strip 14 is ejected from the Printer 10.

The Drum 22 on which the binder strip 14 is mounted during the actual printing, is rotatably mounted on the printer frame 52 by way of a Drum support shaft 54. Drum 22 can be rotated in either direction by a Drum drive motor 56 which drives the Drum by way of a Drum drive train 58 which includes a system of drive pulleys. A Clamp Mechanism 46 is mounted in a recess 22D of Drum 22 which functions to secure the leading edge 14A of the binder strip 14 as the strip is loaded onto the Drum. The Clamp Mechanism 46 includes a movable strip clamp 60 which is operated by a clamp actuate arm 62. The moveable strip clamp 60 includes a strip clamp bar 60B and a pair of strip eject fingers 60C. Depending upon the position of actuate arm 62, the clamp 60 may be moved to one of three positions. At the beginning of a binder strip 14 load sequence, the strip clamp 60 is in an open position so that the leading edge 14A of the binder strip can be received between the Drum 22 and the clamp bar 60B. The strip eject fingers 60C are in a withdrawn position when the strip clamp 60 is the open position.

Strip clamp 60 is in a closed position during the actual printing. In this position, the clamp bar 60B is closed with the leading edge 14A of the binder strip being gripped between the clamp bar 60B and the Drum 22. Finally, after printing, the strip clamp 60 is moved to an eject position where both the clamp bar 60B and the strip eject fingers 60C are exposed. The strip eject fingers 60C function to lift the leading edge 14A of the binder strip up away from the Drum 22.

Figure 28:
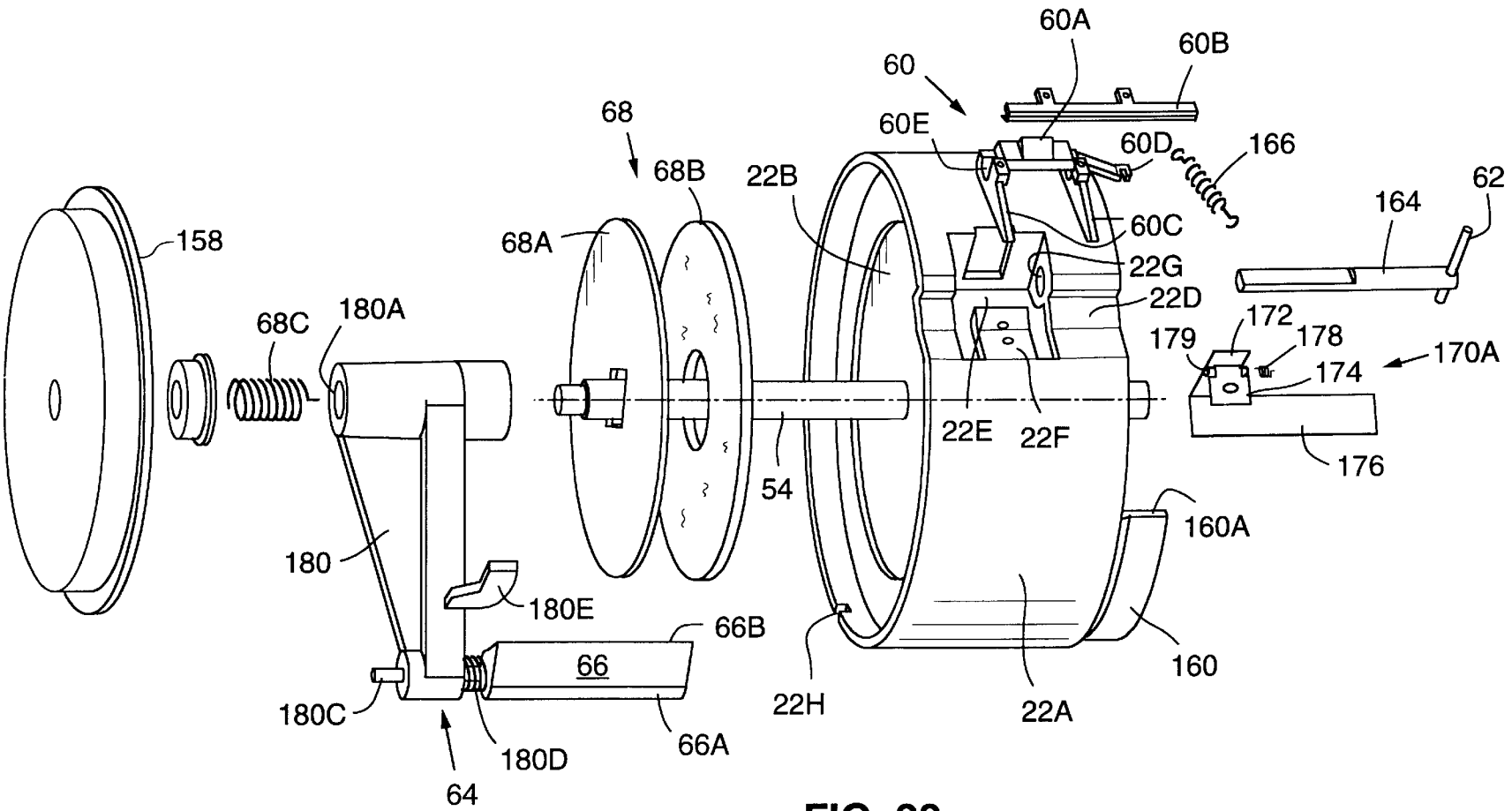
FIG. 28 is an exploded view of the Drum, the scraper arm and the scraper arm clutch.

The Printer 10 further includes a Scraper Mechanism 64 which is also rotatably mounted on the Drum support shaft 54 (FIG. 28). The Scraper Mechanism 64 performs several functions. During the loading of the binder strip 14, the mechanism functions to guide the leading edge 14A of the strip to the Clamp Mechanism 46. After the leading edge 14A is clamped, the Scraper Mechanism 64 is passed over the entire length of the binding strip 14, starting at the clamped leading edge 14A, in a wiping motion. This causes the entire length of strip 14 to be forced against the surface of the Drum 22. After the wiping action is concluding, a scraper arm 66 of the Scraper Mechanism 64 is positioned at the trailing edge 14B of the binder strip 14 and functions to secure the trailing edge to the Drum 22. Thus, the binder strip 14 is secured to the Drum 22 at the leading edge 14A by the Clamp Mechanism 46 and secured to the Drum 22 at the trailing edge 14B by the Scraper Mechanism 64 so that printing can be carried out. Finally, the Scraper Mechanism 64 functions to lift the trailing edge 14A of the binder strip up from the surface of the Drum 22 when the strip is ejected from the front of the Printer 10.

As will be explained in greater detail, the scraper arm 66 of the Scraper Mechanism 64 is mounted adjacent the surface of the Drum 22 and is configured to either move with the Drum or remain fixed relative to the Drum, as will be described. The scraper arm 66 includes a strip guiding edge 66A that functions to guide the binder strip 14 to the Clamp Mechanism 46 during strip loading. The scraper arm 66 further includes a strip engaging edge 66B, opposite the guide edge 66A, which is biased in a direction towards the surface of the Drum 22. The strip engaging edge 66B functions to force the length of the binder strip 14 against the Drum 22 surface during the wiping action and to secure the trailing edge 14B of the strip against the Drum during printing. The engaging edge 66B further functions to move between the strip 14 and the Drum 22 so as to separate the strip from the Drum during the front eject sequence.

The Scraper Mechanism 64 includes a scraper arm slip clutch 68 (FIG. 28) which can be in either in an drive state or a slip state. In the drive state, the scraper arm clutch 68 permits the scraper arm 66 to move with the Drum 22 and when in the slip state, permits the scraper arm 66 and the Drum 22 to move separately. A scraper arm locking mechanism 70 is mounted on the printer frame 52A adjacent the Drum 22 for locking the Scraper Mechanism 64 in a fixed position. In the event the Scraper Mechanism 64 is unlocked, the clutch 68 will remain in the drive state so that the scraper arm 66 will move with the Drum 22. When in the locked position, the scraper arm 66 will remain fixed and will not rotate with the Drum 22, with the scraper arm clutch 68 being in the slip state. The scraper arm locking mechanism 70 includes a solenoid 72 mounted on the frame 52A for actuating the switching the locking mechanism 70 between a locking and non-locking state.

The Printer 10 further includes a Print Head Carriage Assembly 74 mounted on the frame 52 below the Drum 22 and the Strip Load Assembly 24. The Carriage Assembly 74 includes a print head mechanism 25 mounted below and adjacent the surface of the Drum 22. The print head mechanism 25 is a modified dot matrix printer which includes several print pins. The Carriage Assembly further includes a cartridge 76 which holds hold a foil ribbon 78 and which surrounds the print head mechanism 25. The foil ribbon 78 is positioned intermediate the binder strip 14 and the print head mechanism 25 during actual printing.

The Print Head Carriage Assembly 74 is mounted on the printer frame 52 so that the print head mechanism 25 can be driven across the width of the strip support region 22A of the Drum 22. Thus, assuming that a binder strip 14 has a major Y axis along the length and a minor X axis along the width, the rotational position of the Drum 22 controls the printing location along the Y axis of the strip and the position of the Print Head Carriage Assembly 74 controls the printing location along the X axis.

The Print Head Carriage Assembly 74 is mounted on the printer frame 52 by way a front carriage support rail 80 and a rear support rail 82. A carriage drive motor 84 drives a lead screw 86 by way of a carriage drive train 88 in both directions. The lead screw 86 engages a drive nut 90 fixed to the carriage so that carriage movement is effectuated. Once the binder strip 14 is loaded onto the Drum 22, there will usually be some misalignment in the form of skew. As will be explained in greater detail, the subject Printer 10 functions to measure the magnitude of any skew and to electronically compensate for such skew during printing thereby eliminating any visually detectable misalignment between the printed matter and the edges of the binder strip 14. A further function of the Print Head Carriage Assembly 74 is to support a Drum edge optical emitter 92 which senses the position of the strip 14 when the strip is mounted on the Drum 22 and the position of the Drum edge when no strip is on the Drum. The Drum edge optical sensor 94 is mounted in a fixed position on the printer frame 52C.

The subject Printer 10 further includes a Rear Eject Assembly 96 which operates to transfer the printed binder strip 14 from the Drum 22 to the rear opening 20 of the printer housing 16. It would be possible to position the rear opening 20 adjacent the strip input of a binding machine so that the printed strip 14 will automatically be transferred from the rear opening of the printer to the binding machine. The Rear Eject Assembly 96 includes a pivotable eject trip arm 98 which, during the ejection sequence, engages the clamp actuate arm 62 of the Clamp Mechanism 46 and causes the movable strip clamp 60 to go to the eject position so that the leading edge 14A of the binder strip 14 is lifted away from the Drum 22 by the strip eject fingers 60C of the Clamp Mechanism 46. An eject solenoid 100 operates to move the eject trip arm 98 between the eject and non-eject positions.

Figure 33:
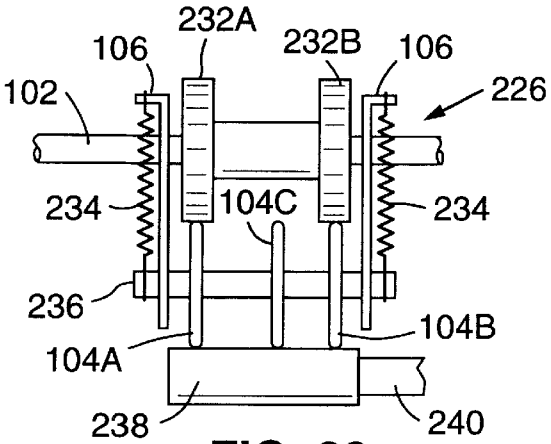
FIG. 33 is a partial view of the three eject wheels of the Rear Eject Mechanism.

The Rear Eject Assembly 96 also includes a drive shaft 102 (FIG. 33) which is driven by the Drum drive motor 56 by way of the Drum drive train 58.

The drive shaft 102 drives three eject wheels 104A, 104B and 104C which grip the strip 14 during the ejection sequence. As will be explained in greater detail, the eject wheels 104A, 104B and 104C are mounted on an pivotable eject frame 106, with this arrangement permitting strip 14 movement out of the Printer 10, but preventing strip movement back into the Printer.

The electrical and electronic components for controlling the operation of the subject printer are primarily located on a printed circuit board 108 mounted vertically on the printer frame 52D. Heat generating components such as motor drivers and the like are mounted on a heat sink 110 located just above the printed circuit board.

Load/Front Elect Assembly (Strip Load Assembly)

Figure 9:
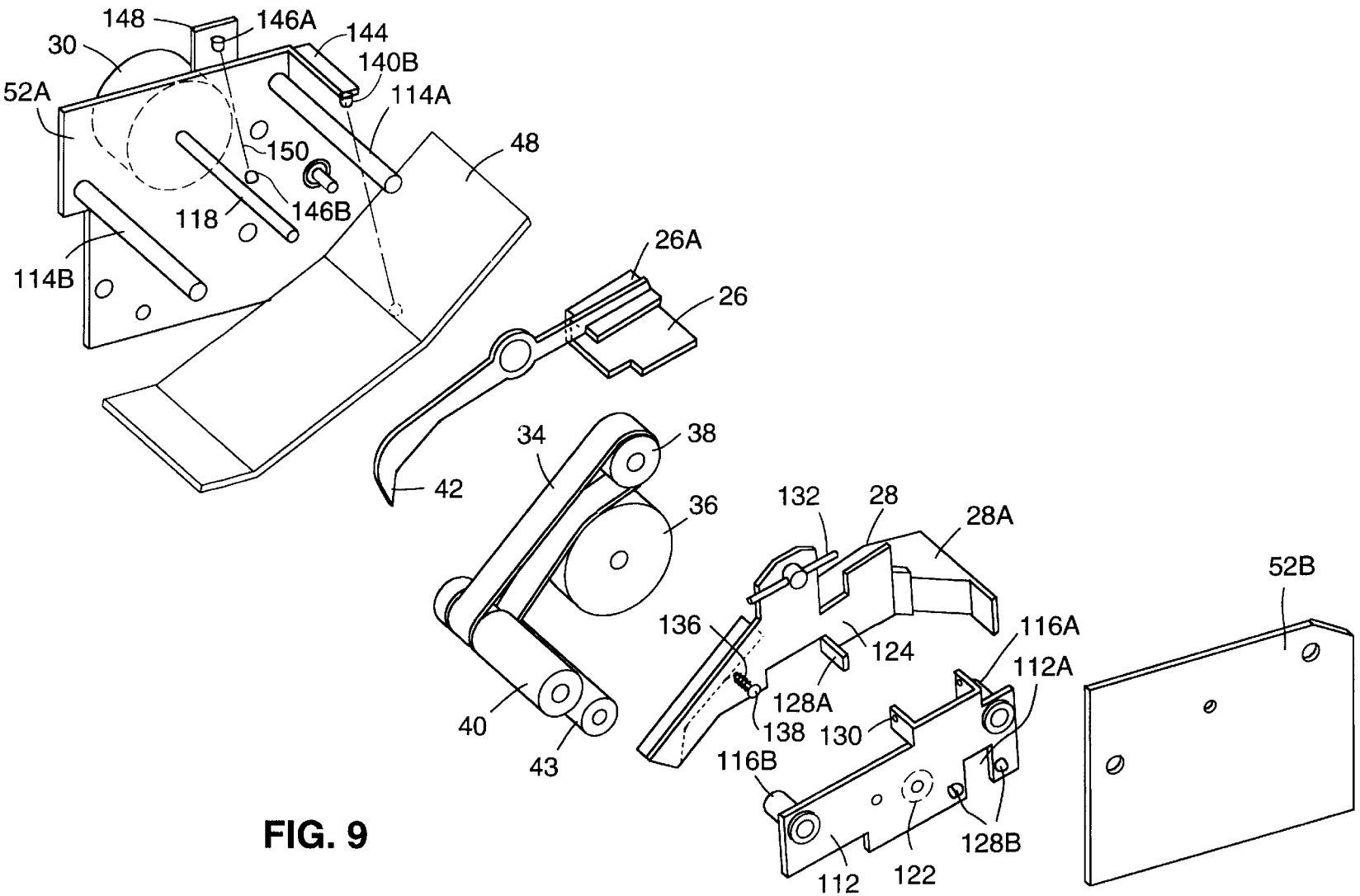
FIG. 9 is an exploded view of the Strip Load Assembly.

Additional details regarding the construction and operation of the Load/Front Eject Assembly 24 will now be given. As can best be seen in FIGS. 5 and 9, the fixed strip guide 26 of the assembly is secured to a frame member 52A. The fixed strip guide 26, together with a binder strip guide 42, are preferably formed from a single plastic element bolted to the frame member 52A. The fixed strip guide 26 includes a guide portion 26A which receives the right hand side (with the user facing the front opening of the printer) of the binding strip 14 when the strip is inserted into the Printer. As previously noted, the movable strip guide 28 is mounted on a translatable strip guide support 112 which can be driven to the left (outward) or right (inward) depending upon the width ("wide", "medium" or "narrow") of the binder strip 14 to be printed.

The translatable guide support 112 is mounted on a pair of rails 114A and 114B and is positioned between printer frame members 52A and 52B. The translatable guide support 112 is mounted for movement on the rails by way of a pair of sleeve bearings 116A and 116B. A lead screw 118, driven by the strip guide carriage motor 30, extends from the motor shaft 120 and through a drive nut 122 fixed on the movable guide support 112 so that rotation of the motor shaft 120 will cause movement of the translatable guide support 112 in either direction.

The movable strip guide 28 is mounted on a pivotable guide support 124 which is, in turn, mounted on the translatable guide support 112 by a hinge mechanism 126 which permits the movable strip 28 guide to be tilted to the left (outward) or to the right (inward). As will be explained, insertion of a binder strip 14 of proper width will cause the strip guide to be tilted to the left, with such action being detected by an optical strip justify sensor 128. The hinge mechanism 126 includes a hinge support member 130 on the translatable support 112 on which the pivotable strip guide support 124 is pivotally mounted by way of a pivot pin 132. The pivot pin 132 is secured to the pivotable strip guide support and extends through openings in the translatable guide support 112. A spring 134 is disposed intermediate the translatable and pivotable guide supports 112, 124 which causes the pivotable guide support to tilt to the right (FIG. 6A), with this spring being compressed when a binder strip 14 of proper width is inserted. The spring 134 is held in place by a screw 138 (FIG. 6B) around which the spring is mounted. The screw 138 is secured to the pivotable guide support 124 and has a shaft which extends through an opening 112B in the translatable guide support 112, with the screw head and the screw shaft being larger and smaller, respectively, than the opening 112B so that the pivotable strip guide support 124 is free to pivot, with the degree of pivoting to the right (inward) being limited by the screw head.

Figure 7:
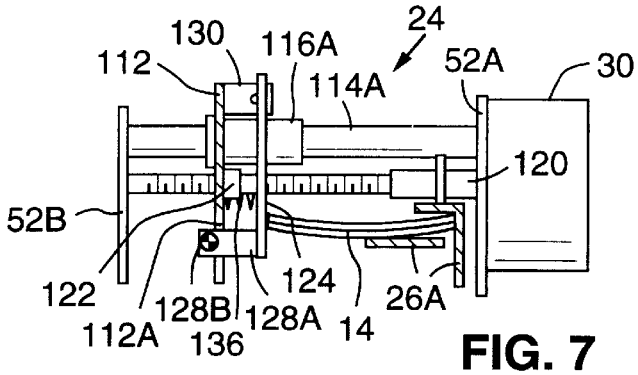
FIG. 7 is a front view of the Strip Load Assembly of the subject Printer with a medium width binder strip inserted therein.
Figure 8:
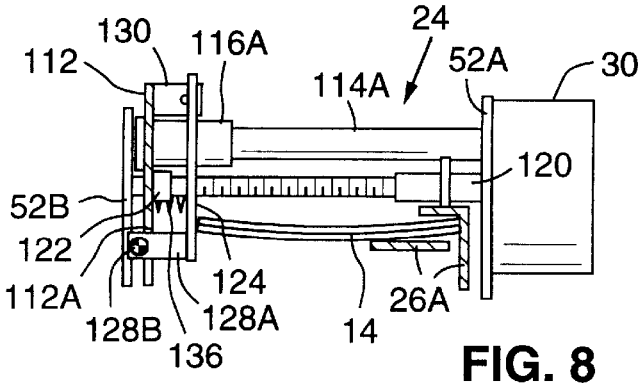
FIG. 8 is a front view of the Strip Load Assembly of the subject Printer with a wide width binder strip inserted therein.

The previously noted strip justify sensor 128 includes an optical detector 128B mounted on the translatable strip guide 112 and a movable flag 128A mounted on the pivotable strip guide support 124. When a binder strip 14 of proper width has been inserted into the Strip Load Assembly 24, the movable flag 128A is displaced to the left so that the flag will be detected by the optical detector 128B (FIGS. 7 and 8). The strip justify sensor 128 also functions to detect when the translatable strip guide support 124 is in a home position, as will be explained. Further, the strip justify sensor 128 is used to increase the speed in which a strip is loaded into the Printer 10, as will also be further explained.

The Strip Load Assembly 24 includes two further optical sensors, including a strip ejected forward sensor 140 for detecting that a binding strip 14 has been ejected and is positioned between the upper and lower eject guide members 48 and 50, respectively, awaiting removal by the user. Sensor 140 comprises an optical emitter 140A positioned on a bracket 142 below the lower eject guide member 50 and a detector 140B positioned on another bracket 144 just above the fixed strip guide 26. A notch 26A is formed in the fixed strip guide 26 immediately below the detector 140B emitter, with openings being formed in the upper and lower eject guides 48 and 50 to provide an optical path between the emitter and detector. The light path of the strip ejected forward sensor 140 is interrupted when a strip 14 is disposed between the upper and lower guides 48 and 50.

The third optical sensor of the Strip Load Assembly 24, the strip present sensor 146, is mounted on frame member 52A (FIG. 11) for sensing when a binding strip 14 has been inserted. When strip present sensor 146 detects the insertion of a binder strip 14, the strip drive motor 32 will be turned on thereby causing the drive belt 34 to pull the strip into the Printer. The strip justify sensor 128 will detect the strip shortly after sensor 146 and will cause the speed of the strip drive motor to increase.

The strip present sensor 146 includes an optical emitter 146A mounted on a bracket 148 attached to frame member 52A above the path of the binder strip 14 and slightly downstream of upper belt roller 38. The optical emitter 146A is further positioned relative to the edge of the strip path so that the strip 14 will be detected only if it is properly positioned abutting the fixed strip guide 26. The optical detector 146B of the strip present sensor is positioned below the emitter 146A and extends through an opening in the frame member 52A. Preferably, the fixed strip guide 26 is mounted on the frame member 52A so that a gap exists intermediate the fixed strip guide and the frame member in order to provide an optical path between the emitter 146A and detector 146B along the surface of the frame member 52A.

The strip drive motor 32 of the Strip Load Assembly is mounted on the frame member 52A and drives the strip drive roller 36 by way of a strip drive train 152. The drive chain includes four pulleys 152A, 152B, 152C and 152D interconnected by a pair of toothed belts 152E and 152F having a geometry such that the desired speed at which the strip is drawn into the printer is achieved. The strip drive roller 36, which is mounted on a roller shaft 154, has a resilient outer surface which engages and drives the strip drive belt 34 by friction. The strip drive belt 34 is mounted by way of the upper belt roller 38 and the lower belt roller 40. The fixed and movable guide portions 26A and 28A are arranged such that the leading edge 14A of a strip loaded into the Printer will be pinched between the strip drive roller 36 and the drive belt 34 at a point where the two contact one another.

The Strip Load Assembly 24 further includes, as previously noted, apparatus for detecting binder strips 14 which have been improperly inserted with the adhesive side facing downward and which have been improperly inserted two at a time. The lower belt roller 40 is positioned just above the path to be taken by the strip during the loading sequence. The rotatable blocking member 44 is rotatably mounted on the frame member 52A by way of mounting member 43 and is positioned adjacent frame member 52A just below the lower belt roller 40. Mounting member 43 extends between frame elements 52A and 52B and further functions to guide the binding strip towards the Drum 22 during loading. The rotatable blocking member 44 has a geometry such that gravity causes the member to be in a normal non-blocking position. The rotatable blocking member 44 is also positioned such that the binder strip 14 will slide over the surface of the member during the loading sequence. The rotatable blocking member 44 is spaced relative to the lower belt roller 40 so that a single binder strip 14 can pass between the two members, but a pair of binding strips 14 cannot. Thus, when two or more binder strips 14 are inadvertently loaded into the Printer, members 40 and 44 will prevent the multiple strips from being loaded onto the Drum 22.

Figure 14:
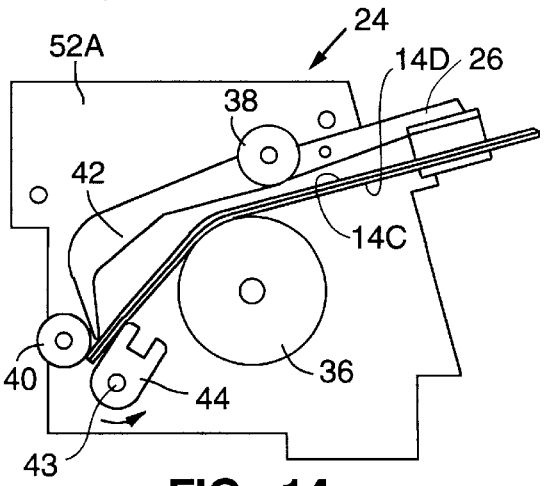
FIG. 14 is a side view of the Strip Load Assembly with a binder strip improperly inserted with the adhesive side facing down.

A difference in co-efficient of friction between the binding strip adhesive 14D and substrate 14C is used to detect when a strip has been improperly loaded into the Printer with the adhesive 14D facing downward. The slightly tacky moving surface of the adhesive 14D which contacts the rotatable blocking member 44 will cause the member to rotate so that the effective spacing between the roller 40 and the rotatable blocking member 44 is reduced (FIG. 14). This action will prevent further loading of the strip. Note that the surface of the substrate 14C is not tacky as is the adhesive side so that the rotatable blocking member 44 remains fixed when the strip slides over the member 44 during loading.

Figure 57:
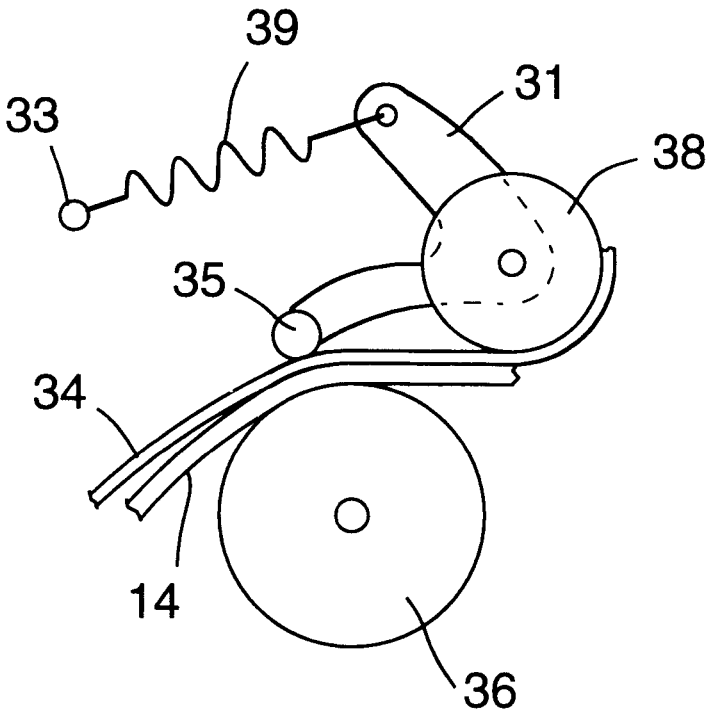
FIG. 57 depicts a modification to the Strip Load Assembly.

In order to increase the reliability of the operation of the Strip Load Assembly 24 it possible to modify the Assembly by adding a nip roller mechanism as shown in FIG. 57. The nip roller mechanism operates to force a nip roller 35 against that portion of the strip drive belt 34 located above the strip drive roller 36 so that a the belt will apply a well controlled force to a binder strip 14 disposed between the belt and the strip drive roller.

Nip roller 35 is mounted on a lower end of a lever arm 31, with the center of the lever arm being pivotably mounted on the same shaft as is the upper belt roller 38. A spring 39 is connected between the upper end of the lever arm 31 and frame member 52A by way of support member 33 mounted on the frame member. Spring 39 operates to apply a well controlled force to the upper end of the lever arm 31 so that the lower end of the arm will force the nip roller 35 down against belt 34. Without the nip roller mechanism, the amount of tension applied by belt 34 would vary depending upon many factors including the age of the belt and the belt tension. This would reduce the ability of the Strip Load Apparatus 24 to accurately load a strip onto Drum 22. Such accuracy is increased by the addition of the nip roller mechanism.

Drum

Drum 22 is preferably an aluminum casting, with the outer surface of the Drum, including the strip support region 22A, being polished so as to provide a proper surface for supporting the strip 14 during printing and so as to provide a surface which tends to grip the adhesive 14D of the strip 14 for reasons which will be explained. The Drum 22 includes an interior wall 22A (FIG. 28) which forms a clutch surface for supporting the scraper arm clutch 66 as will be described. Reinforcing rib members 22C are used to provide strength while minimizing the weight of the Drum 22. The Drum support shaft 54 extends through, and is secured to, the Drum hub 158. The support shaft is rotatably mounted by way of bearings on frame member 52B and frame member 52C. The shaft extends through frame member 52C and supports a Drum drive pulley 58B of the Drum drive train 58. Pulley 58A is driven by pulley 58B by way of a toothed belt 58E, with pulley 58B being driven by pulley 58C by a second toothed belt 58F. Pulley 58C is driven by the Drum drive motor 56 which is capable of driving Drum 22 in either direction.

Drum 22 includes a Drum flag 160 in the form of a flange which extend around the periphery of the Drum for about one-half the circumference of the Drum. A Drum home optical sensor 160 is mounted on frame member 52B, with sensor 102 having an opening through which the Drum flag 160 passes depending upon the rotational position of the Drum 22.

As can best be seen in FIG. 28, Drum 22 includes a slot 22H on the inward side of the Drum approximately opposite Clamp 60. When a binder strip 14 is loaded onto Drum 22, the strip will cover slot 22H so that the slot will not be detected by the drum edge sensor 92. The slot will be detected if no strip is present. This feature is used to determine, during an Self Test & Initialization sequence whether a binder strip 14 had been loaded onto the Drum 22 in a previous operation. As will be explained in greater detail, if such a strip is found, the strip will be ejected.

Clamp Mechanism

As previously noted, Drum 22 has a recess 22D (FIGS. 28, 29A and 29B) for receiving the Clamp Mechanism 46 which operates to secure the leading edge 14A of the binder strip as the strip is fed into the Printer by way of the Strip Load Assembly 24. The Clamp Mechanism 46 is mounted on the Drum 22 by way of a clamp pivot pin 162 so that the strip clamp 60 can be rotated to one of the closed, open and eject positions. As previously described, control of the strip clamp 60 on the Drum is carried out by a clamp actuate arm 62, with rotation of the arm about the pivot pin 162 functioning to control the strip clamp 60 position.

A clamp spring 166, having one end secured to the clamp by way a clamp spring support member 60D and a second end secured to the Drum 22 by way of a spring support member 168 mounted on the Drum, functions to bias the strip clamp 60 to the closed position. The clamp spring 166 is tensioned between the two support members 60D and 168 so as to exert a relatively large clamping force on the end of the strip 14. As will be explained in greater detail, the clamp actuate arm 62 is positioned to engage various stops as Drum 22 rotates, with rotation of the Drum resulting in an actuating force being applied to the arm 62 which overcomes the tension applied by the clamp spring 166. This will cause clamp 60 to move from the normally closed position to either the open or eject positions, depending upon the amount of displacement of the actuate arm 62.

Figure 34A:
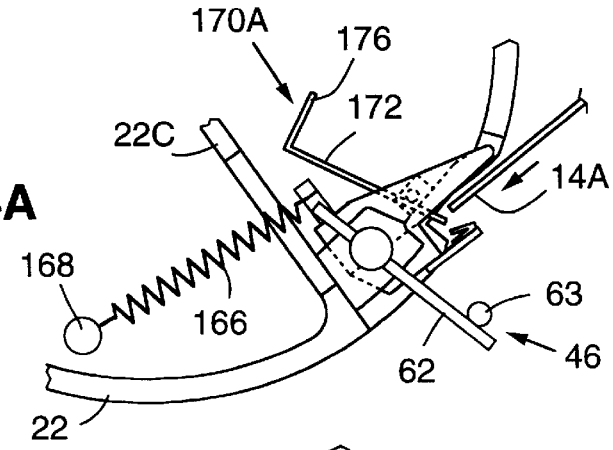
FIGS. 34A and 34B are partial views of the Clamp Mechanism receiving the leading edge of a binder strip.
Figure 34B:
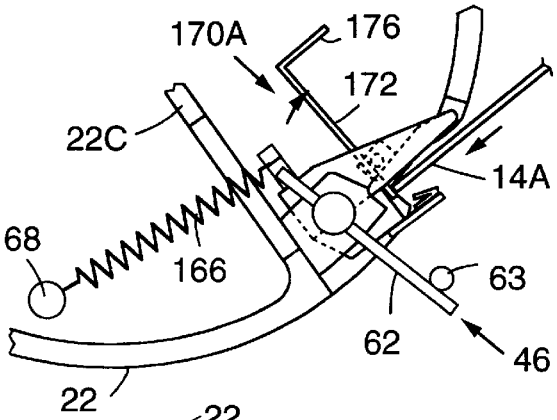

Insertion of the leading edge 14A of the binder strip into the Clamp Mechanism 46 during the loading sequence is sensed by a strip end sensor 170, as previously described. The strip end sensor 170 is operational only when the Drum 22 has been rotated to a load strip position, as will be described. The optical sensor 170 includes a flag 170A which is pivotally mounted on the Drum and positioned to be displaced by the leading edge 14A of the binder strip when the edge of the strip is positioned within the strip clamp 60 when the clamp is in the open position as shown in FIGS. 34A and 34B. The strip end sensor 170 includes an optical detector 170B mounted on frame member 52B, with the sensor creating an optical path which co-operates with the flag 170A when the Drum 22 is rotated to the load strip position.

Figure 29A:
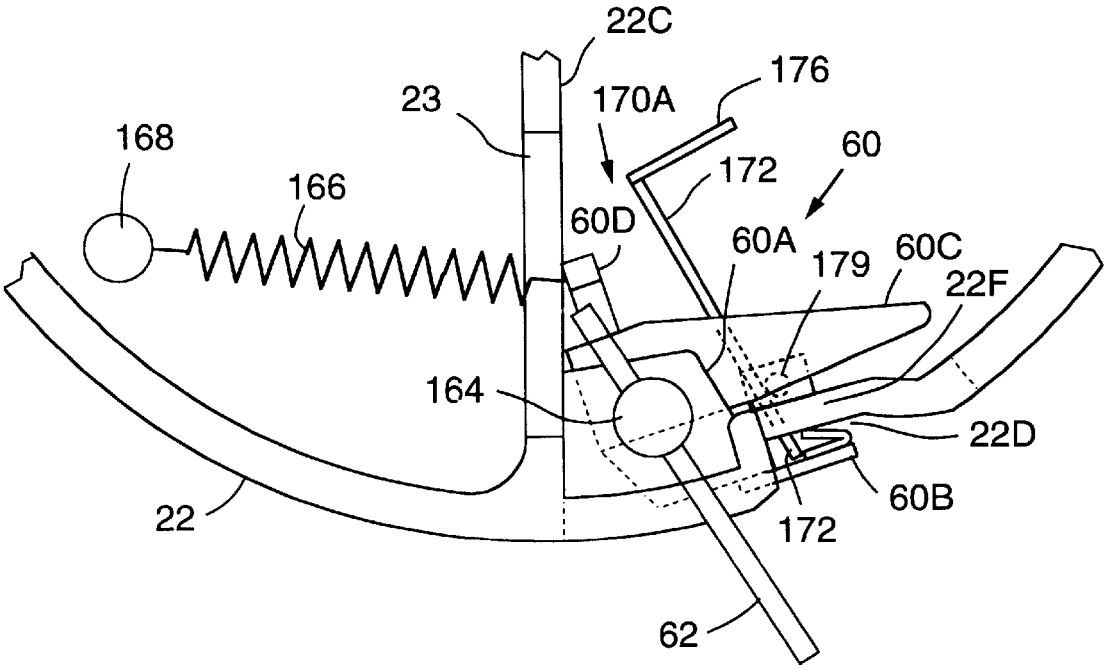
FIGS. 29A and 29B a partial section views showing details of the clamp mounted on the Drum for securing the leading edge of the binder strip.
Figure 29B:
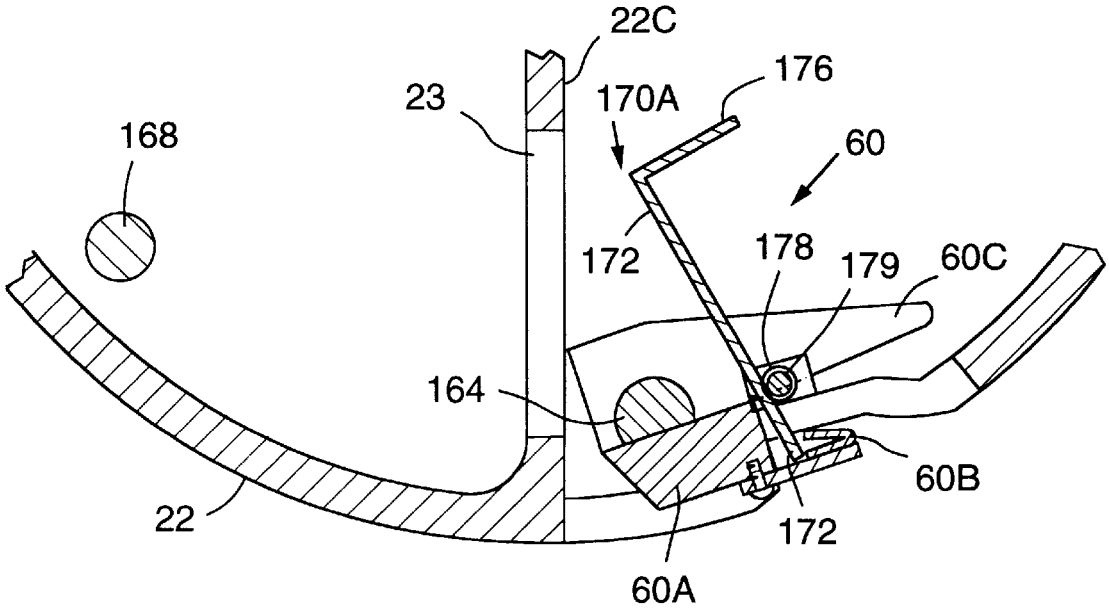

As can best be seen in FIGS. 28, 29A and 29B, the pivoting flag 170A includes an actuator portion 172 which engages the edge 14A of the strip, a flag portion 176 which is parallel with the Drum shaft and which passes through the optical path of the optical detector 170B when a strip has been received by the Clamp Mechanism 46. The pivoting flag 170A further includes a support portion 174 secured to the Drum 22 and which pivotably supports the flag portion 176 on Drum 22. A spring 178 connected between the supporting portion 174 and flag portion 176 functions to bias the flag portion 176 to a disengaged position. The force applied to actuator portion 172 by the leading edge 14A of the binder strip when the strip being loaded onto the Drum 22 will cause the flag portion to be displaced to an engaged position as can be seen in FIG. 34B. Such displacement will be detected by optical detector 170B provided the Drum 22 is in the home position.

Scraper Mechanism

The Scraper Mechanism 64 (FIG. 28) is rotatably mounted on the Drum support shaft 54. The Mechanism 64 includes a support member 180 having an opening for receiving the support shaft 54. The support member 180 is secured to an outer clutch plate 68A so that the outer plate and the Mechanism 64 will always rotate together. The outer plate 68A engages an inner clutch plate 68B, with the inner clutch plate being secured to Drum clutch surface 22B on the interior wall of the Drum 22. Thus, the inner clutch plate 68B and the Drum 22 will always rotate together.

A clutch spring 68C is disposed over the Drum support shaft 54 and is positioned intermediate the frame member 52C and the scraper arm support 180 and is compressed so that the spring will bias the outer clutch plate 68A against the inner clutch plate 68B. The outer plate 68A and the inner plate 68B are made of metal and cork, respectively, so that there exists a substantial amount of frictional coupling between to two plates. As will be explained in greater detail, unless the scraper arm 66 is fixed in place by the scraper arm locking mechanism 70, the scraper arm 66 will rotate with the Drum 22 as the Drum is rotated. Thus, clutch 68 is in the drive state. If the arm 66 is locked in place, the Drum drive motor 56 will provide sufficient drive force to overcome the frictional coupling of the scraper arm slip clutch 68. Thus, clutch 68 is in the slip state so that the Drum 22 will rotate while the scraper arm 66 remains fixed in place.

The scraper arm 66 is secured to the support member 180 by a mounting shaft (not depicted). The arm mounting shaft extends through the scraper arm 66, through an opening in the scraper arm support 180 and terminates in a locking pin 180C which extends away from the arm support. An arm spring 180D is disposed around the mounting shaft intermediate the scraper arm 66 and the arm support 180, with one end of the spring disposed in an opening formed in the mounting shaft and the other end disposed on an opening formed in the scraper arm 66. The arm spring 180D is wound such that a substantial rotational force is applied to the scraper arm 66 so that the strip engaging edge 66B of the arm is biased in a direction against the surface of the Drum 22. A block element 180E is positioned on the arm support 180 which engages the scraper arm 66 and which prevents the strip engaging edge 66B of the arm from actually contacting the Drum surface 22A so as to prevent Drum wear. The block element 180E should be positioned so that the scraper arm 66 will almost contact the Drum surface so as to ensure that an adequate force will be applied to the binder strip 14 by the scraper arm.

Figure 56A:
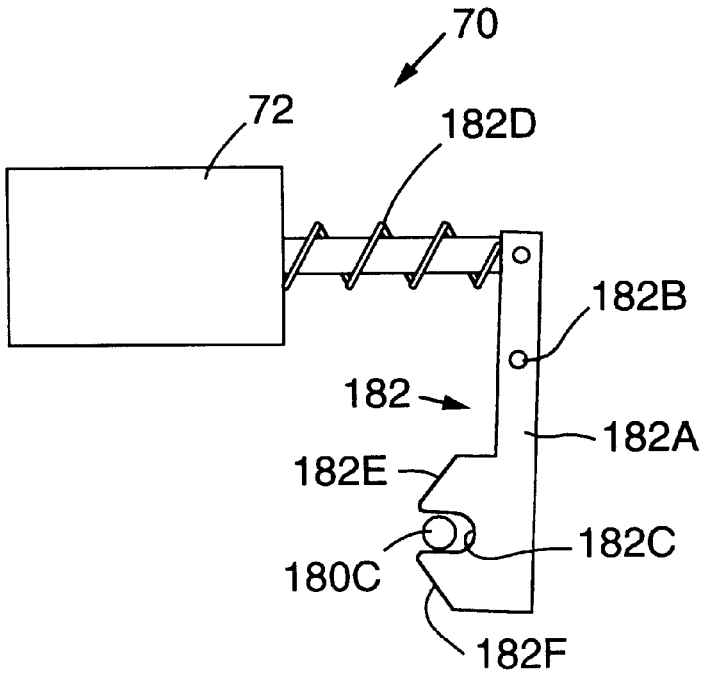
FIGS. 56A and 56B illustrate a portion of the mechanism for latching the Printer scraper arm, with FIG. 56A showing the scraper arm pin locked and with FIG. 56B showing the scraper arm pin unlocked so that the scraper arm is free to move.
Figure 56B:
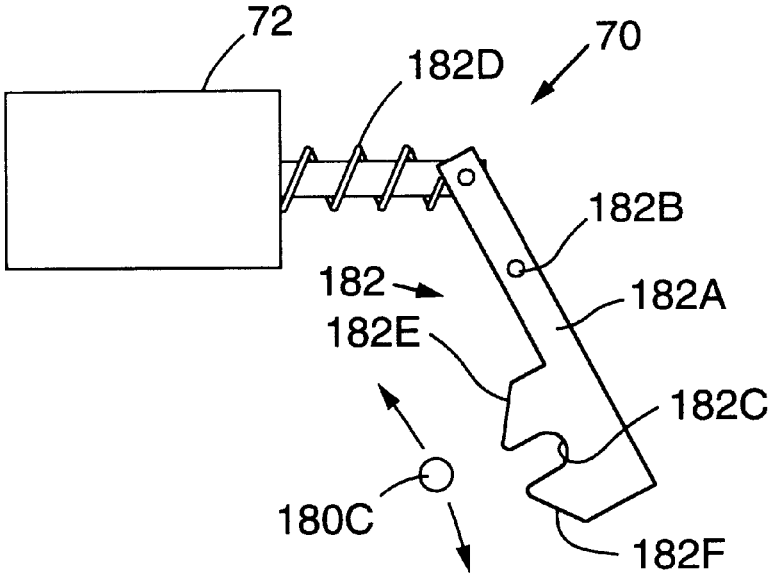

An arm flag 180F is formed on the arm support 180 which will co-operate with the Drum edge optical detector 92B mounted on the frame member 52C and the Drum edge optical emitter 92A mounted on the Print Head Carriage Assembly 74. This arrangement permits detection of the scraper arm 66 when the arm has been rotated by the Drum 22 to a home position. As can best be seen in FIGS. 56A and 56B, the scraper arm locking mechanism 70 includes a solenoid 72 mounted on the frame member 52C. The arm latch 182 includes a latch member 182A pivotably mounted on the frame member 52C by way of a pivot shaft 182B which engages the scraper arm locking pin 180C. The arm latch 182 includes a recess 182C which receives the locking pin 180C and secures the pin in place. The arm latch 182 further includes an upper cam surface 182E which can be engaged by the locking pin 180C when the solenoid is off (FIG. 56A) so that the pin can deflect the arm latch to an open position when the pin is moving downward (Drum 22 moving in the CW direction) thereby permitting the pin to become latched in recess 182C. A lower cam surface 182F is provided so that the locking pin 180C can be latched when moving in the upward direction (Drum 22 moving in the CCW direction). A portion of latch member 182A is positioned away from the frame member 52C so that notch 182C is in the proper position for engaging and disengaging the locking pin 180C. A solenoid spring 182D biases the latch member 182A so that when the solenoid 72 is off (not actuated), the latch member will is capable of engaging the locking pin 180C (FIG. 56A) if the scraper arm 66 is properly positioned relative to the arm latch 182. The latch mechanism 70 will engage the locking pin 180C when the scraper arm 66 carrying the locking pin 180C is positioned relative to the latch mechanism 70 when the solenoid is actuated (FIG. 56B) so that the pin can be captured in recess 182 (FIG. 56A). When the solenoid 72 is on (actuated), spring 182D is compressed and the latch member 182 is in the disengaged position so that scraper arm 66 is free to move with the Drum 22 as the Drum is rotated (FIG. 56B).

The arm 66 is latched by deactuating the solenoid 72 (FIG. 56A) and moving the arm in either the CW or the CCW direction until the pin engages the cam surface 182E or surface 182F, causing the latch 182 to deflect momentarily to an open position and to then to move back to the original position with pin 180C falls into recess 182C. It is preferable that Drum 22 be slowed down at the predicted point of engagement so that pin 180C will have time to fall into recess 182C.

Print Head Carriage Assembly

The Print Head Carriage Assembly 74 includes the print head mechanism 25 and the cartridge 76 for the foil ribbon 78. The Assembly 74 includes a carriage base member 184 mounted on front and rear rails 80 and 82 so that the print head mechanism 25 can be translated along the width of the binder strip 14 for printing. The rear and forward rails 80 and 82 are secured to the printer frame between frame members 52B and 52C. The carriage base member 184 includes a journal bearing 184A (FIGS. 30, 36 and 37) which receives the rear rail 82, with the bearing and rail having relatively close tolerances so that the print head mechanism 25 can be precisely controlled. The print head carriage drive mechanism 186 includes a floating mounting bracket 188 (FIG. 37) which is mounted on the rear rail 82 and is free to rotate about the rear rail. The carriage drive motor 84 (FIG. 32) is mounted on the frame member 52C and drives lead screw 86 rotatably mounted on the floating mounting bracket 188. The drive motor 84 drives the lead screw 86 by way of a drive train 88 which includes drive gears 88A and 88B (FIG. 37). Since the floating mounting bracket is free to rotate about the rear rail 80, the relationship between rail 80 and lead screw 86 remains fixed even when the printing gap is adjusted by rotating rear bearing 82, as will be explained.

The lead screw 86 extends through a drive nut 90 mounted on the carriage base member 184 so that rotation of the screw causes the base member to be translated relative to Drum 22. A lead spring 190 is provided to eliminate back lash created by the interaction between the lead screw 86 and the drive nut 90. One end of the spring 190 is attached to the base member 184 by way of pin 184A and the other end is secured to the floating bracket 188 by way of pin 188A near the drive motor 84. Spring 190 is looped around a pulley 192 mounted on the opposite side of the floating bracket 188 so that tension will always be applied to the carriage base member 184 as the base member is translated during printing.

The cartridge drive mechanism 194 is mounted on the base member 184 on the side opposite to the removable cartridge 76. The mechanism 194 includes a drive motor 194A which drives a ribbon advance pinion 194B by way of a drive chain 194C which includes a pair of gears. The connection between drive motor 194A and the drive motor electronics mounted on the primary printed circuit board 108 is made by way of two ribbon cables 198A and 198B which extend from respective connector 200A and 200B located on a separate carriage printed circuit board 196 which is secured to the base member 184.

Most of the details of the print head mechanism 25 will be subsequently described. The print head mechanism 25 is mounted on the carriage base member 184, with the body 202 member of the mechanism being disposed in opening 184C (FIG. 36) in the base member. The mechanism 25 is secured to the base member 184 by way of a pair of mounting screws 204 which extend through openings 184C in the base member and openings 203C in the print head mechanism 25. The print head printed circuit board 206 is electrically connected to connector 200A located on the carriage printed circuit board 196, with the second ribbon cable 198A extending from connector 200A to the primary printed circuit board 196. The two ribbon cables 198A and 198B are folded so as to provide sufficient length cable length so that the Carriage Assembly 74 is free to move laterally.

The optical emitter 92A of Drum edge sensor 92 is mounted on the upper surface of the carriage base member 184 in opening 184D (FIG. 36) adjacent the print head mechanism 25. The Drum edge optical detector 92B is mounted above the optical emitter 92A on a mounting bracket 208 secured to frame member 52C. The optical emitter 92A moves with the Print Head Carriage Assembly 74 and, when appropriately positioned relative to the Drum 22, functions to measure the skew of the binder strip 14 so that such skew can be compensated for when printing takes place. As previously noted, the Drum edge sensor 92 also functions to sense the position of the scraper arm 66 during the Self Test & Initialization sequence and to detect the position of the binder strip 14 once it is loaded on Drum 22.

Figure 55A:
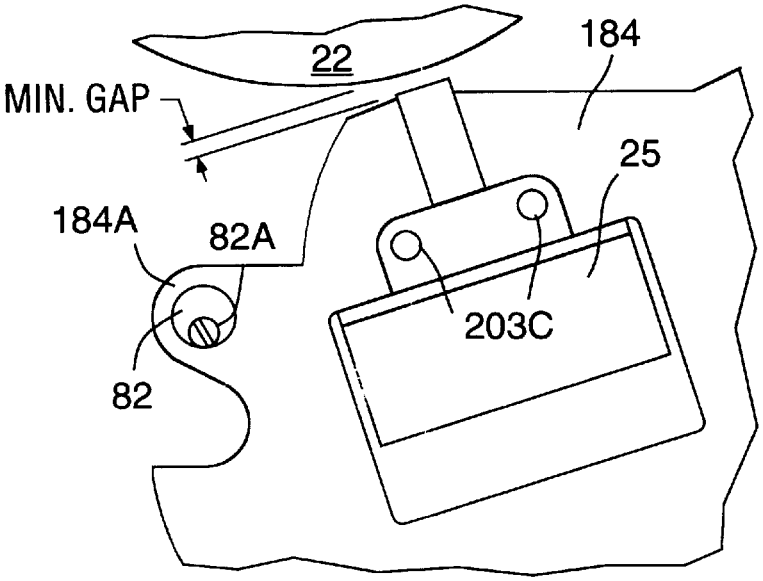
FIGS. 55A and 55B are diagrams illustrating the manner in which the spacing of the print head relative to the drum is controlled.
Figure 55B:
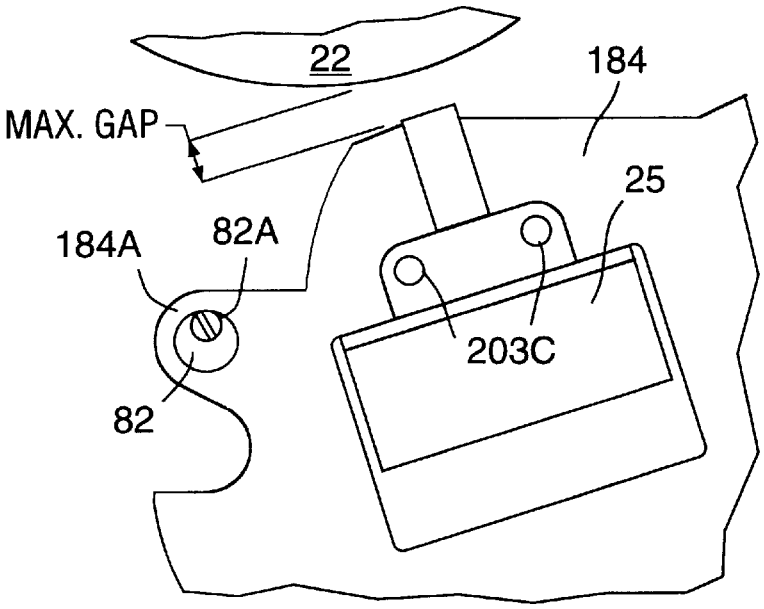
Figure 54:
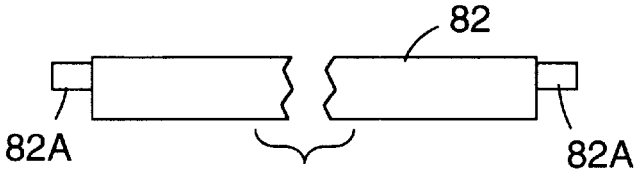
FIG. 54 illustrates the rear rail used to support the print head carriage assembly and used to adjust the spacing of the print head relative to the drum.

The rear support rail 82 (FIG. 30) of the print head carriage assembly 74 is used to control the spacing between the print head mechanism 25 and the drum. Referring to FIG. 54, rail 82 is provided with a pair of mounting extensions 82A which have a longitudinal axis which is offset from the longitudinal axis of the rail 82. The mounting extensions are secured within bearings (not depicted) mounted on frame members 52B and 52C. As can be seen in FIG. 55A and 55B and as previously noted, the rail 82 extends through a journal bearing 184A of the base member 184. A slot (not depicted) is formed in the mounting extension 82A rotatably mounted on frame member 52C so that a screw driver can be used to rotate the extension and the rail 82 connected to the extension. Since the rail axis and the extension axis are offset from one another, rotation of the extension will result in eccentric rotation of shaft 82 which supports the rear portion of the carriage base 184. As shaft 82 rotates, the rear position of the base 184 and the print head mechanism 25 supported by the base will be altered with respect to the drum 22. FIG. 55A shows shaft 82 rotated to a first position which results in the print head mechanism 25 being relatively close to drum 22 so as to minimize the head gap. FIG. 55B shows shaft 82 rotated to a second position which results in the print head mechanism 25 being relatively displaced from the drum 22 so as to maximize the head gap. Shaft 82 can be set to any value intermediate the first and second positions so that any gap spacing between the maximum and minimum value can be selected. A set screw (not depicted) is used to prevent further rotation of shaft 82 once the desired head gap has been selected.

Figure 36:
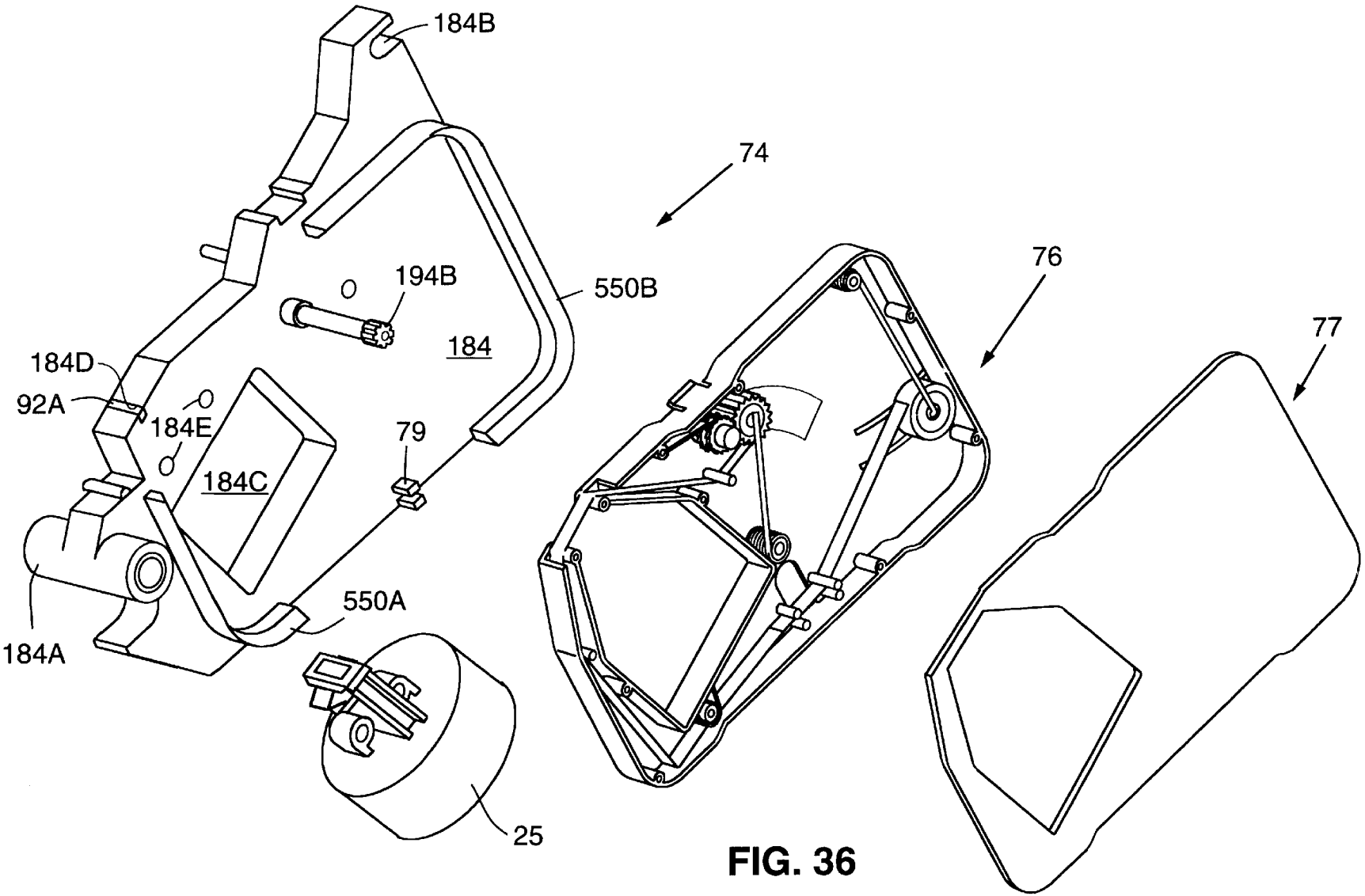
FIG. 36 is an exploded view of the Print Head Carriage Assembly including the ribbon cartridge.
Figure 37:
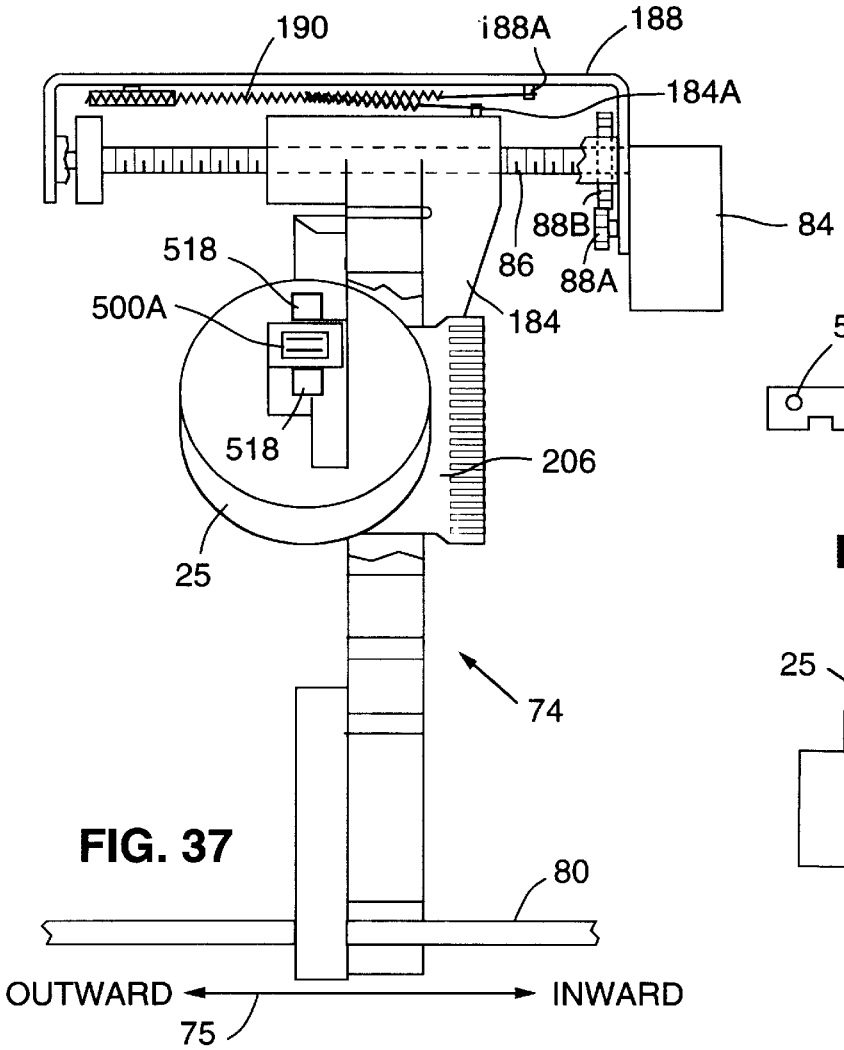
FIG. 37 is a partial plan view of the Print Head Carriage Assembly.

As can best be seen in FIG. 36, the base member 184 includes a pair of cartridge guides 550A and 550B mounted on opposite ends of the base member 184 which guide the cartridge 76 when the cartridge is installed and which support the cartridge after installation. The base 184 further includes an optical sensor 79 which extends into the ribbon cartridge 76 and which senses the presence of the ribbon 78 which will be disposed between the two halves of the sensor 79.

Print Head Mechanism

The Print Head Mechanism 25 is based upon a conventional dot matrix print head which has been modified is several important respects. A modified print head manufactured by DHTech of San Diego, Calif. having model designation DH2024 has been found suitable for this application although other conventional print heads could also be modified for use. Further, the circuitry for driving the Print Head Mechanism 25 differs from that used in combination with a conventional dot matrix print head.

Dot matrix print heads include print heads where the print pins are ballistically driven in the sense that once the print pins are initially provided a driving force, the pins are free to travel to the print medium independent of any linkage. The force exerted on the medium is equal to the kinetic energy of the pin that was imparted to the pin when the pin was first actuated. Dot matrix printers further include print heads wherein the print pins remain captured by the drive linkage, with the linkage operating to apply a driving force to the print pins throughout the travel of the pin to the print medium and are capable of applying a driving force even after the print pins have contacted the medium. Modified dot matrix printers of the captured pin variety are utilized in the present invention.

Figure 53:
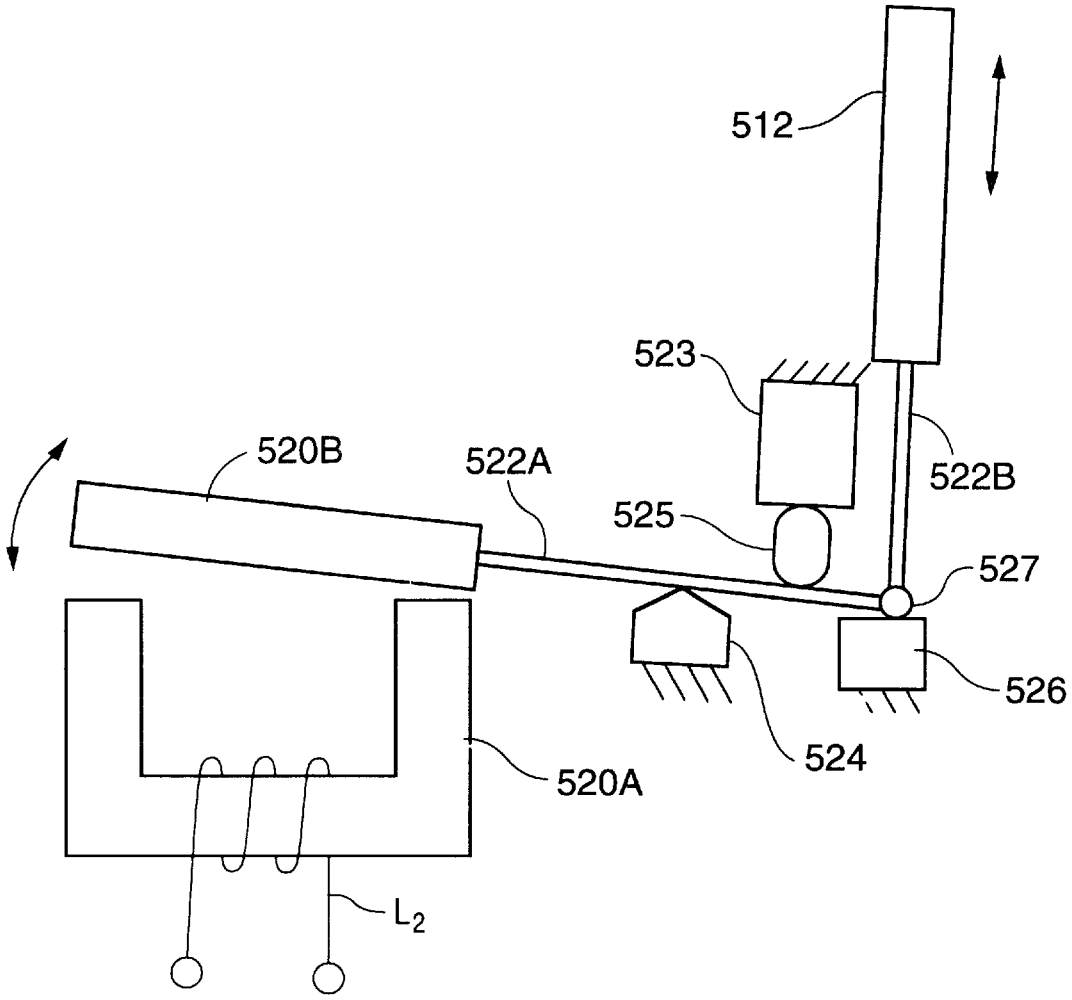
FIG. 53 is a simplified schematic diagram of the drive coil, print pin and mechanical linkage as used in a conventional dot matrix printer.

FIG. 53 is a simplified schematic diagram of the drive linkage associated with a single print pin 512. The drive linkage is conventional. As will be explained in greater detail, each print pin has an associated drive coil, including drive coil L2 associated with print pin 512. coil L1 is wound around a U-shaped pole pieces 520A which attracts an armature 520B when coil L1 is actuated so that the armature 520B is in a position bridging pole piece 520A. The armature 520B is mechanically connected to the print pin 512 by linkage members 522A and 522B, with these elements being connected together by a pivotable joint 527. Linkage member 522B is connected to one of the print pins 512 and linkage member 522A is connected to armature 520B. Linkage member 524 pivots about a fixed pivot mount 524, with fixed stop 526 limiting movement of member 522A in one direction. An elastomer spring 525 positioned between a fixed mounting member 523 and linkage member 522A biases the end of linkage member 522A against fixed stop 526 when coil L2 is not energized.

When coil L2 is energized, armature 520B is attracted to pole piece 520A thereby causing the elastomer spring 525 to become compressed as linkage member 522A pivots about pivot member 524. This action causes the pivotable joint 527 to be lifted off of fixed stop 526 and the print pin 512 to be driven towards the medium. When coil L2 is deenergized, the force compressing elastomer spring 525 is removed so that the spring will cause the pivotable joint to move back to stop 526. Note that the mechanical linkage will place a limit on the maximum travel for the print pint 512.

FIGS. 47A–47D are various exploded view of the Print Head Mechanism 25. Mechanism 25 includes the main body member 202 which contains the twenty-four solenoids (not depicted) for independently actuating respective ones of the twenty-four print pins in response to drive signals applied to the print head PCB 206. The solenoids and associated mechanical components located in main body member 202 are the same as used in a conventional dot matrix printer mechanism as depicted schematically in FIG. 53.

The twenty-four print pins (not depicted) are arranged in the conventional manner, there being two staggered rows of twelve pins each. The print head mechanism 25 is mounted on the print head carriage assembly 74 such that the two rows of pins are aligned along axes parallel to the axis of rotation of Drum 22. The pins are longer than conventional pins to as to accommodate, among other things, a heating element 506, which operates to heat the print pins. Preferably, the print pins are made of high speed steel which is less brittle and less costly than carbide steel sometimes used in print pin applications. A pin guide support 203 extends from the main body member 202 and operates to support several pin guides 500, including output pin guide 500A. Pin guides 500 and the print pins are not depicted so as not to obscure the remaining structure. The pin guides 500 are preferably made of plastic and are each provided with twenty-four openings to receive and guide the individual print pins so as to facilitate the transition of the orientation of the pins from that within the body member 202 to the final orientation of two parallel rows. Five sets of slots 203B are formed in the pin guide support to receive five spaced-apart pin guides 500. The output pin guide 500A is fabricated from ceramic and functions to support and guide the print pins and the transfer heat to the print pins as will be explained.

The Print Head Mechanism 25 further includes a heating element 506 having one electrical contact located on the upper surface and a second contact on the lower surface. Heating element 506 includes a central opening through which the twenty-four print pins pass. Heating element 506 is preferably a thermistor having a positive temperature coefficient. At temperatures below a predetermined transition temperature of the thermistor, the positive temperature coefficient is relatively small (resistance increases slowly with increases temperature), with the coefficient increasing rapidly at temperatures above the transition temperature.

When a voltage is applied across element 506, the element self heats until the temperature reaches the vicinity of the transition temperature. At that point, the rapid increase in resistance begins to limit the power dissipation and thereby limiting self-heating. Thus, the temperature will tend to decrease thereby causing the resistance to drop and the self heating to increase. Thus, heating element 506 will self-regulate at a temperature near the transition temperature. A thermistor manufactured by Ketema, Rodan Division of Anaheim, Calif. is suitable for this application. The thermistor should have a transition temperature of 160 degrees C., a resistance of 8 Ohms at 25 degrees C. and an operating voltage of 18 volts. In any event, the heating element 506 should operate at least 100 degrees C. and perferably at least 150 degrees C.

The heating element 506 is sandwiched between a lower insulating spacer 510 having a central opening and the upper output pin guide 500A so that the output pin guide 500A will be heated. Heat will be transferred from the pin guide 500A to the twenty-four pins by both conduction and radiation. An upper electrical contact 514 is disposed intermediate guide 500A and heating element 506 so that the contact will make an electrical connection to the top electrode of heating element 506. A lower electrical contact 516 is disposed intermediate the insulating spacer 510 and heating element 506 so as to make an electrical connection to the lower electrode of the heating element. The upper and lower contacts 514 and 516 and connected to flex cables 504 and 502, respectively. Cables 502 and 504 are connected to the input side of connector 206.

The output pin guide 500A, the heating element 506 and related structural elements are secured in place on the pin guide support 203 by a spring clip 518 having a central opening 518A through which the print pins pass during printing. The spring clip 518 includes a pair of opposing openings 518B which receive a corresponding pair of spring clip locks 203B formed on opposite sides of the spring clip guide 203. Locks 203B secure the spring clip 518 in place thereby securing the upper pin guide 500A, the heating element 506, contacts 514 and 516 and related structure in place. The spring clip 518 is used to hold the assembly together as opposed to adhesives commonly used in conventional dot matrix printers since the elevated operating temperatures used in the present application would tend to degrade the adhesive.

In a conventional dot matrix printer, the exact location of the end of the print pins is specified to the manufacturer with reference to the two mounting openings 203C. However, it is preferably in the present application to reference the location of the end of the print pins to the output pin guide 508A given the extended length of the print pins. Further, it is desirable to minimize the distance the print pins extend past output pin guide 508A when the pins are in the home or rest position as compared to pins of conventional dot matrix printers. The print pins of the present application are subjected to sufficiently greater forces than those of a conventional printer that it is preferable to reduce the total distance that a pin extends past the outer guide so that when the pin is at the end of the stroke, the pin is less likely to flex or bend when the pins strike the ribbon 78 and binder strip 14.

It is important to precisely control the position of the print head mechanism 25 relative to the binder strip 14 during printing. The print pins 512 of the exemplary print head mechanism have a no load stroke of 0.016 inches. In other words, the end of the pins are capable of moving 0.016 inches from the home position to the maximum, fully extended, position. The print head gap, the distance between the end of the print pins in the rest position and the surface of the drum, as depicted in FIGS. 55A and 55B, is set to 0.031 inches in the exemplary embodiment by rotating shaft 82 as previously described. The nominal thickness of the ribbon 78 is 0.001 inches and the nominal thickness of the binder strips 14 is 0.025 inches. Thus, when the print pins are driven to be at or near the fully extended position of 0.016 inches, the pins will cause the ribbon/strip combination to compress from a nominal value of 0.026 inches to a value approaching 0.015 inches in the region where the pins impact the ribbon/strip combination. The resultant pressure combined with the elevated temperature of the print pins and the duration of the applied pressure, effectuate the transfer of material from the ribbon 78 to the binder strip 14 in the region where the print pins impact. The various dimensions will most likely have to be adjusted to accommodate a particular application.

Figure 50:
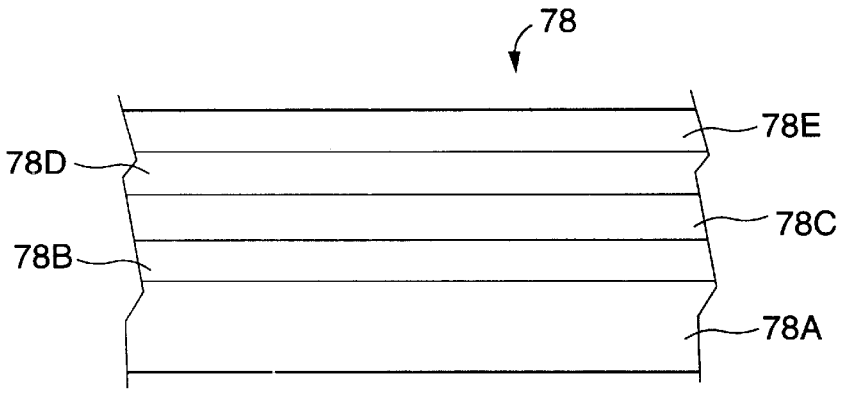
FIG. 50 is a cross-sectional view of the foil ribbon preferably used in the subject Printer.

A cross-section of the ribbon 78 used for printing is shown in FIG. 50. The ribbon includes a base layer 78A approximately 12 microns thick which provides support for the remaining layers. The base layer 78A is preferably made of polyester. A release layer 78B, preferably made of wax is disposed above the base layer 78A and deposited at about 100–200 grams per square meter. Release layer 78B operates to allow the print image to separate from the base layer 78A.

A color layer 78C is formed above the release layer 78B and is a lacquer with a color tint. The lacquer is deposited at about 96 grams per square meter. Layer 78D is a metalization layer in the form of a vacuum sputtered aluminum layer thereby providing a metalized appearance to the print. Finally, an adhesive layer 78E is formed above the metalization layer 78D and operates to bond the metalization layer 78D and the color layer 78C to the binder strip substrate 14C during and after the printing sequence. In some instances, the metalization layer is omitted and the color layer includes opaque pigment so that non-metallic colors are created. The elements of the ribbon that are transferred to the binder strip so as to form the print, including the metalization layer 78D and the color layer 78C, are collectively referred to herein and defined herein as ink.

Ribbons which may be used in the present application are available from several sources and are commonly referred to as hot stamp foil. By way of example, foils available from Crown Roll Leaf, Inc. of Paterson, N.J. having the product designations SA88, BH88 and ZA88 have been found suitable for the present application. Other sources include Dri-Print Foils, Inc. of Rahway, N.J. and Transfer Print Foils of East Brunswik, N.J. It has been found that foils having a relatively thick adhesive layer 78E and having a release layer 78B which permits the remaining layers to easily be separated from the base layer 78A have the attributes conducive to the present application.

Figure 49:
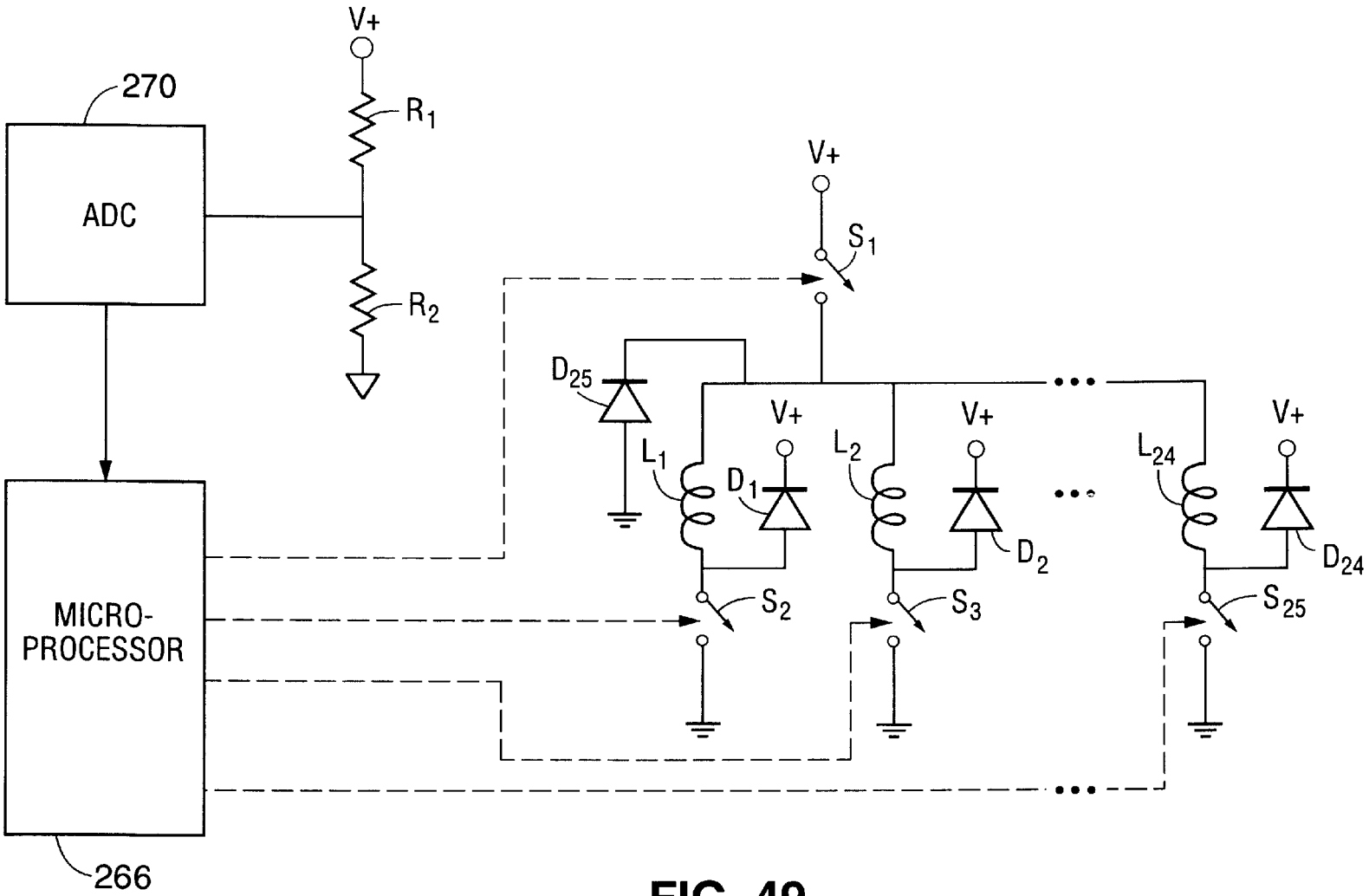
FIG. 49 is a schematic diagram of the circuitry for controlling the drive current used in the print head mechanism of the subject Printer.

Printing is accomplished by conducting current through the twenty-four coils L1–L24 associated with respective ones of the twenty-four print pins and depicted in FIG. 49. The driver circuitry of the present invention provides a relatively long duration current pulse so that force is applied to the print pin as the pin accelerates towards the ribbon 78 and binder strip substrate 14C and continues to apply force after the pin impacts the ribbon/substrate. Thus, the pin is forced and held against the ribbon/substrate thereby facilitating the transfer of the ribbon material to the substrate 14C of the binder strip 14.

Figures 48A, 48B:
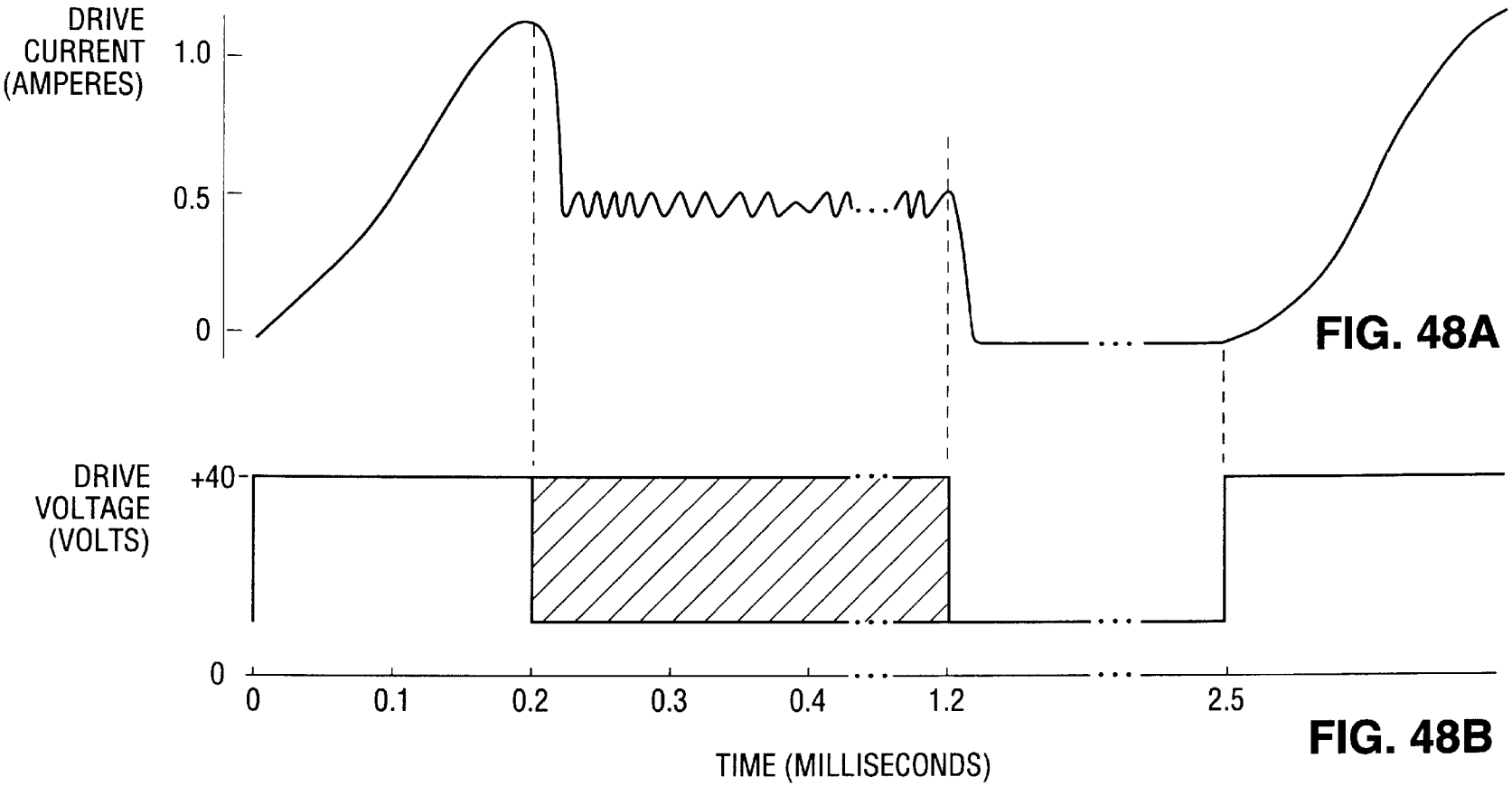
FIG. 48A is a timing diagram showing exemplary current pulses for driving the print head mechanism of the subject Printer.
FIG. 48B is a timing diagram showing exemplary voltage waveforms that are used to generate the FIG. 48A current pulses for driving the print head mechanism.

FIG. 48A depicts exemplary current drive pulses as used in the present invention. It is important to note that the duration of the drive pulses is in the present invention are on the order of 1200 microseconds whereas typical prior art printers utilize pulses have a duration of 250 microseconds. The drive current amplitude must be controlled in order to achieve efficient printing. Prior art controllers utilize pulse width modulation with feedback to control current magnitude. The present printer also utilizes pulse width modulation, but without feedback.

Figure 27:
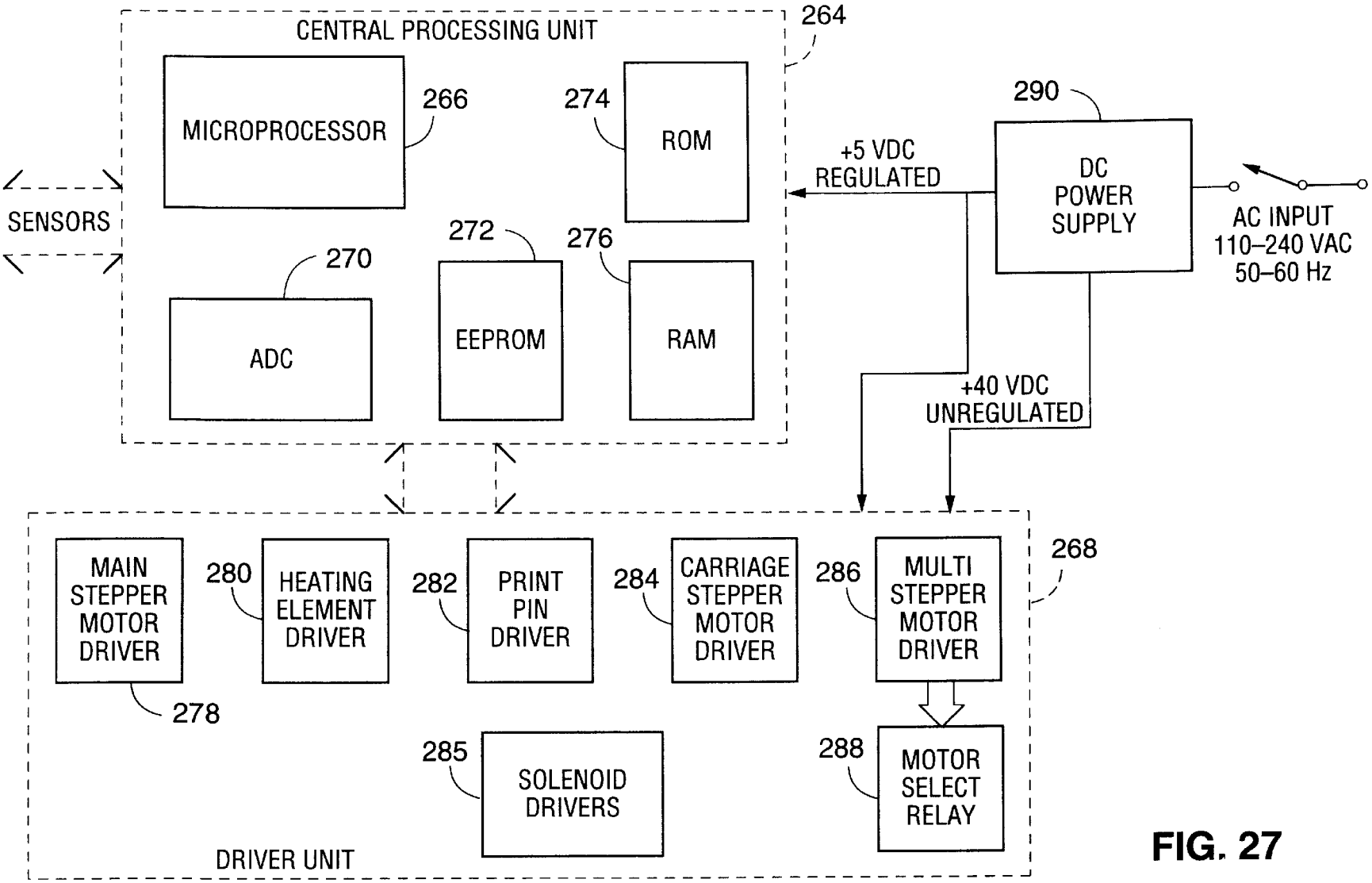
FIG. 27 is a block diagram of the principal electrical components of the subject Printer.

FIG. 49 is a simplified diagram illustrating the manner in which drive current amplitude is controlled. All of the coils L1 to L24 have a common terminal connected to one side of a switch S1, with the state of switch S1 being controlled by microprocessor 266. Switch S1 is preferably a switching transistor which forms part of the print pin driver 280 (FIG. 27). The other side of switch S1 is connected to voltage V+, this being the unregulated +40 volt power output provided by DC Supply 290 (FIG. 27).

The remaining terminals of coils L1 to L24 are connected to one side of separate switches S2 to S25, with switches S2 to S25 also being implemented from power switching transistors. Each switch S2 to S25 is controlled by a separate control line originating from microprocessor 266. The opposite side of each of switches S2 to S25 is connected to circuit common. Microprocessor 266 functions to control switches S1 to S25 is a predetermined manner so as to control the duration and amplitude of the drive current pulses.

The waveform of FIG. 48B depicts the voltage V+ applied to all of the coils L1 to L24 when one or more print pins is to be actuated neglecting losses due to series resistances and the like. When one or 10 more of the coils is selected by closure of the associated switch S2 to S25 which connects the remaining terminal of the coil to ground, the FIG. 48B waveform also depicts the effective drive voltage applied across the coil. As will be explained, the applied drive voltage is pulse width modulated in a manner such that a relatively large initial current is provided followed by a smaller current.

The FIG. 48B current drive waveform is created by closing switch S1 for a duration equal to the duration of the current pulse (typically 1.2 milliseconds). Assuming that the print pin 512 associated with coil L2 is to be actuated, microprocessor 266 will also proceed to control switch S3 in a predetermined manner. The switches of coils not to be actuated will remain in the off state. When switch S3 is turned on, the voltage V+ applied to coil L2 will cause current flow to start as can be seen at the leading edge of each current pulse of the FIG. 48A waveform. The current flow will increase at a known rate which is generally directly proportional to the magnitude of the drive voltage V+ and inversely proportional to the inductance of the drive coil L2. Switch S3 is turned off after a predetermined time period, in this example 0.2 milliseconds, at a point where the initial drive current is at a predetermined amplitude. Typically, the maximum current is set near the maximum rated drive current although the rating can be safely exceeded given the relatively short period that the current is applied relative to the operating frequency. In this example, the drive current will reach an amplitude of approximately 1.2 amperes at 0.2 milliseconds. The duration of the pulse can be adjusted to control the magnitude of the initial current pulse, this being a form of pulse width modulation. Preferably, the duration is also sufficient to ensure that the print pin has fully contacted the ribbon 78 and underlying binder strip 14.

The initial drive current pulse causes the print pin to drive the print pin 512 against ribbon 78 and the underlying binder strip 14 with a very substantial force. The print pin is accelerated towards the ribbon 27 and binder strip 14 over a substantial distance so that the pin acquires a large amount of kinetic energy. The print pin is rapidly decelerated when the pin strikes the ribbon and binder strip thereby transferring the kinetic energy in a short period of time. Thus, the force applied to the ribbon and binder strip is large and estimated to be on the order of 1000 grams. By the end of the initial pulse at 0.2 milliseconds, the pin 512 will be at or near the end of the 0.016 inch stroke as determined by the mechanical linkage (FIG. 53) with the armature 520B being positioned across the pole piece 520A so as to essentially eliminate any air gap between the armature and the pole piece or to approach that condition.

With the magnetic circuit reluctance substantially reduced at this point due to the position of armature 520B relative to the pole piece 520A, the amplitude of the drive current can be substantially reduced while maintaining a substantial pin driving force. The value of the reduced current can be determined for a particular application by adjusting the current amplitude and monitoring the quality of the printing. It has been found that the quality of print drops off at some minimum holding current level, probably due to the increased magnetic reluctance when the armature 520B (FIG. 53) is displaced from the pole piece 520A. The actual current level used is selected to be greater than the holding current level by 20%. Typically, the current is reduced from a peak value of 1.2 amperes to approximately 0.5 amperes. This results in the print pin applying a force in the range of 100 grams. The reduced current level at this stage of the print sequence greatly reduces the amount of heat generated in the print head mechanism 25, thereby increasing reliability and the working life of the print head mechanism 25 and the overall printer. Further, the likelihood of injury to a user as a result of contacting the exposed print head mechanism is eliminated. The current should be reduced from the peak value to a value less than 75% of the peak value and preferably less than 50% of the peak value.

The reduced current amplitude is controlled by pulse width modulating the drive voltage at a frequency of approximately 30 KHz, with the duty cycle, that portion of the cycle where the drive voltage is applied to the drive coil, being nominally 20% to 30% and being adjustable to control the current amplitude. At approximately 1.2 milliseconds, switch S3 is turned off and is not turned on again until the pin is to be actuated a second time. Switch S1 is also turned off at this time. Thus, the drive current is essentially removed.

Assuming that the maximum clock speed of the print head mechanism is 400 Hz, the pin associated with coil L2 cannot be driven until 2.5 milliseconds. Thus, it can be seen that the duty cycle for driving the print head mechanism is 48% (1.2/2.5). A conventional dot matrix printer is typically driven with a duty cycle of 10% to 20%. The duty cycle should be at least 35% and preferably at least 40%.

When microprocessor 266 turns switch S3 on and off during the pulse width modulation, current will tend to continue to flow through coil L2 since current through an inductor cannot change instantaneously. Diode D1 is provided to provide a current path to provide current to coil L2 so as to minimize the creation of large voltages across the coil due to inductance. At the end of the current drive period at 1.2 milliseconds, current would normally continue to flow through coil L2 for an unacceptably long period. Switch S1 is provided to facilitate the termination of current flow at the end of the current drive period. At the end of the period, switch S1 is turned off, with diode D25 serving as a current path so that current flow through coil L2 will drop rapidly, well prior to the initiation of a subsequent print cycle.

The amplitude of the current pulse would normally be dependent upon the magnitude of the unregulated supply voltage V+. In order to maintain the current amplitude at the desired levels, an ADC 270 receives the output of a voltage divider made up of resistors R1 and R2 which is indicative of the magnitude of V+. This output is digitized by ADC 270 and forwarded to microprocessor 266 which adjusts the pulse width modulation so that the current amplitude remains at the desired level during the initial stage of the current pulse and the reduced level during the final stage of the pulse notwithstanding variations in the magnitude of supply voltage V+.

The magnitude of the voltage actually applied across the drive coils L1 to L24 is not actually equal to supply voltage V+. The actual applied voltage is a function of the number of coils being driven in a particular print cycle. It is possible that all twenty-four print pins will be driven when, for example, a solid area is to be printed such as occurs when a large font type is used. In a typical system, there may be a total of 0.5 ohms in series with the supply line between the point at which ADC 270 measured voltage V+ and the magnitude of the actual voltage applied across the coils. This variation in actual voltage is due to switch resistance and the resistance of the metal tracks used in the printed circuit board between the supply output voltage V+ and the coils L1 to L24. Since each pin driven will require over 1 ampere of peak current and about 0.5 amperes at other times, it can be seen the actual voltage applied across the drive coils will drop significantly depending upon the number of pins being driven. For example, if all pins were driven during the same print cycle, the actual voltage applied may be reduced by a value in excess of 24 volts when the peak initial current is drawn and by lesser values at other times in the print cycle. Since ADC 270 does not measure the actual voltage applied to the coils, it is preferable that the pulse width modulation also be controlled as a function of the number of drive pins actuated at the same time. Such modulation would control both the duration of the initial pulse which is nominally 0.2 milliseconds and the duty cycle of the pulses from the end of the initial pulse to 1.2 milliseconds. This will ensure that the drive current remains at the desired levels thereby providing reliable operation under all conditions.

The effects of changes in the supply voltage V+ on the drive current levels can easily determined by direct measurements. For example, if the voltage level of V+ as determined by ADC 270 should drop 20%, the changes in modulation necessary to maintain the desired current levels can be ascertained. Further, the drop in the voltage actually applied to the drive coils based upon the number of coils to be actuated are known values. For example, the drop may be approximately 1.5% for each coil actuated. Since the number of coils to be actuated is a known quantity prior to actual printing, the changes in modulation can easily be implemented to maintain the current levels at the desired value independent of the number of coils to be driven. As is well known in the art, a simple algorithm can be used to convert the measured voltage V+ and the number of coils to be driven to a particular modulation level or, alternatively, a look-up table could be stored in memory which is used to make the conversion.

Rear Eject Assembly

As previously noted, the Rear Eject Assembly 96 cooperates with the other components of the Printer to remove the binder strip 14 from the Drum 22 after printing is completed and to eject the strip out of the Printer by way of the rear opening 20 of the housing 16. In the event the Printer is docked with a binding machine (not depicted), the strip 14 will be automatically transferred out of the rear opening 20 and loaded into the binding machine without intervention by the user.

The pinch roller 210 operates to support the binder strip 14 during the strip ejection sequence after one end of the strip has been released (FIGS. 30 and 31) during both rear and forward ejection. Pinch roller 210 further permits Drum 22 to drive the binder strip 14 during an initial portion of the rear eject sequence. The pinch roller 210 is supported on a supporting frame 212 by way of roller shaft 214, with the supporting frame 212 being mounted for rotation on a main shaft 216 which is secured to and extends between frame members 52B and 52C. A drive frame 218 is also rotatably supported on the main shaft 216 and is connected to the actuator arm 220A of the pinch roller solenoid 220. Thus, the drive frame 218 will pivot slightly about the main shaft 216 in response to actuation of the pinch roller solenoid 220. The drive frame 218 is coupled to the mounting frame 212 by way of a spring 222, so that actuation of the solenoid 220 will cause the pinch roller 210 to move upwards so as to engage a binder strip 14 located on the Drum 22 above the pinch roller. The spring 222 will be compressed slightly when the pinch roller 210 is engaged so as to enhance the gripping action of the roller and to allow compliance to the profile of the strip 14.

The Rear Eject Assembly 96 further include the eject trip arm 98 which is pivotably mounted on the frame member 52C and is moveable between an eject and a non-eject position. The lower portion of the eject arm 98 is coupled to the actuator arm 100A of an eject solenoid 100, with arm 98 being in the eject position when the solenoid is actuated. A spring 224 having one end secured to the trip arm 98 and a second end secured to the frame member 52C causes the eject trip arm to be moved to the non-eject position when solenoid 100 is not actuated. As previously described, when the eject trip arm 98 is moved to the eject position, the arm will engage the clamp actuate arm 62 of the Clamp Mechanism 46, with rotation of the Drum 22 causing the clamp actuate arm 62 to move the clamp to the eject position so that one end of the binder strip 14A will be lifted away from the Drum surface.

The eject drive mechanism 226 (FIGS. 5, 31, 32A, 32B and 33) of the Rear Eject Assembly 96 includes a drive shaft 102 rotatably mounted between frame members 52B and 52C, with one end of the drive shaft connected to drive pulley 58C which is driven drive pulley 58D by way of toothed belt 228. Drive pulley 58D is mounted on the shaft of the Drum drive motor 56. The two spaced apart knurled drive rollers 232A and 232B are mounted on the drive shaft 102 so that rotation of the Drum 22 by the Drum drive motor 56 will also cause rotation of the drive shaft 102 and the knurled drive rollers 232A and 232B. The knurled drive rollers 232A and 232B engage two rubber rimmed eject wheels 104A and 104B which are fixed to a shaft which carries a third rubber rimmed drive wheel 104C disposed intermediate the two wheels 104A and 104B. As previously explained, the three rubber rimmed wheels 104A, 104B and 104C operate to extract the binding strip 14 out of the Printer 10.

The knurled drive rollers 232A and 232B are forced into engagement with the two rubber rimmed wheels 104A and 104B, respectively, by a pair springs 234, each having one end connected to a shaft 236 which carries the three wheels and each having a second end connected to respective support members of the eject frame 106. The eject frame 106 is pivotably mounted on the drive shaft 102, with the shaft extending through openings formed in the eject frame 106 at opposite sides. The three rubber rimmed wheels 104A, 104B and 104C pivot into engagement with an eject roller 238 which is rotatably mounted on the printer frame 52 by way of a shaft 240 and a support member 240A which secures one end of the shaft 240 to frame member 52B. The rubber rimmed wheels 104A, 104B and 104C pivot about shaft 102 down onto the eject roller 238 so that the binder strip 14 can be gripped between the wheels and the roller during the ejection sequence when the wheels rotate in one direction but not in the other direction as will be explained. Note that Drum 22 and the eject wheels 104 are driven together in opposite directions so that when rotation of Drum 22 reverses, so does rotation of the eject wheels 104.

Figure 32B:
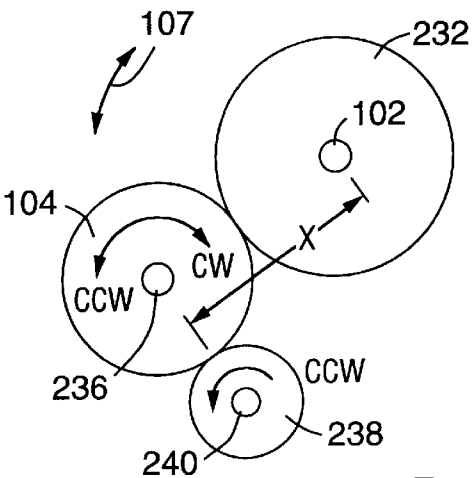
FIG. 32B is a diagram showing the geometry of a portion of the Rear Eject Mechanism.
Figure 32A:
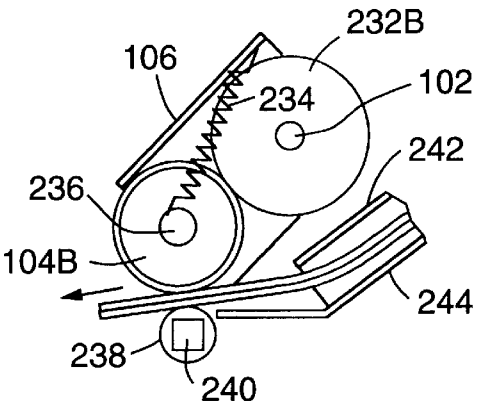
FIG. 32A is a partial view of part of the Rear Eject Mechanism showing a binder strip being ejected.

FIG. 32B is a schematic diagram showing the geometry of the drive roller 232, the eject wheels 104 and the eject roller 238, with certain dimensions being exaggerated. As previously noted, drive roller 232 and the eject wheels 104 are free to pivot about shaft 102 as indicated by arrow 107. The distance X between the shaft 102 and the point at which the eject wheels 104 engage the eject roller 238 is selected to be sufficiently large so as to prevent the eject wheels 104 from passing between drive roller 232 and eject roller 238. When the drive roller 232 causes the eject wheels to rotate in the CW direction, the eject roller 238 is driven in the CCW direction so that a binder strip interposed between wheels 104 and roller 240 would be drawn out of the Printer. However, when the eject wheels 104 are driven by drive roller 232 in the CW direction, rotation of wheels 104 tends to draw the wheels between the drive rollers 232 and the eject roller 238. Since there is insufficient space to accommodate wheels 104, the wheels 104 tend to be jammed between drive roller 232 and the eject roller 238 thereby preventing the wheels 104 from continuing to rotate in the CW direction. The driving force of roller 232 will result in the wheels 104 being momentarily lifted away from engagement of eject roller 238 and to pivot up in the direction of arrow 107. Once wheels 104 are no longer in contact with the eject roller 238, gravity will cause wheels 104 to fall back down into engagement with the eject roller 238 thereby causing the process to be repeated. The net result is that the eject wheels 104, when driven in the CW direction are not capable of driving the eject roller 238 or any binder strip 14 intermediate the eject roller 238 and the eject wheels 104. This construction further prevents any binder strip 14 from being driven back into the Printer by rotation of Drum 22 but allows an externally applied force, such as applied by a binding machine, to pull the binder strip 14 from the Printer without interference from the eject wheels 104.

An upper and a lower guide member 242 and 244 (FIG. 31), respectively, are disposed intermediate the pinch roller 210 and the rubber rimmed wheels 104A, 104B and 104C so as to guide the binder strip 14 from the Drum 22 to the eject drive mechanism. The rear guide members 242 and 244 are mounted on frame member 52C, with the upper guide member 242 having a cut-out 242A adjacent frame member 52C to accommodate the eject trip arm 98.

Optical Sensors

Many of the optical sensors used in the subject Printer 10 are configured to detect the presence of the binder strip 14. Such sensors include, for example, the strip in sensor 170 and the drum edge sensor 92, with the drum edge sensor operating to detect both the drum edge in certain operations and to detect the edge of the binder strip 14 for skew compensation. The binder strips 14 are difficult to detect since the change in the optical detector electrical output can vary considerably when a binder strip 14 is present. That is because darker strips are essentially opaque whereas light colored strips are semi-transparent and permit a significant amount of light to pass. Detector outputs will also vary due to optical misalignment, manufacturing variations in the sensors themselves and changes in ambient light which will affect those sensors adjacent the front and rear openings 18 and 20 in housing 16 and will affect essentially all sensors when the housing is removed for trouble shooting. Only those sensors required to detect the presence of a binder strip 14 are calibrated each time power is applied to the subject Printer as part of a Self Test & Initialization sequence to be described later. Those include the strip ejected forward sensor 140, the strip present sensor 146 and the drum edge sensor 92, with sensor 92 functioning to detect both the edge of the Drum 22 and the position of the binder strip 14 on the Drum. It is also desirable to calibrate ribbon sensor 79 since the optical characteristics of different types of ribbons will vary. As will be explained, ribbon sensor 79 is calibrated at the manufacturing facility and during maintenance rather than during the Self Test & Initialization sequence.

Figure 51:
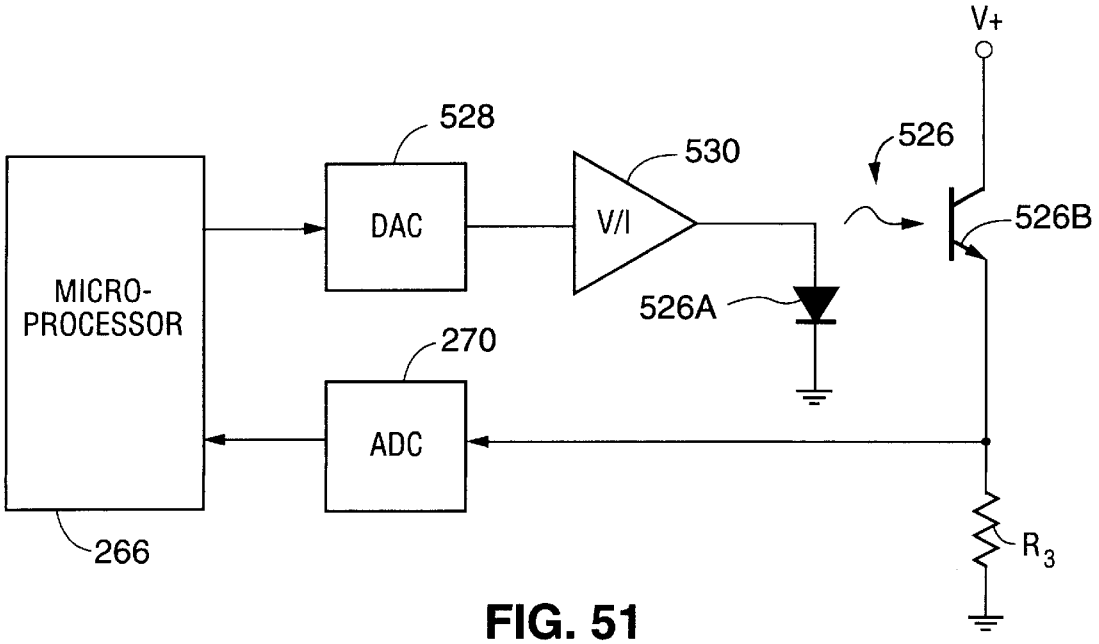
FIG. 51 is a schematic diagram of the circuitry for controlling the various optical sensors used in the subject Printer.

FIG. 51 is a simplified diagram of an arrangement for increasing the dynamic range of an optical sensor 526 so as to enable the sensor to operate over a wide variety of conditions. Microprocessor 266 generates an digital output having a magnitude which controls the magnitude of the drive current for emitter 526A of the optical sensor 526. The digital output is fed to a digital to analog converter (DAC) 528 which converts the digital value to an analog voltage. The analog voltage is converted to a current by voltage to current converter (V/I) 530. The current output is used to drive optical emitter 526A.

Sensor 526 further includes a detector 526B which produces a current indicative of the amount of light received by the detector. The detector current passes through a resistor R3 so as to produce an analog voltage across the resistor. This voltage is forwarded to analog to digital converter (ADC) 270 the output of which is received by microprocessor 266.

During the Self Test & Initialization sequence, microprocessor 266 causes the drive current to be set to a maximum value. If the resultant detector current is measured to be more than 75% of the full scale for ADC 270, the drive current is reduced and the cycle repeated until the measured current is at or slightly less that 75% of full scale. This sequence operates to maximize the dynamic range of the system.

Once the emitter 526A drive current is set, normal sensing is carried out by monitoring the ADC 270 output. When the light path between emitter 526A and detector 526B is interrupted by a typical binder strip 14, the strip will typically absorb approximately 80% of the light. The remaining 20% of light will cause the ADC 270 output to drop from 75% of full scale to 15% 20% of 75%) of full scale. Microprocessor 266 compares the ADC 270 output with a stored value equal to 37% of full scale to determine whether a strip 14 is detected.

As previously noted, ribbon sensor 79 is calibrated at the manufacturing facility and during maintenance since calibration requires that the ribbon 78 be removed. It is expected that ribbons having varying transparency will be used, with the most transparent ribbons being the most difficult to detect. The drive current to the emitter portion of sensor 79 is set to a relatively low value, with the switching threshold value being selected to detect ribbons which are of the highest transparency.

The drum edge sensor 92, as previously described, has an optical emitter 92A mounted on the Print Head Carriage assembly 74 and an optical detector 92B mounted on the printer frame member 52C. When measuring the location of the binder strip 14 on the Drum 22 for the purpose of skew compensation, the optical emitter 92A will move relative to the detector 92A. Sensor 92 is thus required to be capable of sensing the position of the binder strip 14 on the drum under varying conditions depending upon the location of the detector 92A relative to the emitter 92B. In order to obtain reliable detection, it is necessary to varying the switching threshold value depending upon the location of the detector 92A and emitter 92B as indicated in FIGS. 52A and 52B.

Figures 52A, 52B:
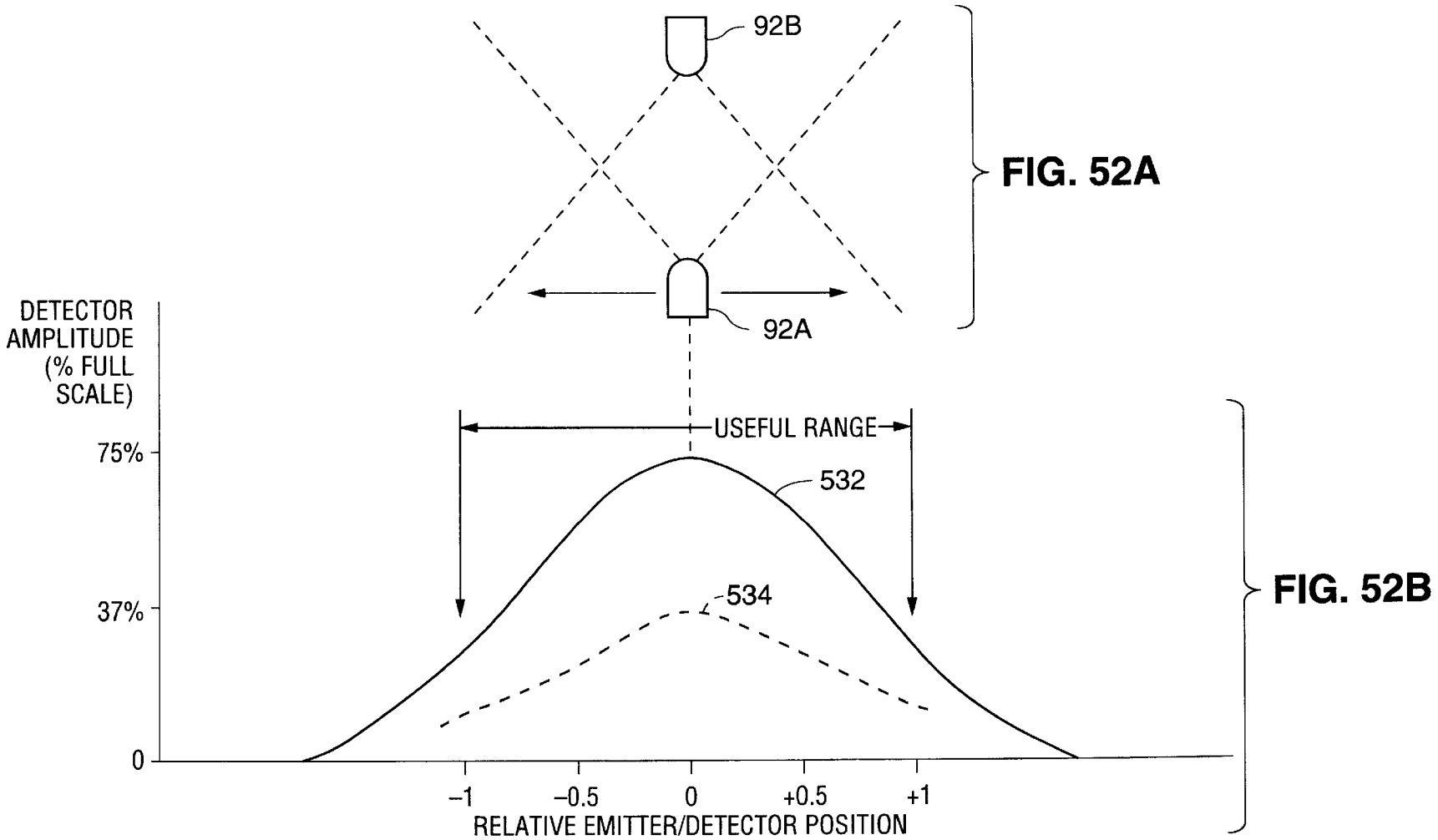
FIGS. 52A and 52B are diagrams illustrating the operation of the drum edge sensor used in the subject Printer.

FIG. 52A illustrates the manner in which emitter 92B can move relative to detector 92A as the Print Head Carriage Assembly 74 is moved when locating the edge of a binder strip 14 mounted on Drum 22. During the Self Test & Initialization sequence to be described later, the Head Carriage Assembly 74 is positioned such that the emitter 92A and detector 92B are aligned with one another, with this position being designated in the FIG. 52B diagram as position 0. The drive current for the emitter 92A is adjusted to produce as detector 92B output which is 75% of full scale in essentially the same manner as previously described in connection with FIG. 51.

Curve 532 of FIG. 52B represents the detector 92B output in percentage of full scale of ADC 270 as a function of the relative position of the emitter 92A and detector 92B. As can be seen from curve 532, the detector 92B output is at a maximum when the emitter and detector are aligned (position 0). The output drops off significantly when the emitter 92B is shifted in either direction, with the sensor 92 being outside a useful operating range when the displacement is greater than +1. Note that curve 532 does not take into account the presence of Drum 22 which causes the actual curve to be asymmetrical around position 0 since Drum 22.

Curve 534 of FIG. 52B represents the switching threshold values as a function of the relative position. Since the carriage drive motor 84 is a stepper motor, the relative position of the detector 92A and emitter 92B is known. The switching threshold value at position 0 is set to 75% of full scale as previously described. The threshold values are reduced when the relative position deviates from the aligned position (position 0), as indicated by curve 534. Preferably, several values of switching threshold are store in memory with a particular value being selected based upon the relative position. For example, as can be seen from curve 534, when the relative position is either −0.5 or +0.5, the threshold switching value is reduced to approximately 25% of full scale. When the relative position is either −1.0 or +1.0, the threshold switching value is reduced to only about 15% of full scale.

Ribbon Cartridge

Figure 38:
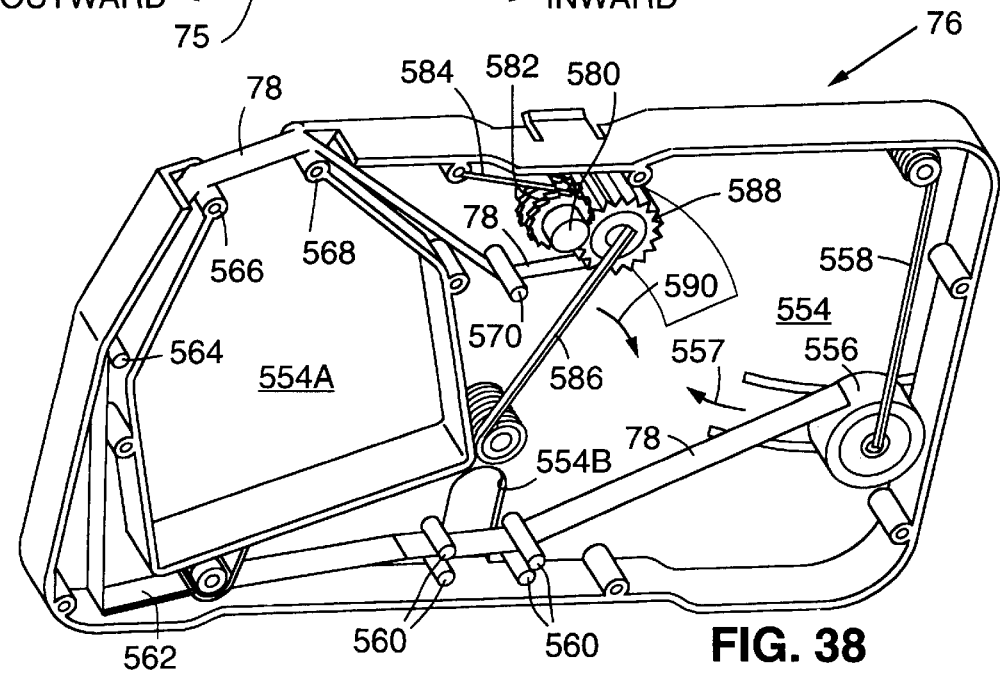
FIG. 38 is a perspective view showing construction details of the print ribbon cartridge.
Figure 41:
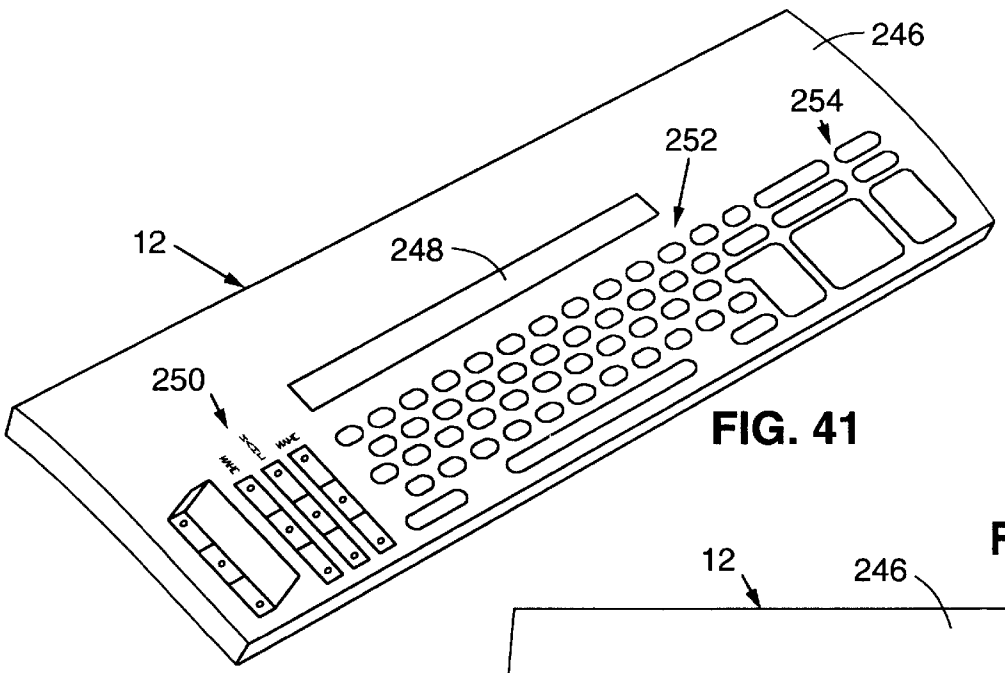
FIG. 41 is a perspective view of the control keyboard of the subject Printer.
Figure 42:
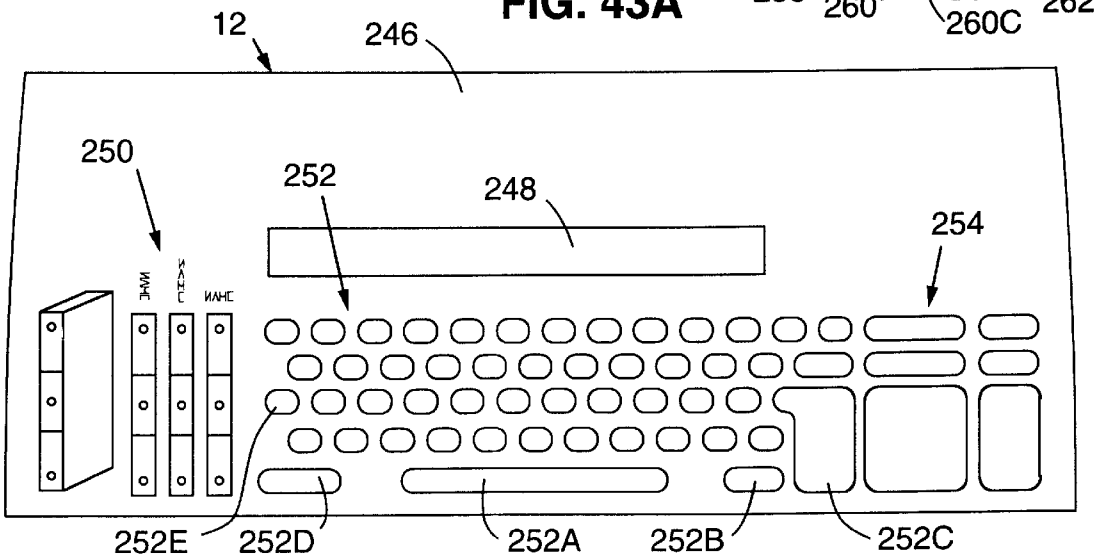
FIG. 42 is a plan view of the control keyboard of the subject Printer.

Additional details regarding the ribbon cartridge 76 are shown in FIG. 38. The cartridge 76 includes a plastic housing 554, which together with cartridge cover 77 (FIG. 36) enclose the ribbon 78 stored in the housing together with the associated hardware. The housing 544 is provided with an opening 554A shaped to accommodate the body of the print head mechanism 25 mounted on the carriage base member 185.

Cartridge 76 includes a capstan 580 which is driven by the ribbon advance pinion 194B mounted on the carriage base member 185 (FIG. 36). Capstan 580 carries a mace gear 582 which, as will be explained, engages the rolled used ribbon 78 and drives the rolled ribbon in a counter clockwise direction at a fixed rate during printing thereby pulling the ribbon off of the ribbon supply reel. A pawl 584 engages the mace gear 582 and prevents the gear from turning in the clockwise direction.

The used ribbon 78 becomes wound around a take-up gear 588. Gear 588 is rotatably mounted on a spring 586 which deflects in the direction of arrow 590 as the used ribbon becomes wound around gear 588. The teeth of mace gear 582 are sufficiently sharp to engage the roll of used ribbon and to drive the roll in the counter clockwise direction. The teeth of take-up gear 588 enable the mace gear 582 to initially drive the roll when little or no used ribbon has yet to been wound around the gear.

The unused ribbon 78 is wound around a ribbon supply reel 556, with reel 556 shown without ribbon for purposes of illustration. Reel 556 is rotatably supported on a spring 558 which deflects in the direction of arrow 557 when the reel in fully loaded with ribbon 78. As the ribbon becomes unwound, spring 558 causes the reel to move in a direction opposite to arrow 557.

The ribbon 78 extends from reel 556 and passes through two pair of guide pins 560 which guide the ribbon past opening 554B off the housing. When the cartridge is positioned on the carriage base member 184 (FIG. 36), ribbon sensor 79 extends through opening 554B and surrounds the ribbon so that the ribbon can be detected. Preferably, the ribbon 78 includes two transparent segments, one located at the end of the ribbon and one located at a distance from the end of the ribbon estimated to be sufficient to carry out printing of a typical binder strip. Typically, the second transparent segment is located a few feet from the ribbon end. The manner in which the transparent segment is used will be described.

Ribbon 78 continues past opening 554B and is guided around an 90 degree turn by a tensioner 562. Tensioner 562 is a elongated spring having one end secured to housing 554 and the opposite end engaging the ribbon 78. The spring end engaging the ribbon preferably has a 90 degree bend (not depicted) which guides the ribbon around the 90 degree turn. Tensioner 562 is pliant so that the tensioner will flex substantially during printing thereby controlling the tension of the ribbon.

Ribbon 78 is further directed along a path over opening 554A by ribbon guides 564, 566 and 568. Thus, ribbon 78 will be positioned adjacent the print head of the print head mechanism 25 when the cartridge is installed on the base 184. A shield 590 (not depicted in FIG. 38) is mounted on the cartridge housing 554 intermediate guide pins 566 and 568 which extends over ribbon 78 in the region intermediate the guide pins. Thus, ribbon 78 will pass between shield 590 and the guide pins 566 and 568.

Figure 39:
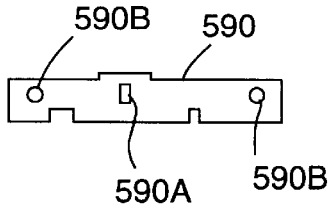
FIG. 39 is a plan view of the heat shield of the ribbon cartridge.
Figure 40:
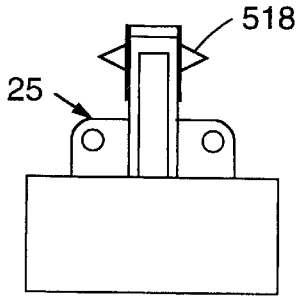
FIG. 40 is a side view of the print head mechanism.

Referring to FIG. 39, shield 590 is made from a flexible strip of plastic film having a central opening 590A through which the print pins pass during printing. The ends of the shield are mounted on the interior of housing 554 by way of pins (not shown) which extend through the two mounting openings 590B in the shield, with the shield assuming a arcuate shape when installed on the cartridge 76. A heat resistant polyamide film, such as made by Dupont under the trademark Kapton, has been found suitable for this application. Shield 590 is provided to prevent the ribbon 78 from inadvertently contacting heated spring 518 (FIG. 40) and associated structure of the print head mechanism 25. Shield 590 further functions to minimize the transfer of contaminants from the inside of the cartridge 76 to the print head.

Referring back to FIG. 38, ribbon guide 570 operates to guide the ribbon towards the take-up gear 588 on which the used ribbon is wound. Spring 586 tends to bias gear 588 and the ribbon wound around the gear against the mace gear 580 so that the mace gear teeth are under sufficient pressure to enable the mace gear to drive the take-up gear 588 and the used ribbon wound around the gear. As previously noted, as the used ribbon is wound, spring 586 permits take-up gear 588 to be translated in the direction of arrow 590. Note that as the diameter of the used ribbon wound around gear 588 increases, the diameter of the ribbon wound around supply reel 556 will be decreasing thereby providing space for the used ribbon. Similarly, when the supply reel is full, the reel is free to move in the direction of arrow 557 a substantial distance since the diameter of the used ribbon wound around gear 588 will be small.

The two transparent ribbon segments are used to control printing when cartridge 76 ribbon supply is low. When the first transparent ribbon segment spaced a few feet from the ribbon 78 end is detected by sensor 79, printing is temporarily stopped and the ribbon is advanced until the first segment has passed the print head mechanism 25. This is done because the transparent segment is not usable for printing. As will be described later in connection with FIG. 45, printing is carried out in multiple passes. The printing pass that was interrupted is then repeated, including any part of the pass that was previously printed. The printing sequence then will continue until completed assuming that the remaining ribbon is adequate. Once printing is completed, the ribbon is advanced until the final transparent segment is detected so that Printer will not attempt to print another strip even if the Printer has been turned off and then turned on. If the remaining ribbon is not adequate, an appropriate message is displayed to the user and the partially printed strip is ejected through front slot 19 and will not be forwarded to the rear for binding.

Control Keyboard

As previously noted, the Control Keyboard 12, sometimes referred to as the interface unit, is used to enter the information necessary to specify the matter to be printed on the binder strip 14. As can be seen in FIGS. 41, 42, 43A and 43B, the Keyboard 12 is enclosed by a housing 246 and includes a main display 248 for displaying the text entered y a user to be printed on the binder strip 14 and for displaying a user menu which, among other things, provides prompts that enable the user to easily enter the printing information.

Keyboard 12 includes two sets of key, including a group of standard function keys 250 and a group of special function keys 252. The standard function keys are essentially the same keys used in a standard QUERTY type keyboard. Elongated key 252A is a Space key, key 252B is a Help key and key 252C is an Enter key. Key 252D is the Primary Shift key, with key 252E acting as a secondary shift key. As is well known, the function provided by number keys in the upper row and the function provided by the letter keys in the next lower three rows of keys is controlled by the Primary Shift key 252B, with the Secondary Shift key 252E providing a third function for certain keys.

Figure 43A:
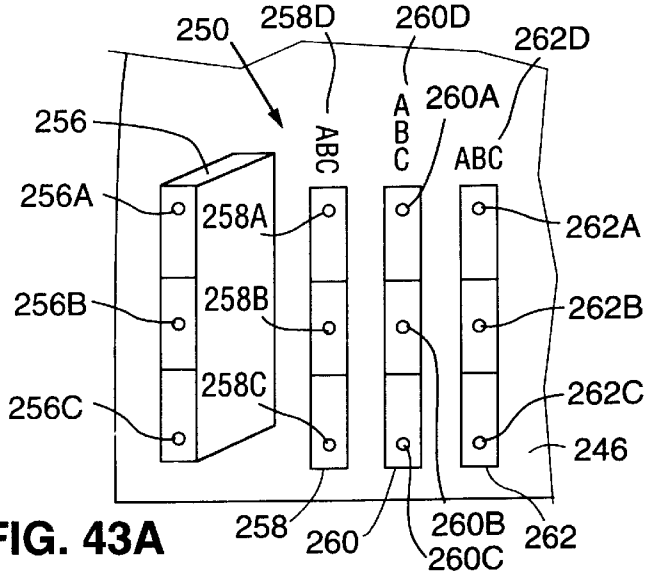
FIG. 43A is a partial view of the LED display portion of the control keyboard.
Figure 43B:
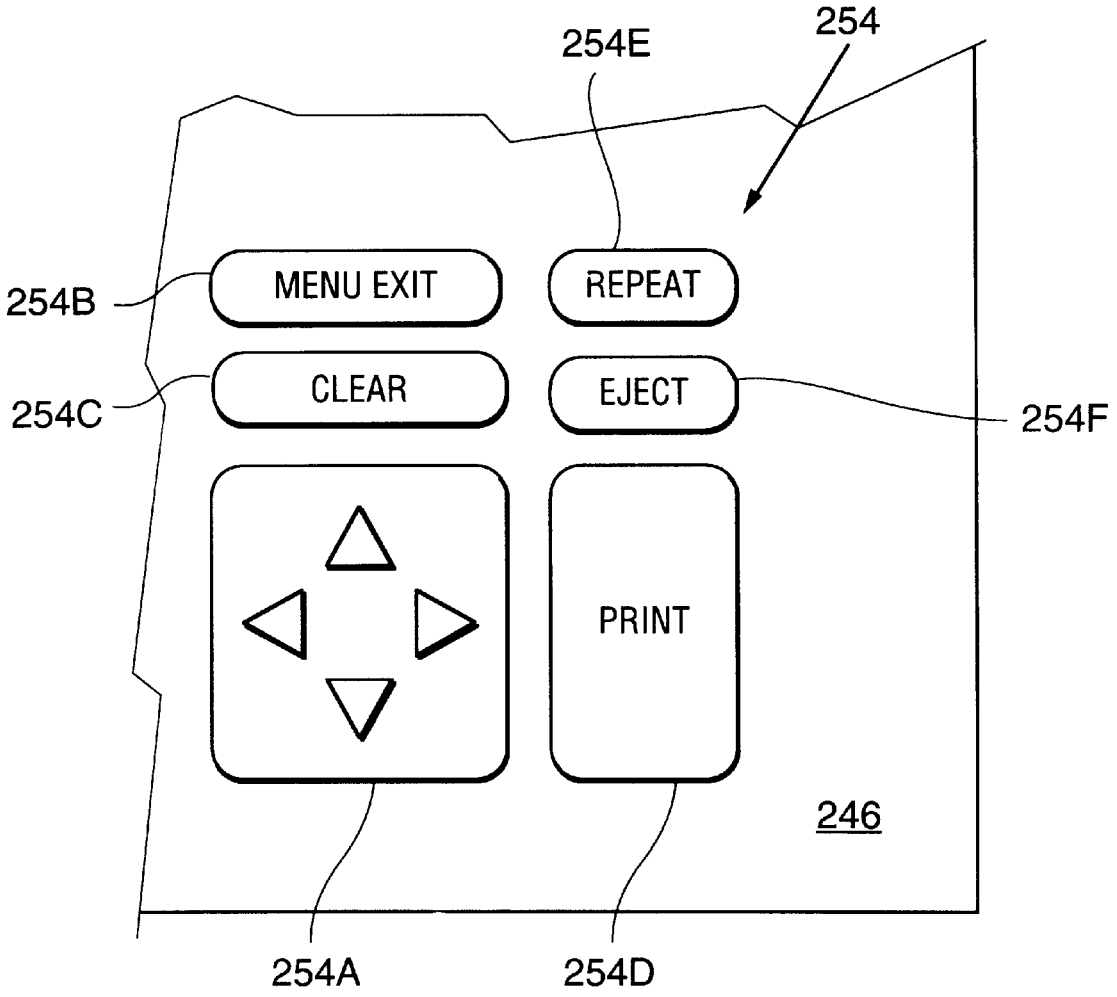
FIG. 43B is a partial view of the special key segment of the control keyboard.

The special function keys 254, as can be seen in FIG. 43B, include a Cursor Control key 254A which allows selections to be made from the various menus shown on main display 248. As will be explained later in greater detail, Menu/Exit key 254B is provided for selecting various menus when the left portion of the key is actuated and for exiting the menus when the right portion of the key is actuated. The functions of the Clear, Print, Repeat and Eject keys 254C, 254D, 254E and 254F key, respectively, will be subsequently described.

The LED display portion 250 of Keyboard 12 is used to control and depict the orientation of the text to be printed on the binder strip 14 and the zone of the binder strip 14 on which the text is to be printed. As can best be seen in FIG. 43A, display portion 250 includes four indicia 256, 258, 260 and 262 printed on the Keyboard housing 246. Indicia 256 depicts a perspective view of a bound book showing an upper printing region, a central printing region and a lower printing region of the depicted book spine. The upper, center and lower regions of the indicia represent the upper, center and lower zones, respectively, of the actual book spine. A LED 256A mounted on the housing 246 indicates that print data is to be entered using the Keyboard 12 and the printed text will be located in the upper zone of the spine of the bound book. Similarly LEDs 256B and 256C indicate when print data is to be entered and that the printed text will be located in the central and lower zones, respectively, of the spine of the bound book.

The print text can be oriented on the spine of the book in three directions. The print text can be aligned vertically with the characters positioned sideways, vertically with the characters positioned vertically (stacked) and horizontally, with the characters positioned vertically. Such text orientations are referred to herein as vertical, stacked and horizontal, respectively. Indicia 258D is printed on housing 246 depicting an example of print text aligned vertically, with indicia 260D and 262D depicting, respectively, text in the stacked orientation and the horizontal orientation. Indicia 258 printed on housing 246 depicts a book spine having text aligned in the manner represented by the associated indicia 258D (vertical), with indicia 260 and 262 depicting book spines having text aligned in the same manner represented by indicia 260D (stacked) and 262E (horizontal), respectively.

Table 1 below shows the nine possible combinations of spine zones and orientations A through I.

TABLE 1

| | ORIENTATION | | |
|---|---|---|---|
| SPINE ZONES | A B C | A B C | ABC |
| Upper | A | B | C |
| Center | D | E | F |
| Lower | G | H | I |

It is possible to combine the three text orientations in any manner desired. By way of example, it would be possible to select the stacked text orientation of indicia 260D to be used in the central zone of the book spine (option E), to select the vertical text orientation of indicia 258D to be used in the lower zone (option G) and to select the horizontal text orientation of indicia 262D to be used in the upper zone (option C). Three LEDs mounted on housing 246 and associated with each text orientation option become activated when the user makes the orientation selection. Thus, there are a total of nine LEDs, including LEDs 258A, 258B and 258C associated with indicia 258, LEDs 260A, 260B and 260C associated with indicia 260 and LEDs 262A, 262B and 262C associated with indicia 262.

Each of the nine LEDs have an associated integral switch which a user can actuate by pressing the LEDs. Note that LEDs 256A, 256B and 256C do not have associated integral switches. Assume, by way of example, that a user first actuates the switch associated with LED 258A. This actuation will cause the LED 258A to start blinking. The blinking LED indicates to the user that text will be printed in the upper spine zone using horizontally oriented text and that the text can be entered at this time using the standard function keys 252 of the Keyboard 12.

If a user were to then actuate a switch associated with either LED 260A or 262D, this would indicate the user is making a selection change since both of these switches are also associated with the upper spine zone. This action will result in the blinking LED 258A to turn off, and the newly selected LED to start blinking. If a user were to then select a LED associated a spine location other than the upper location, this would indicate that the user is not altering a previous selection, but is making a further selection. In that event, the LED associated with the new selection would start blinking. For example, if the switch associated with LED 262C were actuated, LED 262C would begin blinking indicating that text for the lower spine zone is ready for entry using standard keys 252. Such text would have a horizontal orientation.

Assuming that the user had previously entered text for the upper spine location, LED 258A would remain continuously on indicating that text had been entered for that location. If the user had failed to enter text for the upper spine zone, LED 258A would go off when the switch associated with LED 262C was actuated thereby reminding the user that text was not previously entered for the upper spine zone. LED 256A turns on when any LED associated with the upper spine zone (258A, 260D and 262D) is selected and remains on if text has been entered for the upper spine zone. LEDs 256A, 256B and 256C associated with indicia 256 turn on when a user has selected the upper, center and lower zones for printing, respectively, and remain on if the user has entered text for the associated zone. If the user selects another zone without entering text, the LED 256A, 256B or 256C will turn off.

Figure 43C:
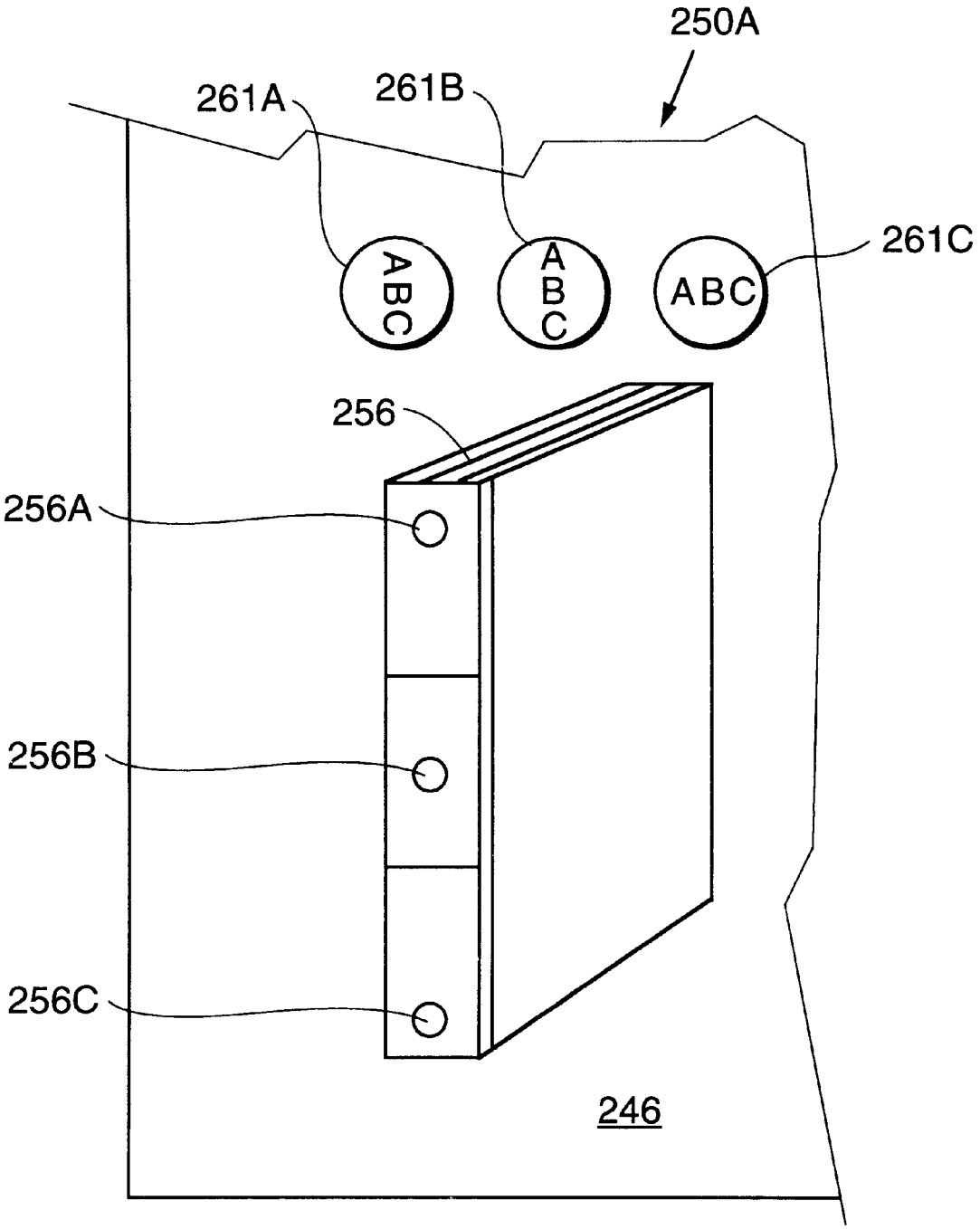
FIG. 43C is a partial view of an alternative LED display segment of the control keyboard.

FIG. 43C shows an alternative embodiment LED display portion 250A. The alternative embodiment includes an indicia 256 of a bound book formed on the keyboard housing 246. Indicia 246 depicts upper, center and lower regions which represent the upper, center and lower zones of an actual book, respectively. The upper, center and lower regions of indicia 256 each has an associated LED, including LEDs 256A, 256B and 256C, respectively. Each of the LEDs has an associated integral switch which can be actuated by a user be depressing the associated LED.

Display portion 250A further includes three indicia 261A, 261B and 261C formed on the housing 246 which represent the vertical, stacked and horizontal text orientations, respectively. Each of the three indicia 261A, 261B and 261C has an associated LED and an associated switch which is actuated be pressing the LED. A user must actuate two switches in order to select a particular text orientation for a particular spine zone. Thus, if a user wants vertical text to be entered in the upper spine zone, the switch associated with LED 256A is actuated together with the switch associated with indicia 261A. Both LEDs will begin to blink when they are actuated indicating to the user that text can be entered using the standard keys 252 of the keyboard. Once text has been entered, the LED 256A will remain continuously on thereby reminding the user that entry of text for the upper spine zone has been completed. If no text is entered and a switch associated with a different spine zone is actuated, LED 256A will turn off.

Assuming that a user had selected the upper spine zone in combination with vertical text, both LED 256A and the LED associated with indicia 261A will commence blinking as previously noted. If the user fails to enter text and selects, for example, another orientation by actuating the LED associated with either indicia 261B or 261C, the LED associated with 261A will turn off and the newly selected LED will commence blinking. LED 256A will also be blinking thereby indicating to the user that text can be entered using the standard keys 252.

The user controls operation of the Printer primarily by using the special function keys 254 on Keyboard 12. It is desirable to simplify operation of the Printer by making the function keys generally self-explanatory so that the user does not have to frequently resort to display 248 except to confirm proper text entry. However, simple menus shown on display 248 may be of some use to those with minimal familiarity with the operation of the Printer. Such menus, which typically provide a user with various choices and prompts, are commonly used in the art, as is the software for generating such menus and for interpreting user entered responses. Since the manner in which the menus are generated and the content of the menus form no part of the present invention, the menus will not be described in detail other than by a brief overview of some of the functionality. In this manner the true nature of the invention will not be obscured in unnecessary detail.

Figure 43D:
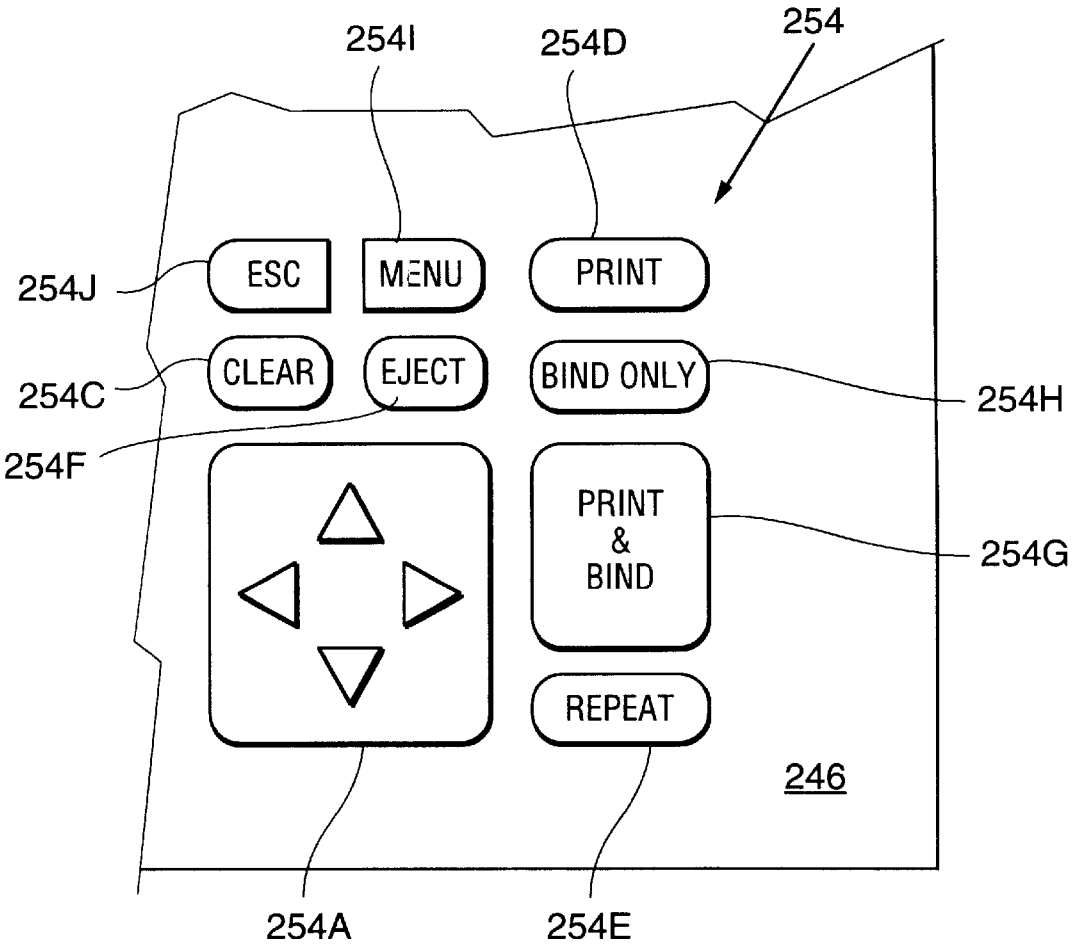
FIG. 43D is a partial view of an alternative special key segment of the control keyboard.

As previously noted, the cursor control key 254A of the special function keys 254 shown in FIG. 43D permit a user to scroll through a main menu and secondary menus shown on display 248. The Menu half of key 254B is used to cause the main menu to be displayed. Print key 254D, when actuated, causes the binder strip 14 to be printed and ejected through either the front slot 19 of the housing 16 or the rear opening 20, depending upon which method was previously selected by the user. In the event a binding machine is docked to the Printer, the printed strip 14 ejected through the rear opening can be automatically loaded into the binding machine.

The Clear key 254C causes a clear menu to be displayed which prompts the user with various choices to be cleared, including one or all of the three text zones on the binder strip 14. The Exit half of key 254B is used to scroll up through various menus until the main menu is reached. Once the main menu has been displayed, further actuation of the Exit key will cause a text entry screen to be displayed for the most recently selected binder 14 strip zone. A Repeat key 254E is provided which causes the entered text to be printed on successive binder strips 14 and for the binder strip to be ejected out of rear opening 20 for automatic transfer to a docked binding machine. The Eject key 254F causes the binder strip 14 to be ejected through the front slot 19.

FIG. 43D depicts an alternative embodiment set of special function keys 254. The ESC key 245J operates in the same manner as the Exit key 254F of the FIG. 43B embodiment as do the Eject keys 254F. The cursor control key 254A and the Repeat key 254E provides the same functions in both the FIG. 43B and 43D embodiments. The Menu key 254I of the FIG. 43E embodiment performs the same function as the Menu half of key 2542 of the FIG. 43B embodiment. The Bind Only key 254H is used when the Printer is docked to a binder machine and a user wants to load a strip 14 into the binder machine without undocking the machine from the Printer. The Bind Only key 245H allows a user to insert a strip 14 into the Printer, with the Printer functioning to load the strip on Drum 22 without printing and to eject the strip through rear opening 20 to the binder machine. The Print & Bind key 254G is used print a binder strip 14 and to forward the printed strip to a docked binding machine, a function performed by making a menu selection when the FIG. 43A embodiment is used.

In order to properly place text to be printed in the binder strip 14, information regarding the width of the stack of pages to be bound by the strip 14 must be provided since the book width determines on dimension of the area on the strip 14 which is available for receiving text. Further, the stack width determines which of the three binder strip widths to be inserted into the Printer. One method of providing the stack width is to simply enter the actual width manually into keyboard 246 in response to a prompt shown on display 248. Alternatively, when the Printer is docked to a binding machine, such machine functions to measure the stack thickness as part of the binding process. This width information can be made available directly to Printer 10 by way of data link such as an infrared data link between the Printer and the binding machine.

Printer Electronics

The electrical and electronic components of the subject printer are illustrated in FIG. 27. The Central Processing Unit 264 includes a microprocessor 266 such as the Motorola 68332. Microprocessor 266 controls essentially all printer functions and interfaces with the various sensors located in the printer mechanism and with the various driver devices located in a Driver Unit 268. The sensors are primarily optical sensors, including the print ribbon sensor 79, the drum edge sensor 92, the strip justify sensor 128, the strip ejected forward sensor 140, the strip present sensor 146, the drum home sensor 162 and the strip end detector 170B.

Central Processing Unit 264 further includes an eight bit Analog-to-Digital Converter (ADC) 270 which functions, among other things, to monitor the magnitude of an unregulated supply voltage and to provide a digital output used by Processing Unit 264 to control the magnitude of the print head mechanism 25 drive current. An ADC made by National Semiconductor and sold under the designation ADC0838 has been found to be suitable for this application. This ADC has several input channels which can be digitally selected so that a single ADC can be used to measure analog signals from multiple sources.

An Electrically Erasable Programmable Read Only Memory (EEPROM) unit 272 is included in the CPU for storing data in a non-volatile manner. The EEPROM unit 272 is programmed with data relating to system parameters, including electrical and mechanical calibration values determined at the factory, and including binder strip 14 print information such as titles, logos and other information which will be frequently printed by a particular user. EEPROM unit 272 can be implemented using two Microchip 64K×8 bit circuits sold under the designation 24LC65/P. A Read Only Memory (ROM) 274 is provided for storing the program for controlling operation of the Printer 10 and for storing the font files used in printing. A Random Access Memory (RAM) 276 is used by Microprocessor 266 in the conventional manner for executing the program stored in ROM 274. A 128K×8 RAM sold by Toshiba under the designation TC551001BPL-85 can be used to implement RAM 276 and 128K×8 bit ROM sold by National Semiconductor under the designation NM27C010-12 can be sued to implement ROM 274.

It should be noted that the code stored in ROM 274 for controlling the operation of the subject Printer could be implemented in a variety of ways by those skilled in the art, with the particular implementation forming no part of the present invention and with no particular implementation being preferred at this time. It is believed that the best manner to enable those skilled in the art to practice the subject invention is to describe the code in terms of the detailed functionality of the subject Printer rather than describing a particular implementation of the code itself.

Driver Unit 268 includes all of the drivers and similar interface units for controlling the electro-mechanical components of the printer in response to inputs from the Central Processing Unit 264. As previously noted, Printer 10 includes a main stepper motor 56 for driving Drum 22. The main stepper motor 56 is controlled by a driver circuit 278, which can implemented using a driver circuit in combination with a current controller circuit sold by SGS Thompson under the respective designations L298 and L6506. A driver circuit 280 for controlling the heating element in the printer head mechanism 25 is a voltage regulator such as the LM338 sold by National Semiconductor. A print pin driver 282 is used to control the actuation of one of the twenty-four pins of the dot matrix printer head mechanism 25. As will be explained in greater detail, driver 282 includes various discrete power transistors and diodes for applying drive current to a selected one of the pins of the print head mechanism 25.

Driver Unit 268 further includes a driver circuit 284 for controlling the carriage stepper motor 84 which, as previously described, controls the position of the print head mechanism 25. A driver made by Allegro under the designation UDN2916B can be used for this application. A set of solenoid drivers 285 is used for independently controlling the three solenoids, including solenoid 72 of the of the scraper arm locking mechanism, the pinch roller solenoid 220 and the eject solenoid 100. Drivers 285 include three pairs of power transistors, each in the Darlington configuration, one pair for each solenoid. The power transistors are part of a single transistor array sold by Motorola under the designation ULN 2003. A single stepper motor driver 286 is shared by the strip guide carriage motor 30, the strip drive motor 32 and the cartridge drive motor 194A since none of these motors need to be controlled at the same time. A motor select relay 288 controlled by the CPU 264 is used to select the motor to be controlled by driver 286. As will be explained, the motor select relay 288 is used to disconnect the strip drive motor 32 during part of the strip loading sequence.

A power supply 290 is used to generate an unregulated +40 volt output capable of providing high currents, with this output being the primary power source for the various drivers of the Driver Unit 268. A voltage regulator, such as the National Semiconductor LM340 is used to provide a regulated +5 volt output used to power the circuitry of the Central Processing Unit 264 and to the Driver Unit 268.

Figure 26:
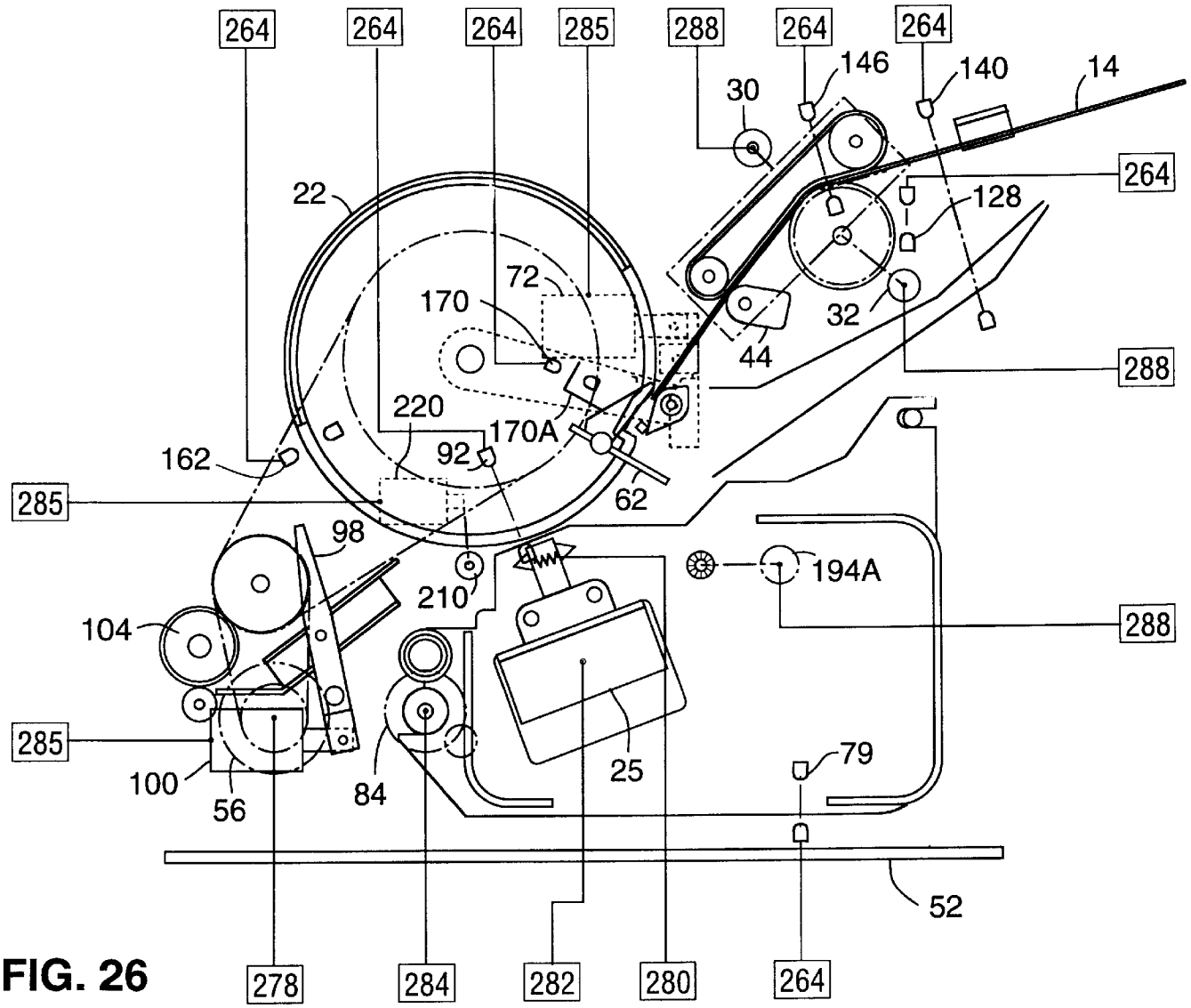
FIG. 26 is an overall schematic diagram of the primary mechanical and electrical components of the subject Printer.

FIG. 26 is an schematic diagram showing the principle electromechanical components which interface with the Driver Unit 268 and the seven optical sensors of the subject Printer 10 which interface with the Central Processing Unit 264. The electromechanical components include the scraper arm locking solenoid 72, the pinch roller solenoid 220 and the eject solenoid 100. As previously noted, the optical sensors include the print ribbon sensor 79, the drum edge sensor 92, the strip justify sensor 128, the strip ejected forward sensor 140, the strip present sensor 146, the drum home sensor 162 and the strip end detector 170B.

Printer Operation

Having described the construction of the subject Printer 10, operation of the Printer will now be described. Initially, a determination is made as to whether there is a binder strip 14 already present in the Strip Load Assembly 24. This would occur, for example, if a strip 14 were some how jammed in the Assembly. This is done using the strip present sensor 146, with the drive current to emitter 146A being set temporarily to a maximum value. Sensor 146 is poled using a preliminary switching threshold value. If a strip is present, the main keyboard display 248 shows an appropriate message indicating that the user should remove the strip 14 from the Printer 10.

Assuming that there was no strip 14 in the Printer 10 or that the strip has been removed, a Self Test & Initialization sequence is carried out. As will be explained in greater detail, the Self Test & Initialization sequence checks all of the sensor conditions and places all of the Printer elements, such as Drum 22 and the Scraper Mechanism 64, in a ready condition.

Referring to the timing diagram of FIG. 44A, the Self Test & Initialization sequence will now be described. This sequence is carried out when the Printer is first turned on and after certain access doors in the Printer housing have been opened and then closed. This is because it is possible that the configuration of the Printer has been altered once the doors have been opened including moving the position of scraper arm 66. Such assess doors may include the housing door for loading the ribbon cartridge 76 and a door which provides access to Drum 22 for removing jammed binder strips.

Figure 6A:
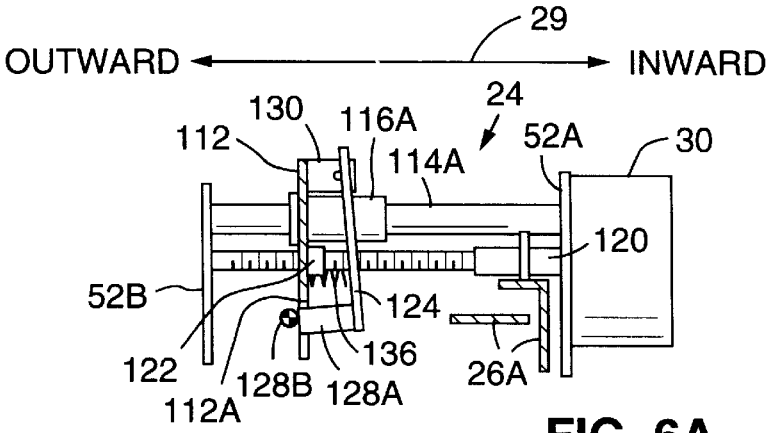
FIG. 6A is front view of the Strip Load Assembly of the subject Printer without the presence of a binder strip.

As indicated in the timing diagram, power is applied at time T1. The strip guide carriage motor 30 will begin stepping in a counter clockwise (CCW) direction. This action will cause the movable strip guide 28 to move towards the fixed strip guide 26 (FIG. 1). As indicated by line 29 of FIG. 6A, movement in this direction is referred to a inward movement and movement in the opposite direction is referred to as outward movement. Eventually, the movable strip guide 28 will engage part of the fixed guide 26 causing movable flag 128A of the strip guide sensor 128 to block the optical detector 128B (FIG. 6A). At this point, time T2, the Strip Load Assembly 24 is in the home position and actuation of the sensor 128 will cause the strip guide carriage motor 30 to stop stepping so that the strip guide 28 will stop.

As previously discussed in connection with FIG. 51, the optical sensors 140 and 146 are calibrated at this time. Although the drum edge sensor 92 will be calibrated at a later stage of the sequence, the emitter 92B of the drum edge sensor will be set to a maximum drive current value and the switching thresholds will be set to a preliminary value so that the drum edge sensor 92 is capable of detecting the Drum edge. When the detector 92A output is less than a predetermined value, the drum edge sensor 92 output of the FIG. 44A diagram is considered to be at a minimum level and when the sensor is greater that a predetermined value, the output is considered to be at a maximum level. The actual detector output is shown by dashed lines in FIG. 44A. Later in the sequence, the drum edge sensor 92 will be calibrated as previously described in connection with FIGS. 52A and 52B.

Also at time T2, the scraper arm latch solenoid 72 is actuated. Actuation of solenoid 72 will cause the arm latch 182 of the scraper arm locking mechanism 70 to switch to the non-locking state (FIG. 56B) so that the scraper arm 66 will be free to move with Drum 22 as the Drum is rotated. The Drum 22 is then moved to a home position, with the manner in which the Drum is moved depending upon whether the Drum is positioned such that the drum home sensor 162 is closed (drum flag 160 positioned in sensor 162) or open (drum flag 160 positioned out of sensor 162).

Figure 44A:
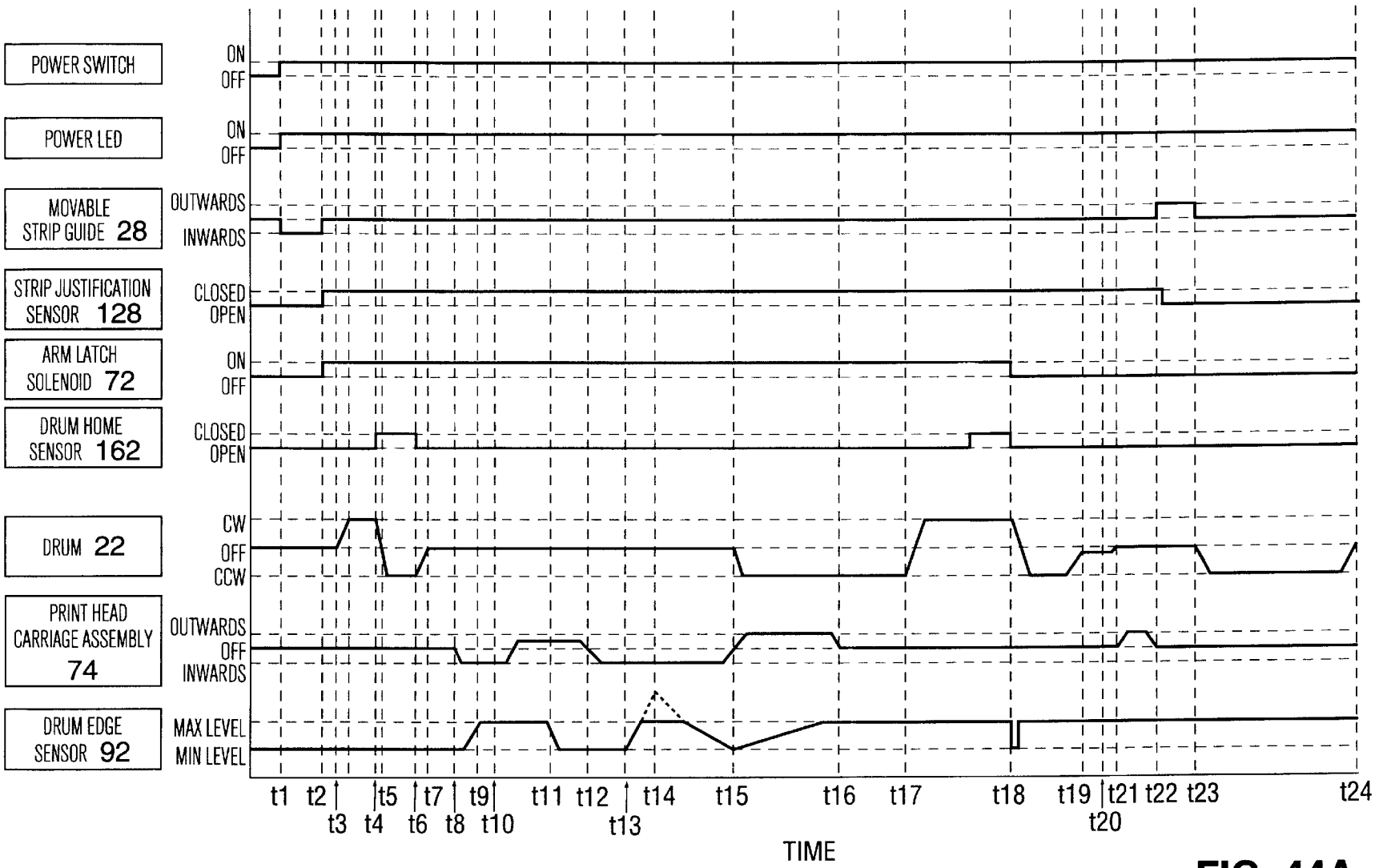
FIGS. 44A and 44B are timing diagrams illustrating the sequence for initializing the subject Printer.
Figure 44B:
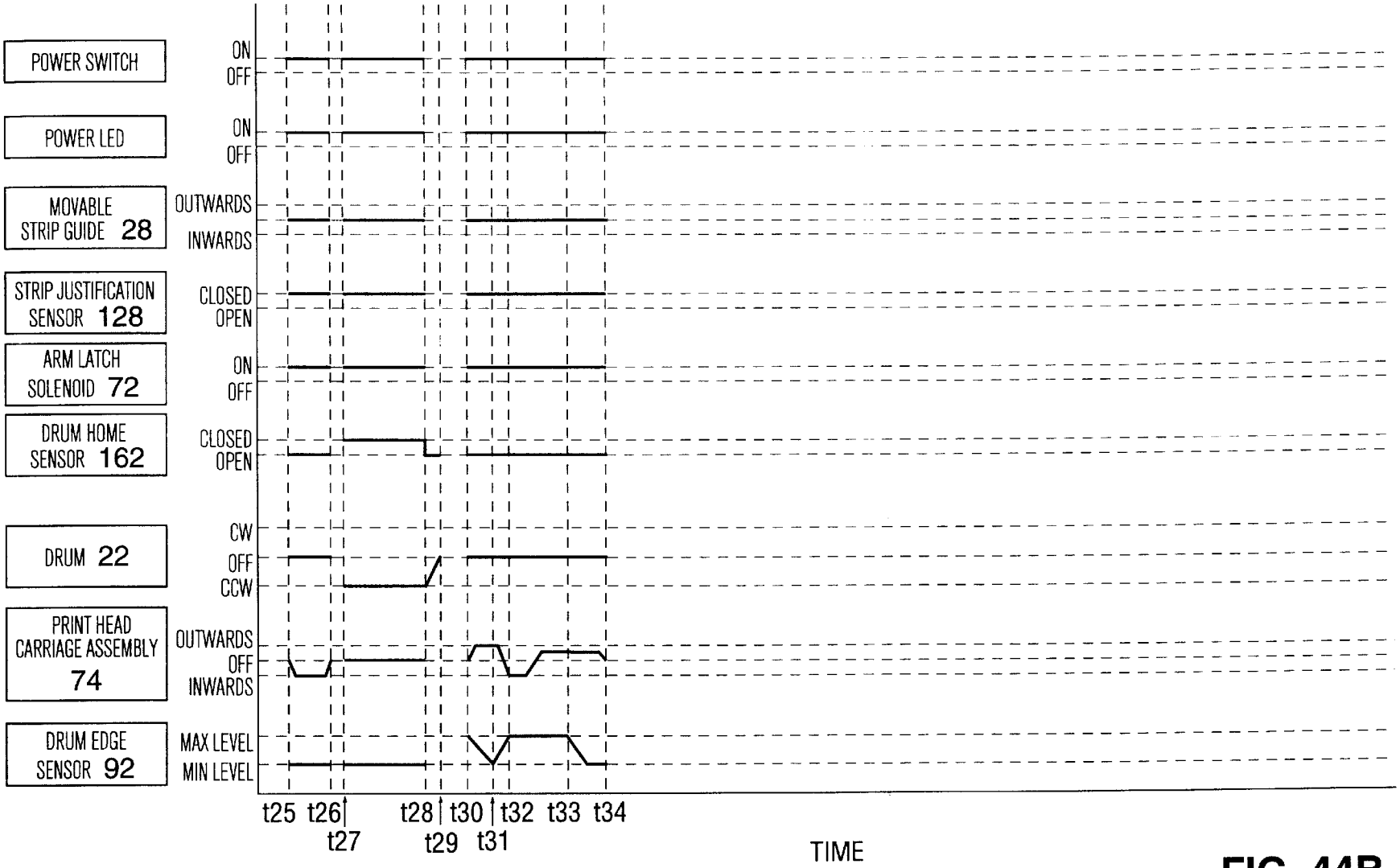

FIG. 44A illustrates the manner in which Drum 22 is placed in the home position when the drum home sensor 162 is initially in the open state. FIG. 44B will describe an alternative sequence if the drum home sensor 92 is at the closed state. Assuming that the sensor 92 is at the open state, the next step is to home the Print Head Carriage Assembly 74. The Drum drive motor 56 is first driven at time T3 in a direction which causes Drum 22 to rotate in the Clockwise (CW) direction (towards a user as indicated by arrow 27 of FIG. 1) until the leading edge 162A of the drum flag enters sensor 162 mounted on frame member 52B. This will cause sensor 162 to change from the open to the closed position at time T4. The drum drive motor 56 will then reverse direction slightly later at time T5 so that Drum 22 will be driven in the Counter Clockwise (CCW) direction (away from a user as indicated by line 27 of FIG. 1) until sensor 162 switches back to the open position. When the open position is detected at time T6, the position of the drum is recorded as the drum home position. The drum drive motor 56 then starts to slow down at time T6 and is stopped at time T7, with the Drum 22 being located near the home position.

The manner in which the Carriage Assembly is placed in the home position depends upon the state of the Drum edge sensor 92 at time T2. FIG. 44A depicts the condition where drum edge sensor 92 is initially in the minimum level state, with Drum 22 blocking the optical path between detector 92B and emitter 92A.

FIG. 44B discloses an modification of the FIG. 44A sequence where the Carriage Assembly 74 is moved inward (as defined by line 75 of FIG. 37) at time T2 as a precautionary step which will be subsequently described.

Returning to FIG. 44A, at time T8, the carriage drive motor 84 will be driven in a direction which causes the Carriage Assembly 74 is driven inward as part of the homing sequence. Movement of the Carriage Assembly 74 in the inward direction is carried out at a relatively high rate until drum edge sensor 92 is no longer below the Drum 22 and will change to the maximum level state at time T9. At this point, the Carriage Assembly 74 is approximately in the carriage home position. In order to place the Carriage Assembly accurately in the home position, it is first necessary to partially calibrate the drum edge sensor 92 by selecting the appropriate drive current to the emitter 92B of the sensor.

When the Carriage Assembly 74 is moved in the inward direction thereby causing the drum edge detector 92A output to increase starting after time T8, the output of detector 92A is repeatedly measured. Since the emitter 92B drive current was previously set to a maximum value, the detector 92A output will eventually exceed 75% of full scale of ADC 270 (FIG. 51). The drive current to emitter 92B is then reduced until the detector 92A output is equal to 75% of full scale. When the Carriage Assembly 74 is moved a further step in the inward direction, the detector 92A output is again measured and the drive current to emitter is again reduced so that the detector output is again at 75% of full scale. This will be repeated until it is no longer necessary to reduce the drive current thereby indicating that the peak output was just measured meaning that emitter 92B and detector 92A are close to being aligned position 0 as shown in FIG. 52B. Thus, the drive current for the emitter 92B will be set to the proper value at around time T9.

Calibration of the drum edge sensor 92 will be completed later in the sequence. Continuing with the sequence for homing the Carriage Assembly 74, at time T10 the Carriage Assembly will have been driven a small predetermined distance in the inward direction at a relatively high rate, with the drum edge sensor 92 remaining at the maximum level state. Carriage Assembly 74 is then moved at a reduced speed in the outward direction until drum edge sensor 92 falls below the switching threshold value at time T11 due to the presence of the edge of Drum 22. At this point, the Carriage Assembly 74 is in the home position, a position where the location of the Assembly 74 relative to the edge of Drum 22 is known with a relative high degree of accuracy. The home position is recorded and, as previously explained, will be used to accurately measure the edge of the binder strip 14 extending over the Drum edge once the strip is loaded onto the Drum.

At this time, the sequence for completing the calibration of the Drum edge sensor 92 begins. The Carriage Assembly 74 continues to be driven at a low rate in the outward direction for a small distance and then is stopped at time T12 and driven in the opposite, inward direction. This is in preparation for determining the various switching threshold values for drum edge sensor 92 which will calculated and recorded. As the Carriage Assembly 74 continues to be driven in the inward direction, the drum edge sensor 92 will proceed to change from the minimum level to the maximum level as emitter 92B moves out from under Drum 22. During this time, from T13 to T14, the detector 92A output is repeatedly measured and a corresponding switching threshold value is stored in memory. At time T14, the emitter 92B is aligned with the detector 92A so that the detector output is at a maximum value as indicated by the dashed waveform of FIG. 44A. Movement of the Carriage Assembly 74 during this time period corresponds to movement from position −1 to 0 of FIG. 52B. As the Carriage Assembly 74 continues to be driven in the outward direction, the emitter 92B starts to move away from detector 92A so that the magnitude of the detector output starts to drop. Again, the detector 92A output is repeatedly measured and a corresponding switching threshold voltage is calculated and stored in memory from time T14 to T15, with the Carriage Assembly 74 movement corresponding from movement from position 0 to position +1 of FIG. 52B. Typically, the threshold value is stored for each step of the carriage drive motor 84, there being a total of 800 steps as the Carriage Assembly 74 moves starting at time T13 to time T14. It would be possible to use substantially fewer threshold values if desired since many of the 800 stored threshold values will be substantially the same. As previously explained, when the edge of the loaded binder strip 14 is to be detected and measured, the threshold switching voltage stored in memory will be used which corresponds to the position of the Carriage Assembly 74 thereby optimizing operation of the drum edge sensor 92 over a range extending from position −1 to +1 (FIG. 52B). Note that the remainder of FIG. 44A (together will FIGS. 44B, 45 and 46) will continue to depict the drum edge sensor 92 state using the maximum and minimum level designations for purposes of simplification even though the sensor is now fully calibrated and is capable of operating in a fully analog mode where a wide range of detector 92A outputs can be resolved.

At time T15, the Printer begins a sequence to move the drum to the ready position and to move the print head carriage assembly 74 to the ready position. The initial portion of this sequence includes a sequence for locating and locking the scraper arm 66. In order to lock the arm 66, the arm is positioned next to the scraper arm latch 182 mounted on the frame member with the latch solenoid 72 being in the actuated state (FIG. 56B). This will cause latch 182 being in the non-locking position. The latch solenoid 72 is then deactuated thereby causing latch 182 to switch to the locking state which will result in the scraper arm locking pin 180C being secured in the latch 182 (FIG. 56A).

The sequence for positioning the scraper arm 66 begins with a sequence for locating the position of the arm. First, beginning at time T15 the Carriage Assembly 74 is moved in the outward direction so that the drum edge emitter 92B will be in a position at time T16 suitable for detecting the scraper arm flag 180F. Since the scraper arm latch 182 is in the non-locking state, arm 66 is free to move with the Drum 22. Drum 22 is driven beginning at time T15 in the CCW direction a sufficient amount to ensure that the scraper arm will be at a maximum CCW position at time T16.

At time T17, Drum 22 is driven in the CW direction and is stopped at time T18 when flag 108F of the scraper arm blocks emitter 92B of the drum edge detector 92. Thus, the position of the scraper arm 66 has been established. The scraper arm latch solenoid 72 is turned off at this time so that the latch 182 is in a position to seize the locking pin 180C (FIG. 56A). The scraper arm 66 is located below the scraper arm latch 182. Drum 22 is driven a predetermined distance in the CCW direction until pin 180C is located just below latch 182 at time T19. At that time, Drum rotation speed is reduced so that pin 180C will engage the cam surface on the lower half of the latch 180 just below recess 182C (not depicted in FIG. 56A) thereby causing the latch to deflect and to then seize the pin in recess 182C when the pin moves to a slightly higher position at time T20. The scraper arm is now latched.

After the scraper arm 66 has been latched, the Drum 22 is stopped at time T21. In addition, Carriage Assembly 74 is moved in outward direction slightly so as to be in a position relative to Drum 22 to be able to detect the edge of a binder strip 14 when the strip is subsequently loaded, with the Carriage Assembly 74 still being positioned sufficiently in the inward direction to cause the drum edge sensor 92 to remain at the maximum level. The strip guide 28 is also moved beginning at time T22 in the outward direction (FIG. 6A) to be in a position to accept a binder strip 14 of narrow width. As the guide 28 is moved, the strip justify sensor 128 changes state.

Figure 15:
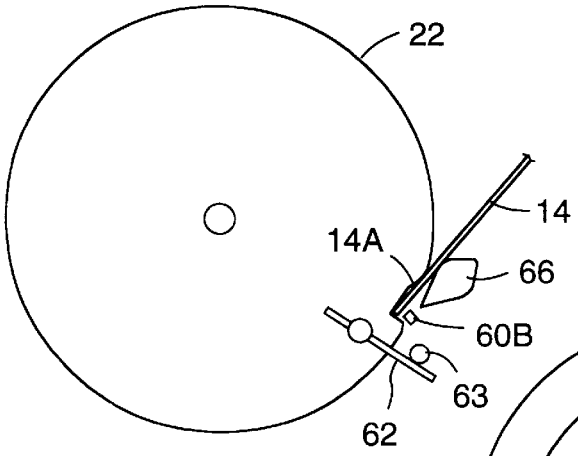
FIG. 15 is a schematic diagram of an initial stage of a binder strip being loaded onto the Drum for printing.

Starting at time T23, Drum 22 is rotated in the CCW direction a predetermined amount so that the clamp actuate arm 62 is positioned adjacent arm block 63. Only a small amount of additional rotation of Drum 22 will be necessary to cause the clamp actuate arm to engage block 63 and cause the clamp 68 to move to the open position so that the leading edge 14A of a binder strip 14 can be subsequently received by the clamp (FIG. 15).

FIG. 44B illustrates the manner in which the FIG. 44A timing diagram is modified in three different circumstances and depicts three short alternative sequences to be substituted for sequences in the FIG. 44A diagram, including a first sequence between T25 and T26, a second sequence between T27 and T29 and a third sequence between T30 and T34.

With respect to the first alternative sequence, if the drum edge sensor 92 is initially at the minimum level at time T1 as shown if FIG. 44A, it is preferred that an additional precautionary step be taken. The minimum level indicates that there is a possibility that the Print Head Carriage Assembly 74 the Assembly is located under Drum 22 and is in a position to interfere with movement of the clamp actuate arm 62 (FIG. 29A) which controls the strip clamp 60. In that event, that portion of the FIG. 44A diagram between T2 and T3 is replaced by that portion of the FIG. 44B diagram between T25 and T26. As can be seen in FIG. 44B, the Print Head Carriage Assembly 74 is driven in the inward direction a small predetermined amount so as to ensure the Assembly 74 will be spaced away from the actuate arm 62.

If the drum edge sensor 92 is at the maximum level at time T1 of FIG. 44A, Carriage Assembly 74 will not be in a position to interfere with arm 62. However, the manner in which the Print Head Carriage Assembly 74 home position is determined is modified by replacing the sequence from T8 to T12 of FIG. 44A with the sequence from T30 to T34 of FIG. 44B.

It is possible that a binder strip 14 remains on the Drum from a previous operation. Drum edge sensor 92 is not capable of distinguishing between the drum edge at time T8 (FIG. 44A) and a binder strip 14 which is present on the Drum. Accordingly, prior to time T8 (not depicted in FIG.

44A), the Carriage Assembly 74 is positioned so that it is approximately at the edge of Drum 22, with this rough positioning information being available in memory. Drum 22 is then rotated so that slot 22H (FIG. 28) will pass over emitter 92B of the drum edge sensor. If the Drum 22 is clear, sensor 92 will be able to detect the abrupt and substantial change in detector 92A output when slot 22H passes over emitter 92B. In that event, the sequence will continue as previously described. If a strip is present, there will be no change is detector 92A output when slot 22H passes over the emitter. In that event, the Printer will enter a sequence to eject the strip to the front of the Printer.

Referring again to FIG. 44B, at time T30, the drum edge sensor is at the maximum value. The Print Head Carriage Assembly 74 is driven outward until time T31 when the drum edge sensor 92 changes state thereby establishing a rough home position. The Carriage Assembly 74 is then driven in the inward direction a small predetermined amount in preparation for determining the accurate home position. At this point, emitter 92B is under Drum 22 near the edge of the Drum. The Carriage Assembly 74 drive direction is changed and the Assembly 74 is driven slowly in the outward direction. At time T33, the Carriage Assembly 74 is in the accurate home position which is recorded. The Carriage Assembly 74 is stopped at time T34.

Finally, if the drum home sensor 162 is in the closed position at the start of the Self Test & Initialization sequence, Drum 22 need only be moved in the CCW direction to reach the home position. In that event, that portion of the FIG. 44A timing diagram between T3 and T7 is replaced by that portion of the FIG. 44B timing diagram between T27 to T29 which shows Drum 22 being driven in the CCW direction until the drum home sensor 162 changes from the closed to the open state. This concludes the Self Test & Initialization sequence.

Once Printer 10 receives the various information required to carry out printing, Printer 10 is implemented to either eject the printed strip through the front opening 19 where the strip can be received by the user or through the rear opening 20. In the event the Printer is docked to a binding machine, the printed strip can be transferred to the binding machine automatically by way of opening 20, as previously described.

Printing Sequence—Rear Strip Eject

The printing sequence for ejecting the printed strip at the rear of the Printer by way of opening 20 will be described first in connection with the timing diagram of FIG. 45. Referring to the timing diagram, at time T40 it can be seen that Printer 10 receives information needed to carry out the actual printing. This includes the print information (text, font, orientation, etc.) and information regarding the thickness of the stack of sheets to be bound. The manner in which a user enters the print information was previously described. As previously noted, the stack width information can be manually entered by the user or can be automatically provided by a binding machine docked to the Printer in the event the binding machine is of the type which automatically measurers the stack thickness as a part of the binding process.

The stack thickness information is used to control the relative spacing of the fixed strip guide 26 and the movable strip guide 28. In addition, this information is used to generate error messages should a user enter print information which would result in print of such a size that it would not fit in the region of the binder strip 14 that would be located at the edge of the bound book as opposed to the portions of the strip that would be overlying the front and back cover of the bound book.

Assuming that the print and width information has been entered, the sequence for printing on a binder strip and ejecting the strip through the rear housing opening will now be described. The print image is first converted to a bit map using conventional font rendering software. Such software functions to convert text in the form of character values to images comprised of pixels (dots) representing such characters. The software further functions to rotate, scale and locate the characters and to change the character typefaces or fonts. Font rendering software is available from various sources including the Agfa Division of Bayer Corp. located in Wilmington, Mass. and Bitstream Inc. located in Cambridge, Mass. The particular font rendering software package obtained from these sources will depend upon the type of fonts desired and other factors well known in the art.

Figure 45:
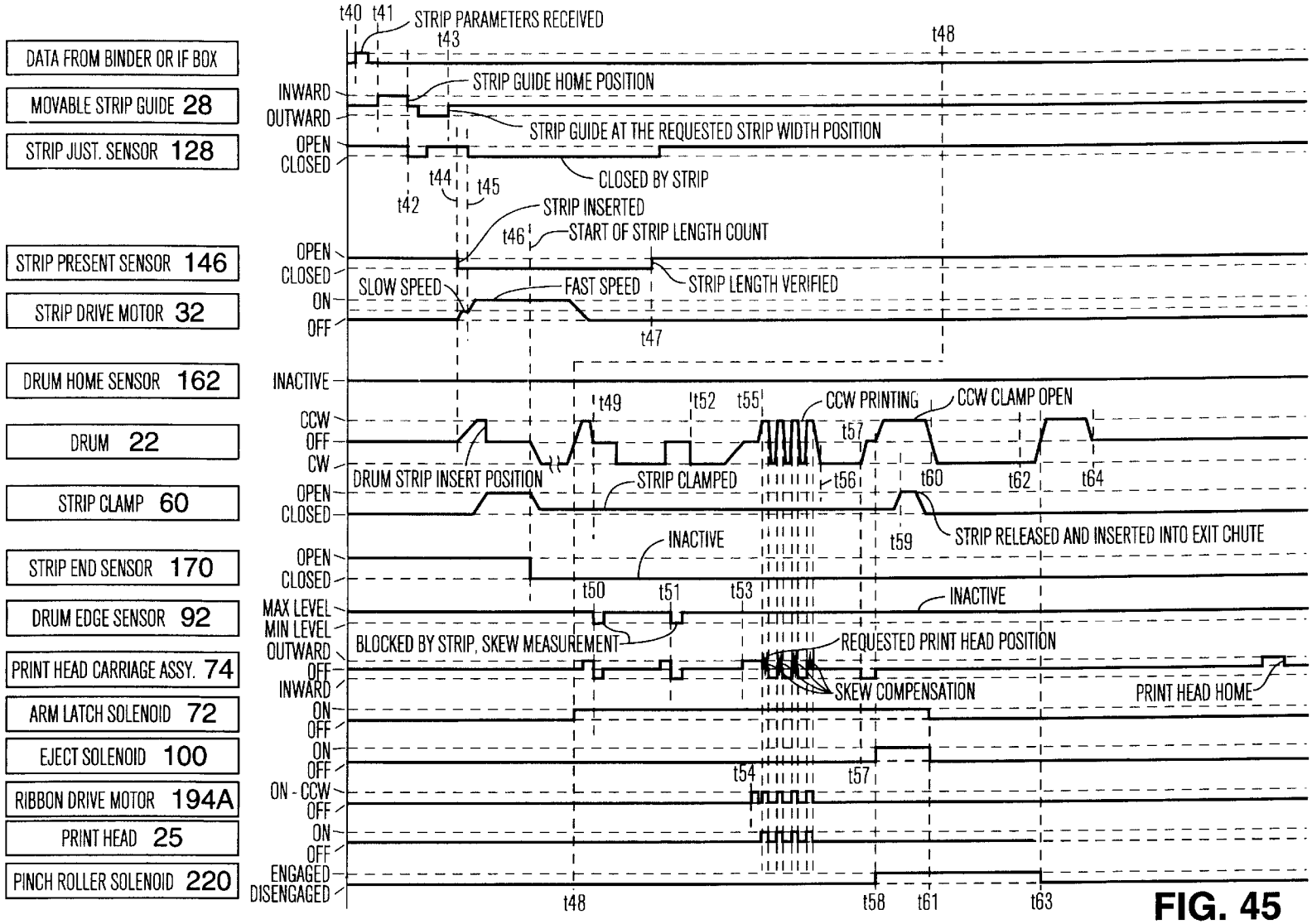
FIG. 45 is a timing diagram illustrating the sequence for printing a binder strip and ejecting the printed binder strip at the rear of the Printer.

Referring to FIG. 45, at time T41, the strip guide carriage motor 30 is driven in a direction which causes the movable strip guide 28 to move in the inward direction as defined by arrow 29 of FIG. 6A until guide 28 is in the home position as indicated by closure of strip justify sensor 128. Next, at time T42, guide 28 is driven from the home position in the outward direction to a position relative to the fixed guide 26 which is appropriate for the width of binder strip 14 to be used. Movement from the home position will cause the strip justify sensor 128 to change from the closed to the open state. The movable guide 28 is at the desired position at time T43.

Figure 6B:
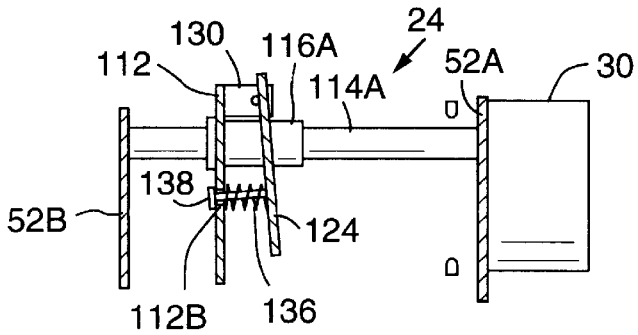
FIG. 6B is cross-sectional view of the structure of FIG. 6A.

Referring momentarily to FIG. 6A, a front view of the Strip Load Assembly 24 is depicted with the fixed guide 26A and the movable guide (not shown) positioned relative to one another so as to accommodate a medium width strip. The movable strip guide 28A, which is pivotably mounted by the hinge mechanism 124 (FIG. 9), is slightly tilted due to the action of spring 136 (FIG. 6B). The user then inserts a binder strip 14 of appropriate medium width into the Strip Load Assembly 24 between the fixed and movable strip guides. FIG. 7 shows a front view of the Assembly 24 with a medium width strip 14 inserted. Note that the strip 14 is of sufficient width so as to deflect the movable strip guide and the pivotable guide support 124 so as to cause the flag 128A of strip justify sensor to enter optical detector 128B thereby actuating the sensor. This is indicated in the FIG. 45 timing diagram at time T45 showing the strip justify sensor 128 switching to the closed state.

If a user were to attempt to erroneously insert a narrow width strip, flag 128A would not be deflected a sufficient amount to enter detector 128B. Thus, the strip justify sensor 128 will remain open thereby indicating an error condition which would be shown on the main keyboard display 248. Conversely, if a user were to incorrectly attempt to insert a wide width binder strip, the strip guides 26 and 28 are positioned sufficiently close to one another so as to prevent the Strip Load Assembly 24 from accepting the strip. FIG. 8 shows the Strip Load Assembly 24 properly configured to accept a strip 14 of wide width, with the strip justify sensor 128 shown actuated.

When a strip 14 of proper width (medium) is inserted at time T44, the strip will initially block the optical path of the strip present sensor 146. This action will cause the strip drive motor 32 to start to be driven at a relatively low velocity (time T44). This will cause the strip 14 to be gently pulled into the Printer between the strip drive belt 34 and the strip drive roller 36. As previously noted, insertion of a strip 14 of proper width will also cause the strip guide justify sensor 128 to be actuated. The state of the justify sensor 128 is sampled at time T45. If sensor 128 is not closed, an error has occurred and an error message is displayed. Assuming that sensor 128 is closed when sampled, the speed of the strip drive motor 32 is increased thereby increasing the speed at which the strip is drawn into the Printer 10.

At time T44 when the strip present sensor 146 detects the strip 14, the drum drive motor 56 is also driven a small predetermined amount in the CCW direction. This will cause the Drum 22 to also rotate in the CCW direction causing the clamp actuate arm 62 of the Clamp Mechanism 46 to move from a position adjacent the arm block 63 mounted on the frame member to a position engaging the arm block. The additional drum rotation will thus cause the movable strip clamp 60 to change from the closed to the open position so that the clamp is in position for receiving the leading edge 14A of a strip. This is shown at time T45 of the FIG. 45 timing diagram. Note that a second block (not depicted) is mounted on the frame member which acts as a stop by engaging the end of the clamp pivot pin. The second block 65 positively prevents further rotation of Drum 22 towards the user so that the movable strip clamp 60 will remain in the open position and will not continue to be advanced to the eject position.

Figure 11:
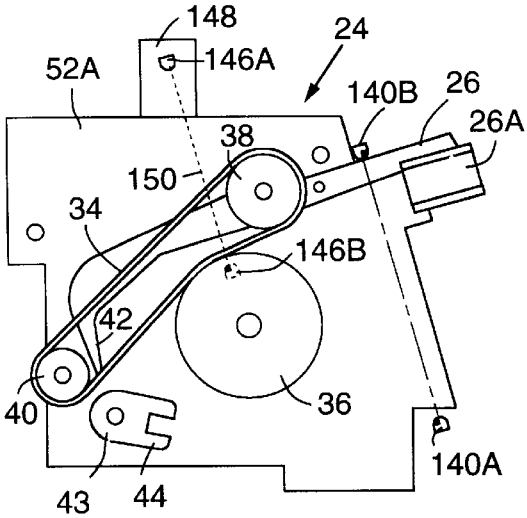
FIG. 11 is a side view of the Strip Load Assembly with the drive belt present.
Figure 12:
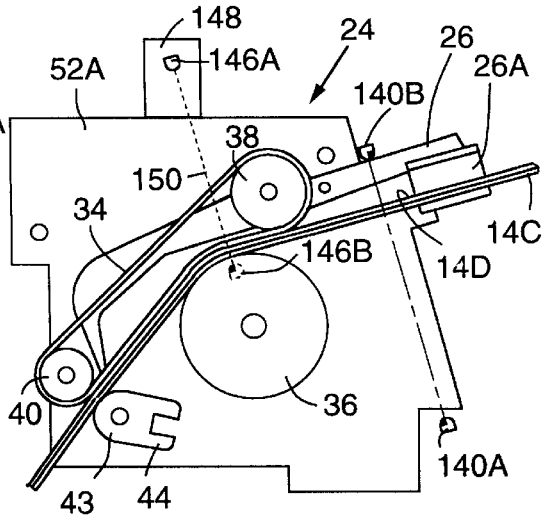
FIG. 12 is a side view of the Strip Load Assembly with a binder strip being properly loaded therein.

The strip drive motor 32 continues to be driven so that the binder strip 14 will continue to be drawn into the Printer 10 at the increased rate of speed. The leading edge 14A of the strip will be slightly bent so as to biased against the lower portion of the strip drive belt 34 so that the strip will be guided midway between the lower belt roller 40 and the mounting member 43 on which the rotatable blocking member 44 is mounted (FIGS. 11 and 12).

Assuming that a single strip 14 has been properly inserted into the Printer with the adhesive side 14D facing up (FIG. 12), the strip will simply slide over the rotatable blocking member 44 without causing the member to rotate.

At this point in the loading sequence, the scraper arm 66 is locked in place by the scraper arm latch 182. As can best be seen in FIG. 15, scraper arm 66 is positioned slightly above the strip clamp 60 so that the arm is positioned to guide the leading edge 14A of the strip into the Clamp Mechanism 46. As the strip is drawn into the Strip Load Assembly 24, the leading edge 14A will pass over the scraper arm 66 and engage the Drum 22 surface just above the Clamp Mechanism 46. The strip edge 14A will follow the Drum surface a short distance and will then enter the Clamp Mechanism 46 just above the open clamp bar 60B. The strip edge 14A will eventually engage the strip end sensor 170 (FIGS. 28 and 34A) causing the pivoting flag 170A to move (FIG. 34B) at time T46 so that sensor 170 changes from the open to the closed state (FIG. 45).

Actuation of the strip end sensor 170 will cause the drum drive motor 56 to be turned on and driven in the CW direction so that Drum 22 will also proceed to rotate in the CW direction towards the user. After a slight amount of Drum 22 rotation, the actuate arm 62 of the Clamp Mechanism 46 is displaced from the frame mounted arm block 63 so that the movable strip clamp 60 moves from the open position to the closed position (time T46). Clamp spring 166 (FIG. 29A) operates to force the clamp bar 60B against the leading edge 14A of the binder strip thereby securing the leading edge of the strip to Drum 22.

Figure 16:
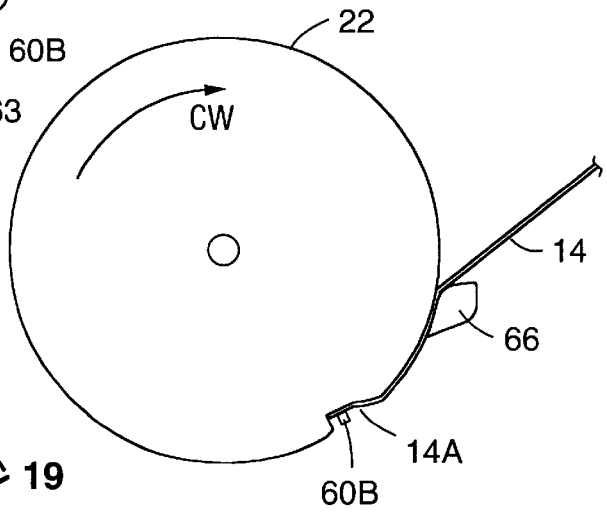
FIG. 16 is a schematic diagram of a an intermediate stage of a binder strip being loaded onto the Drum for printing.

The binder strip 14 continues to be drawn into the Printer as Drum 22 rotates as can be seen in FIG. 16. The scraper arm 66 remains locked in place at this time, with the strip engaging edge 66B (FIG. 28) of the arm applying a significant amount of force against the strip due to the compression of spring 166 as the strip is drawn between the Drum and arm 66 as the Drum rotates. Since the strip substrate 14C has a relatively low coefficient of friction, the amount of rotational force that needs to be applied to the Drum 22 to pull the strip under the arm 66 is not great. Furthermore, since there is a relatively high coefficient of friction between the smooth Drum 22 surface and the adhesive side 14D of the strip which tends to hold the strip in place thereby assisting the Claim Mechanism 46 in securing the strip at this stage of the loading sequence.

The binder strip 14 will continue to be drawn into the Printer until the trailing edge 14B of the strip passes the strip present sensor 146 at about time T47. The total length of the binder strip is determined by measuring the amount of Drum 22 rotation starting at the point at which the leading edge 14A of the strip is received by the Clamp Mechanism 46, as determined by the strip end sensor 170 at time T46, and stopping at the point at which the trailing edge 14B of the strip is detected passing the strip present sensor 146. The strip length that corresponds to this amount of Drum 22 rotation is added to a predetermined length that corresponds to the length of the path from the strip present sensor 146 to the Clamp Mechanism when the Drum is in the initial strip loading position shown in FIG. 15.

The Drum 22 will continue to rotate in the CW direction towards the user until time T48 when the strip 14 has been fully loaded onto the Drum. Note that there is a break in the time scale of FIG. 45 for Drum 22 during the last portion of rotation where loading the strip on the Drum is completed. For reasons explained below, the waveform depicting the strip drive motor 32 (FIG. 45) during the strip loading sequence is only an approximation of the actual control of the motor.

It is desirable that the leading edge 14A of the binder strip be accurately positioned fully within clamp 66, with the edge engaging the rear portion of the clamp as shown in FIG. 34B. This is because the drum edge sensor 92 in not capable of measuring misalignment of this type so that such misalignment cannot be corrected. It is also important that the binder strip be tightly wound around Drum 22 without air gaps or wrinkles to achieve optimum printing. It is not feasible to synchronize the drum drive motor 56 and the strip drive motor 32 with sufficient accuracy to achieve these objectives. In order to ensure that the leading edge 14A of the strip is properly positioned within clamp 66 and to ensure that the edge remains properly positioned as the clamp 66 closes as a result of Drum rotation, it is preferred that the strip drive motor 32 initially feed the binder strip 14 at a rate slightly greater than the rate at which Drum rotation takes up the strip. This will cause the binder strip to subjected to a slight compression force starting at about time T46 (FIG. 45).

Once clamp 60 has closed due to Drum 22 rotation and once a small portion of the strip has wound around the Drum, the compression force on the strip should be changed to a tension force. This can be accomplished by switching off the strip drive motor 32 so that the motor will provide a moderate degree of resistance as rotation of Drum 22 pulls the remainder of the strip through the Strip Drive Assembly 24. Note that motor 32 is turned off by disconnecting the power source as opposed to simply stopping the motor since a stopped stepper motor that remains energized will resist rotation. The tension force will not displace the strip edge 14A from clamp 60 since the clamp is fully closed when the force is applied and since a portion of the strip will be wound around Drum 22, with the smooth surface of the Drum tending to grip the adhesive 14D of the strip and resist the pulling force exerted by the Strip Load Assembly 24.

Figure 17:
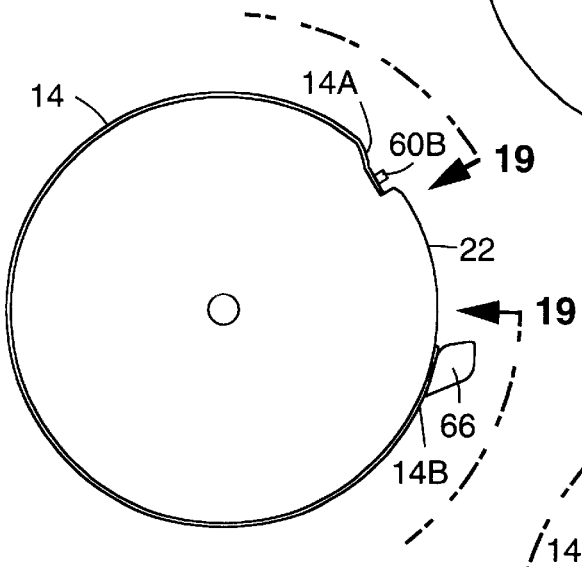
FIG. 17 is a schematic diagram of a binder strip completely loaded onto the Drum.

Drum 22 will eventually stop rotating at time T48 at a location based upon the calculated binder strip 14 length so that trailing edge 14B of the strip will be positioned adjacent the scraper arm 66 as shown in FIG. 17. At this point, the binder strip 14 is secured in place at the leading edge 14A by the clamp bar 60B of clamp 60 at the trailing edge 14B by the scraper arm 66. The wiping action of the scraper arm 66 during the strip loading sequence together with the tension force described above ensures that the strip is positioned flat on the Drum 22 surface, with there being no air gaps between the strip and the surface.

The scraper arm latch solenoid 72 is then actuated at the time Drum 22 has stopped so as to release the scraper arm 66 as shown in FIG. 56B. This will permit scraper arm 66 to move with the Drum 22 and thereby continue to secure the trailing edge 14B of the strip in place when the Drum is rotated during the actual printing. The Clamp Mechanism 46 will continue to secure the leading edge 14A of the strip during printing.

Figure 19:
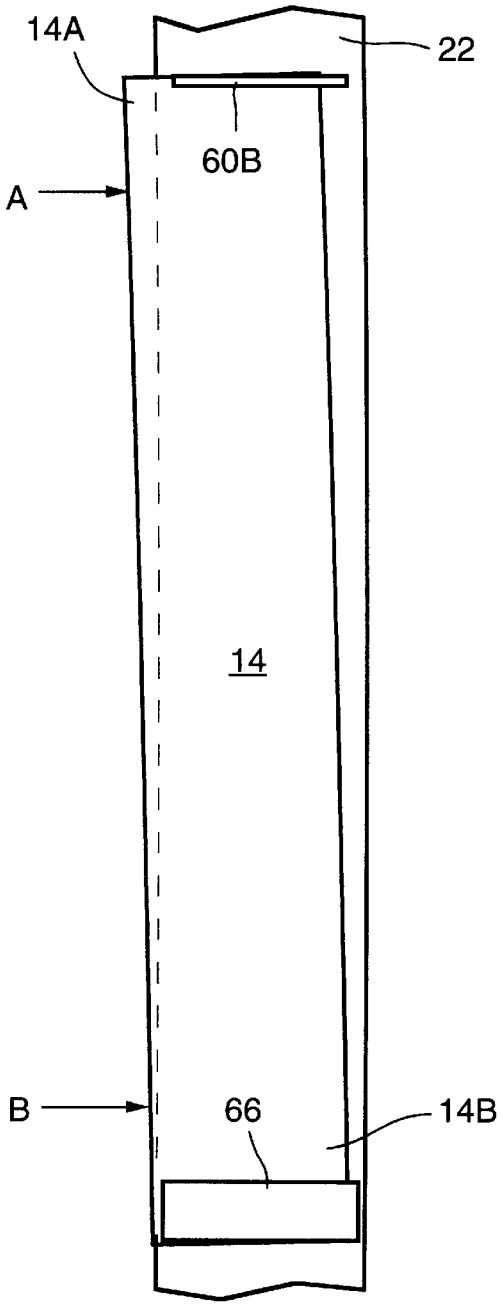
FIG. 19 is a view of the binder strip taken through section lines 19—19 of FIG. 17 showing the skew between the strip and the edge of the Drum.

The Strip Load Assembly 24 is positioned relative to the Drum 22 so as to ensure that at least a small portion of the strip 14 overhangs the Drum edge for the entire length of the strip. An example of a binder strip loaded is shown in FIG. 19, with FIG. 19 being a view taken from FIG. 17 along line 19—19. Prior to the actual printing, the edge of the binder strip extending over the Drum edge is measured in two places by the drum edge sensor 92 so as to determine the exact position of the strip 14 on the Drum. This information is used both to determine the location on the strip where printing is to be performed and to determine whether there is any strip skew so that printing can be controlled to compensate for such skew.

In order to position the loaded strip 14 for measurement, Drum 22 is rotated in the CCW direction a small distance and stopped at time T49. This will result in position A of the binder strip 14 (FIG. 19) being positioned to be sensed by the drum edge sensor. Note that the Carriage Assembly 74 was previously positioned so that emitter 92B will be on the inward side of Drum 22 so that the drum edge sensor 92 will be at the maximum level state. As previously noted, the maximum and minimum level state terminology is used for purposes of simplification even though sensor 92 is now fully calibrated and is capable of operating in an analog mode where states other than the maximum level and minimum level can be discriminated. Once Drum 22 has stopped, the Carriage Assembly 74 which supports the emitter 192B of drum edge sensor 92 is driven in the outward direction at a reduced rate of speed. Each time the carriage drive motor 84 is advanced a single step, a new switching threshold value generated and stored during the Self Test & Initialization sequence is obtained from memory and used by the drum edge sensor 92 during the search for the edge of the binder strip. When the edge at position A (FIG. 19) of the strip causes the drum edge sensor 92 to change state at time T50, the position is recorded. The Carriage Assembly 74 is then driven a small amount in the inward direction so that emitter 92B is repositioned on the inward side of Drum 22, thereby causing sensor 92 to change state, in preparation for locating position B of binder strip 14 (FIG. 19).

Drum 22 is rotated a predetermined amount in the CW direction so that position B of the binder strip 14 is positioned to be detected by the drum edge sensor 92. Carriage Assembly 74 is then driven slowly in the outward direction, with the switching threshold values being updated in the same manner previously used when detecting the edge at position A. When the drum edge sensor 92 changes state at time T51, the drum edge position is recorded.

The number of drum drive motor 56 steps required to rotate Drum 22 to move the binder strip so that the strip is first disposed over the print head mechanism 25 at position A (FIG. 19) and then position B is known. Since the skew measurement determines the number of carriage drive motor 84 steps required to move the Carriage Assembly 74 to compensate for the difference in location of the binder strip 14 edge at positions A and B, a straightforward adjustment can be made during the actual printing of the binder strip 14 to alter the Carriage Assembly 74 position depending upon the Drum location so as to compensate for any binder strip 14 skew. As previously noted, even if the binder strip 14 has no skew, the binder strip 14 edge information is further used to precisely locate the central axis of the strip on the Drum so that the text will be printed in reference to the axis thereby ensuring that the text will positioned properly relative to the central axis.

Figure 18:
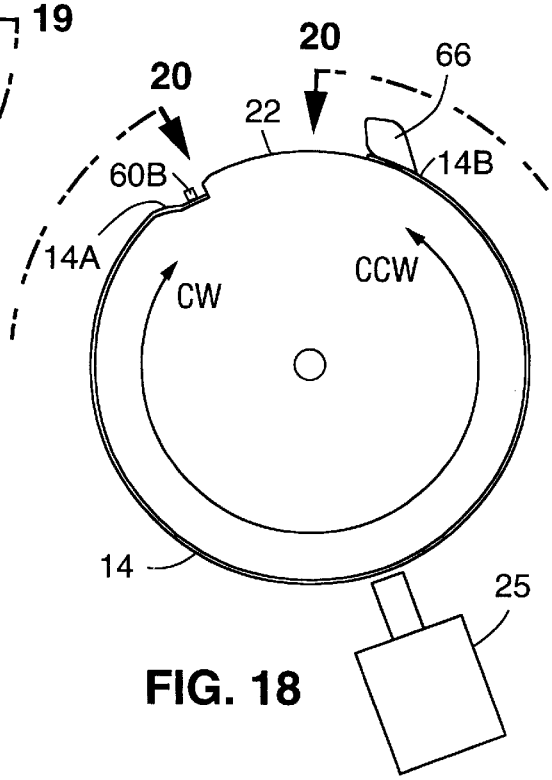
FIG. 18 is a schematic diagram of a binder strip mounted on the Drum being printed.

FIG. 18 shows binder strip 14 fully loaded on the Drum 22 during the actual printing sequence. At time T52, Drum 22 is driven in the CW direction in preparation for the actual printing and then stopped. At time T53, the Carriage Assembly 74 is driven in the outward direction so as to be in position at the outward edge of the binder strip 14 for the first printing pass. The cartridge drive motor 194A which drives the ribbon 78 is driven slightly so as to eliminate any slack in the ribbon at time T54.

Printing occurs while the Drum 22 is rotating in the CCW direction, with Drum 22 being positioned such that the print head mechanism 25 is opposite the trailing edge of binder strip 14B adjacent the scraper arm 66 at the beginning of the CCW rotation. Depending upon the width of the binding strip, a typical printing sequence is carried out with four passes as Drum 22 rotates in the CCW direction as shown in the FIG. 45 timing diagram. The print head mechanism 25 is first positioned over the outward edge of the binder strip 14 near scraper arm 66, with the pins of the head being actuated as Drum 22 is rotated. When Drum 22 rotates during printing, the cartridge drive motor 194A rotates in the CCW direction which causes the ribbon 78 in the cartridge 76 to be advanced during printing. As previously noted, it order to conserve ribbon, it is preferable that the ribbon not be advanced if no printing is to occur during a particular printing pass. Further, if a large portion of a pass does not call for printing, it may be desirable to not advance the ribbon during any such large portion. However, when controlling the advance of ribbon 78 within a particular pass in this manner, it is necessary to start and stop the ribbon at a fairly high rate. Construction of the ribbon cartridge 76 should take into account the resultant increased stress if the ribbon advance is to be controlled in this manner.

During the first printing pass beginning at time T55, the position of the Print Head Carriage Assembly is adjusted for each step of the drum drive motor 56 as may be required to compensate for any skew of the binder strip 14. This adjustment will also be performed for all of the subsequent passes.

Figure 20:
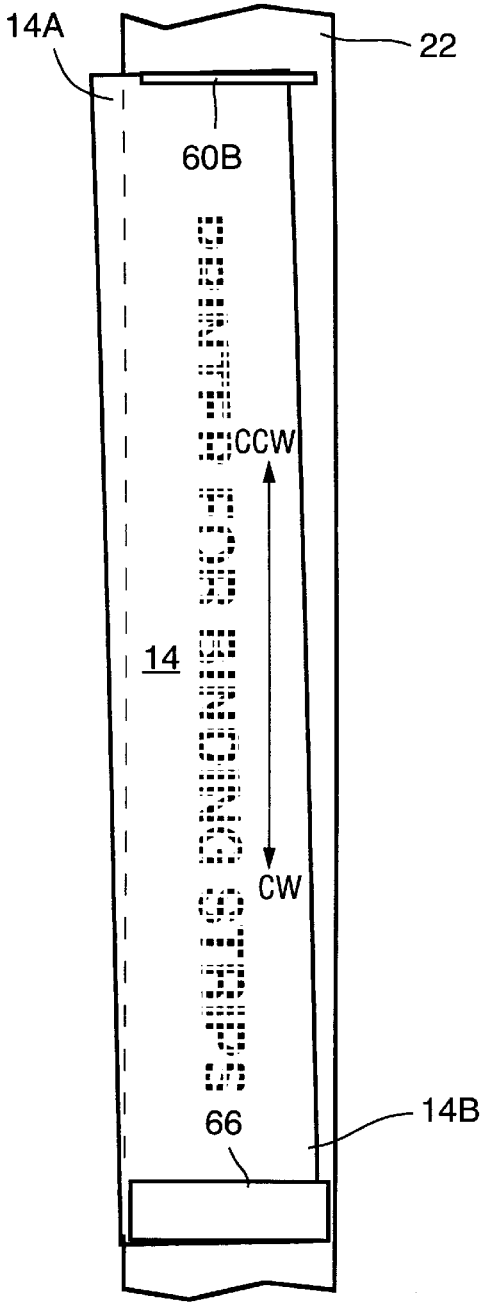
FIG. 20 is a view of the binder strip taken through section lines 20—20 of FIG. 18 showing the manner in which the printed matter is located on the strip to compensate for the skew between the Drum edge and the strip.

Once the first pass is carried out, Drum 22 is reversed, with no printing occurring during Drum rotation in the CW direction. The Carriage Assembly is driven in the inward direction a small amount so as to be in position for the second pass. This sequence will be repeated for the final two passes thereby completing the printing of the binder strip 14. FIG. 20 shows an exemplary binder strip 14 at this stage of the sequence.

Once printing is completed, the binder strip 14 will be ejected from the Printer 10 by way of the rear opening 20 in housing 16. As previously noted, the subject Printer 10 could be docked with a binding machine so that the printed strip 14 will be automatically transferred to the input of the binding machine. As soon as printing is completed, Drum 22 is rotated in the CW direction in preparation for the eject sequence and then stopped at time T56. At time T57, the Carriage Assembly 74 is driven a small amount in the inward direction and then stopped to ensure that the Assembly 74 does not interfere with movement of clamp actuate arm 62. At time T58, the eject solenoid 100 is actuated thereby moving the eject trip arm 98 into a position to intercept the clamp actuate arm 62 when Drum 22 is rotated in the CCW direction.

Figure 21:
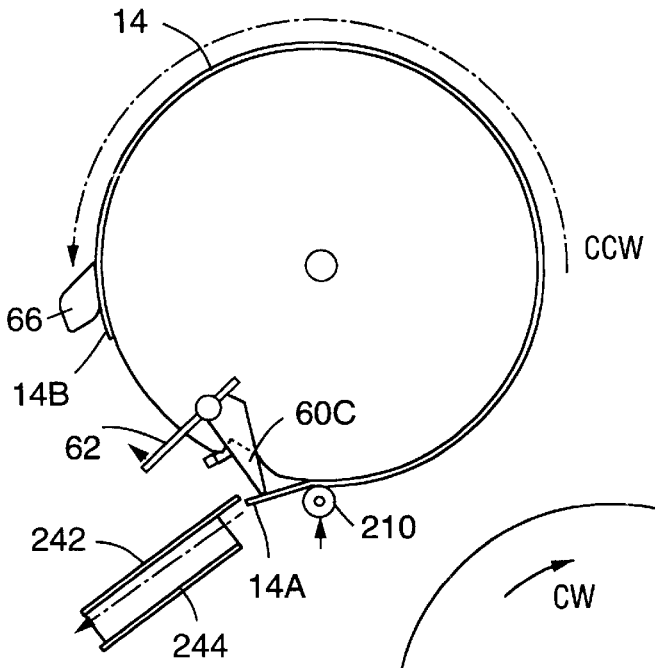
FIG. 21 is a schematic diagram of an initial stage of a binder strip being ejected to the rear of the Printer.
Figure 31:
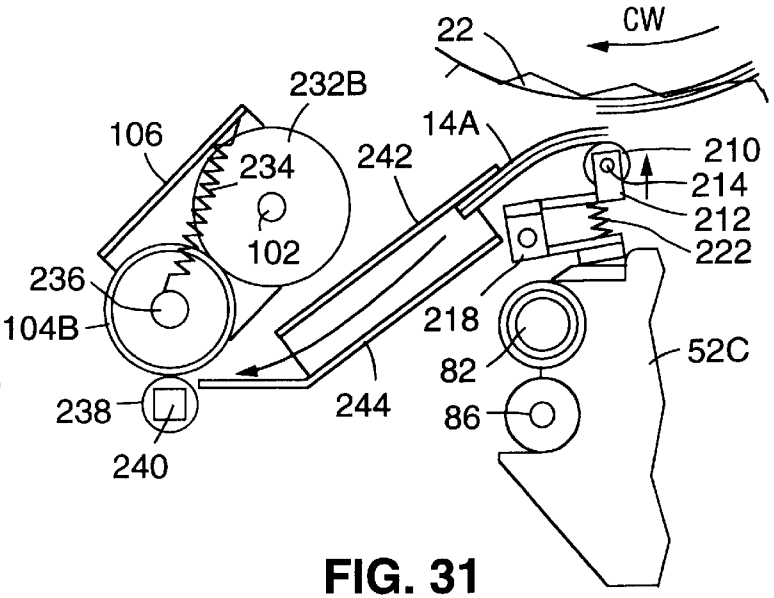
FIG. 31 is a partial view of the Rear Eject Mechanism just as a binder strip commences to be ejected.
Figure 30:
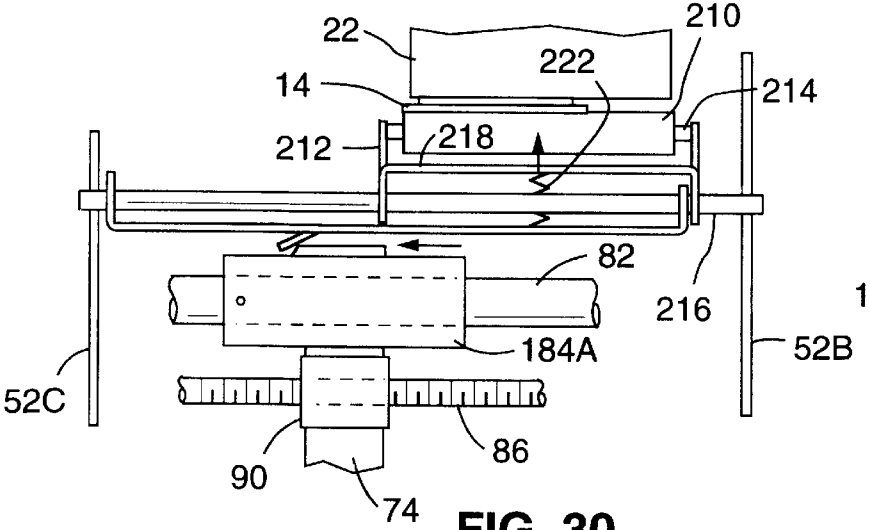
FIG. 30 is a partial view showing a binder strip supported between the pinch roller and the Drum.
Figure 35A:
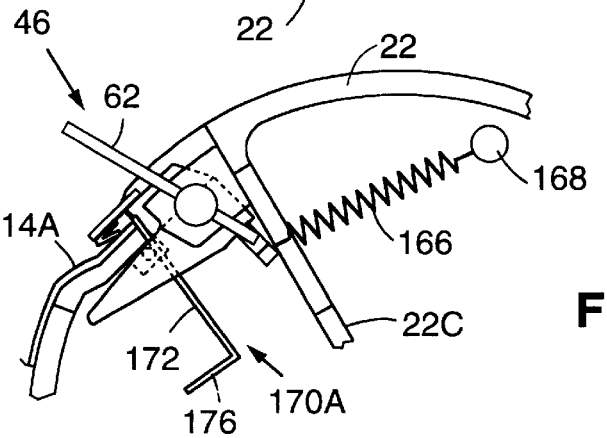
FIGS. 35A and 35B are partial views of the Clamp Mechanism as a binder strip is being ejected at the rear of the Printer.
Figure 35B:
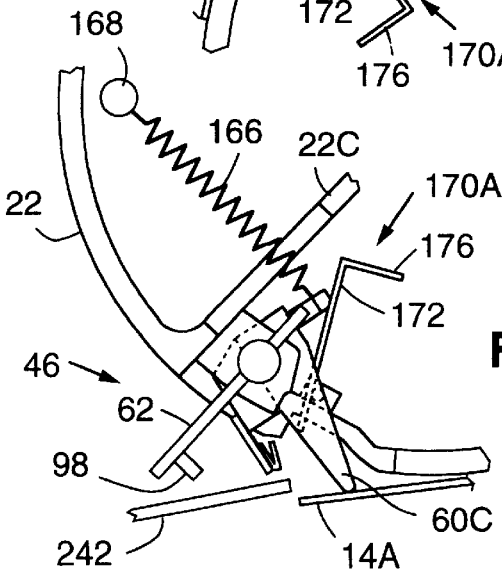

Also at time T58, the pinch roller solenoid 220 will be actuated so that the pinch roller 210 will be biased up against the strip 14 thereby supporting the strip during the ejection sequence (FIGS. 30 and 31). At the same time, Drum 22 is proceeds to be driven in the CCW direction. Eventually, at time T59, the clamp actuate arm 62 will engage the trip arm 98, with Drum 22 being driven far enough in the CCW direction to switch the movable clamp 60B from the closed position to the eject position (FIG. 35B). This will cause the leading edge 14B of the binder strip 14 to be released and lifted away from the Drum 22 surface by the strip eject fingers 60C, as can be seen in FIG. 35B. With the eject fingers 60C pressing down on the strip and with the pinch roller 210 supporting the strip from below, the leading edge 14A of the strip will poised to pass between the upper and lower eject guide members 242 and 244, respectively (FIGS. 21 and 31).

Figure 22:
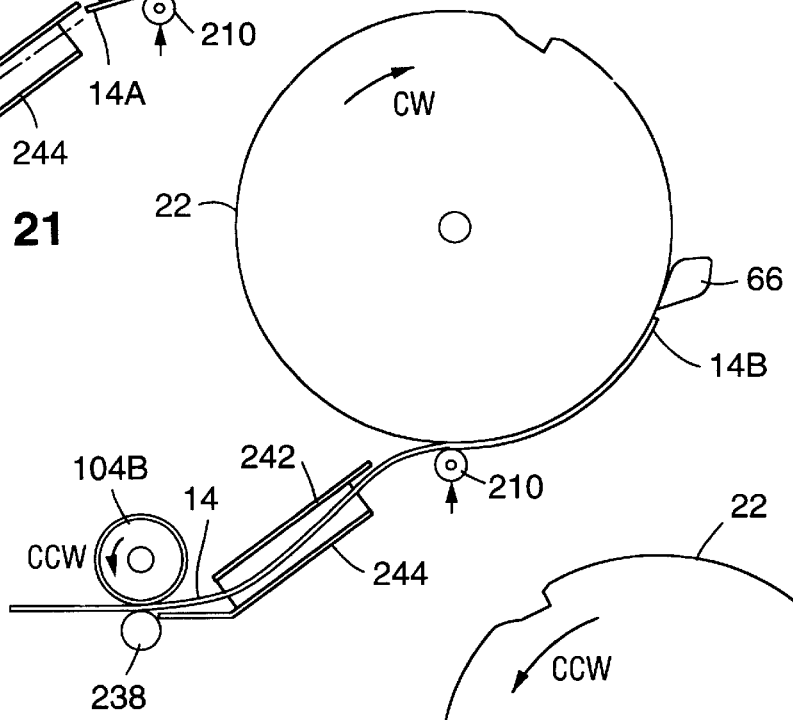
FIG. 22 is a schematic diagram of an intermediate stage of a binder strip being ejected to the rear of the Printer.

At time T60, Drum 22 will reverse direction and proceed to rotate in the CW direction, causing the strip clamp 60 to return to the closed position, but without the strip being present in the clamp. In addition, the eject solenoid 100 is turned off at time T60. During this portion of the eject sequence, the pinch roller 210 forces the strip 14 against the Drum 22 thereby permitting the Drum to drive the strip in the eject direction. As Drum 22 rotates in the CW direction the leading edge 14A of binder strip 14 will be positioned between the eject roller 238 and the three eject wheels 104A, 104B and 104C (FIGS. 22 and 32). Since the eject wheels 104A, 104B and 104C are driven indirectly by the drum drive motor 56 and since the direction of rotation of the wheels is opposite to that of Drum 22, at this point of the eject sequence, the eject wheels 104A, 104B and 104C will rotate in the CCW direction as shown in FIG. 22. However, as previously described in connection with FIG. 32B, the wheels 104A, 104B and 104C will not grip the binder strip 14 when the wheels are rotated in the CCW direction and thus will not resist movement of the strip as Drum 22 drives the strip in the eject direction.

Drum 22 will continue to rotate in the CW direction until time T62 when the locking pin 180C of the scraper arm 66 is positioned just above the arm latch 182, with arm latch solenoid 72 being off so that latch 182 is in the locking state as shown in FIG. 56A. A slight additional rotation of Drum 22 in the CW direction will cause the locking pin 180C mounted on the scraper arm 66 to first engage cam surface 182E thereby deflecting the latch 182 and then to move into a position so that the pin will be received by recess 182C so that latch 182 will return to the original position. This will cause the scraper arm 66 to be locked in place so that it will no longer rotate with Drum 22.

Figure 23:
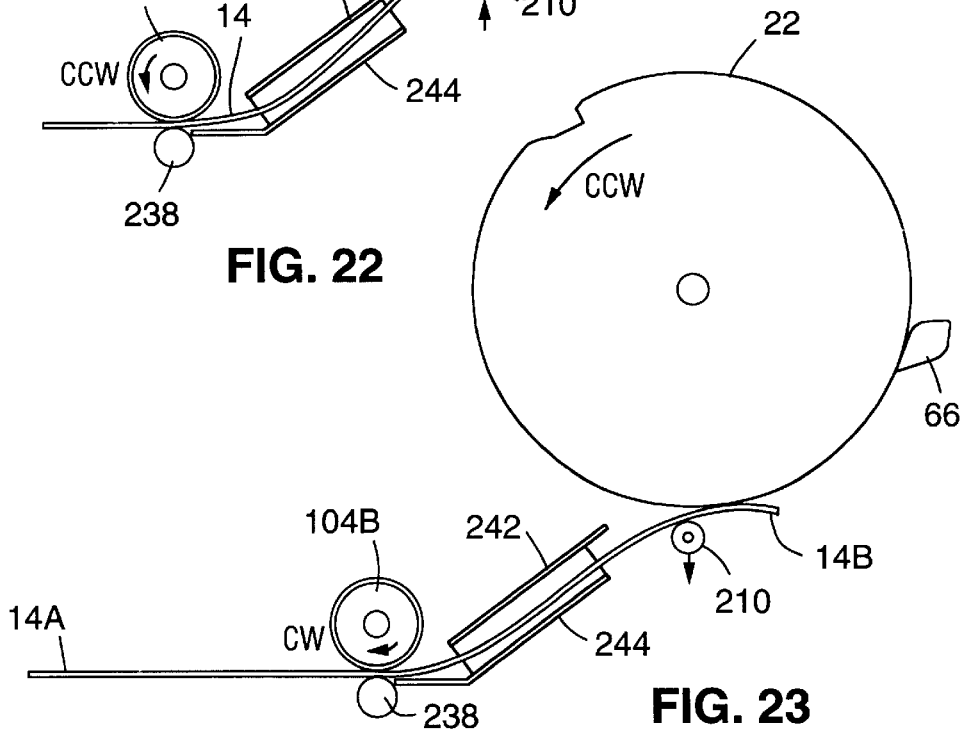
FIG. 23 is a schematic diagram of an final stage of a binder strip being ejected to the rear of the Printer.

Drum 22 will continue to rotate in the CW direction a slight amount so that the trailing edge 14B of the binder strip will pass under scraper arm 66 thereby freeing the trailing edge 14B from the Drum (FIG. 22). Drum 22 will then be reversed at time T63, with the pinch roller solenoid 220 being turned off as the Drum direction is reversed so that the pinch roller 210 no longer forces the strip against the Drum, but does provide support for the strip as shown in FIG. 23.

Drum 22 is then driven in the CCW direction (T63), but no longer drives the strip 14 since the strip is no longer secured to the Drum 22. The drum drive motor 56 will proceed to drive the three eject wheels 104A, 104B and 104C in the CW direction (FIG. 23), a direction which permits the wheels to engage the binder strip 14 and to pull the strip in the eject direction. Drum 22 will continue to be driven in the CCW direction, with the eject wheels 104A, 104B and 104C being driven in the CW direction until the binder strip 14 is completely ejected from the Printer. At time T64, Drum 22 is stopped thereby concluding the rear eject sequence.

Figure 13:
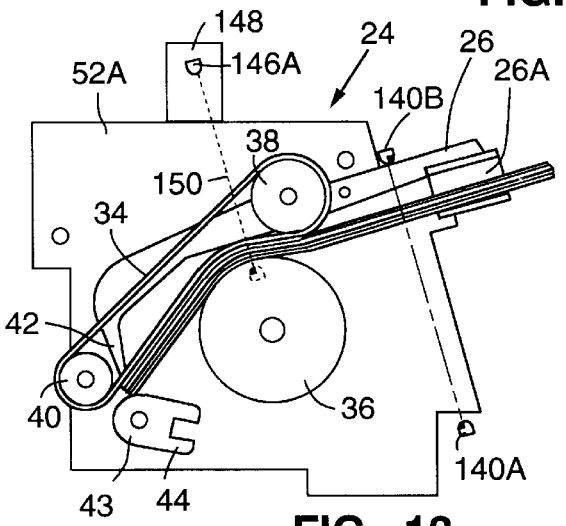
FIG. 13 is a side view of the Strip Load Assembly with a pair of binder strips improperly inserted therein.
Figure 10:
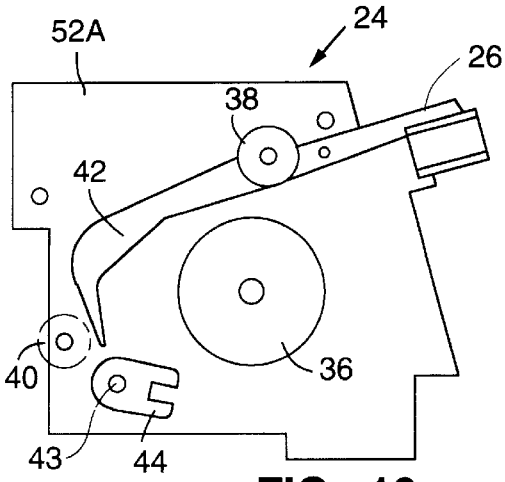
FIG. 10 is a side view of the Strip Load Assembly with the drive belt removed.

As previously noted, the Strip Load Assembly 24 is capable of detecting two faulty binder strip 14 loading conditions. The first condition occurs when a user inadvertently attempts to load two binder strips 14 at one time. This may happen because the strips 14 are usually packaged together and there is some tendency for the strips to stick to one another. FIG. 13 shows two strips 14 being improperly loaded at the same time. However, the spacing between the lower belt roller 40 and the mounting member 43 is such that only a single strip 14 can pass between the two members. Thus, the pair of strips 14 will be too thick to pass between the roller 40 and member 43 and will not be loaded. The failure of the loading sequence to continue will be detected and an error message will be shown on display 248. In addition, the strip drive motor 32 will be driven in a reverse direction causing the two strips to be partially ejected through the Strip Load Assembly 24.

The second fault condition occurs when a user attempts to improperly load a binder strip 13 with the adhesive side 14D facing downward. The strip 14 will be loaded until the strip contacts the rotatable blocking member 44 (FIG. 14). If the strip had been properly inserted, the strip substrate 14C, typically paper, will simply slide over the rotatable blocking member 44 rather than engage and rotate the member (FIG. 12). However, if the adhesive side 14D of the strip contacts the rotatable blocking member 44, the slight tackiness of the adhesive will cause the member to rotate as shown in FIG. 14. This rotation will reduce the effective spacing between the fixed and rotatable blocking members 42 and 44, respectively, thereby preventing the strip from moving forward. Once the Printer senses that the loading sequence has terminated, an error message is issued on the display 248 and the strip drive motor 32 is reversed so that the binder strip will be partially ejected from the Strip Load Assembly 24.

Figure 46:
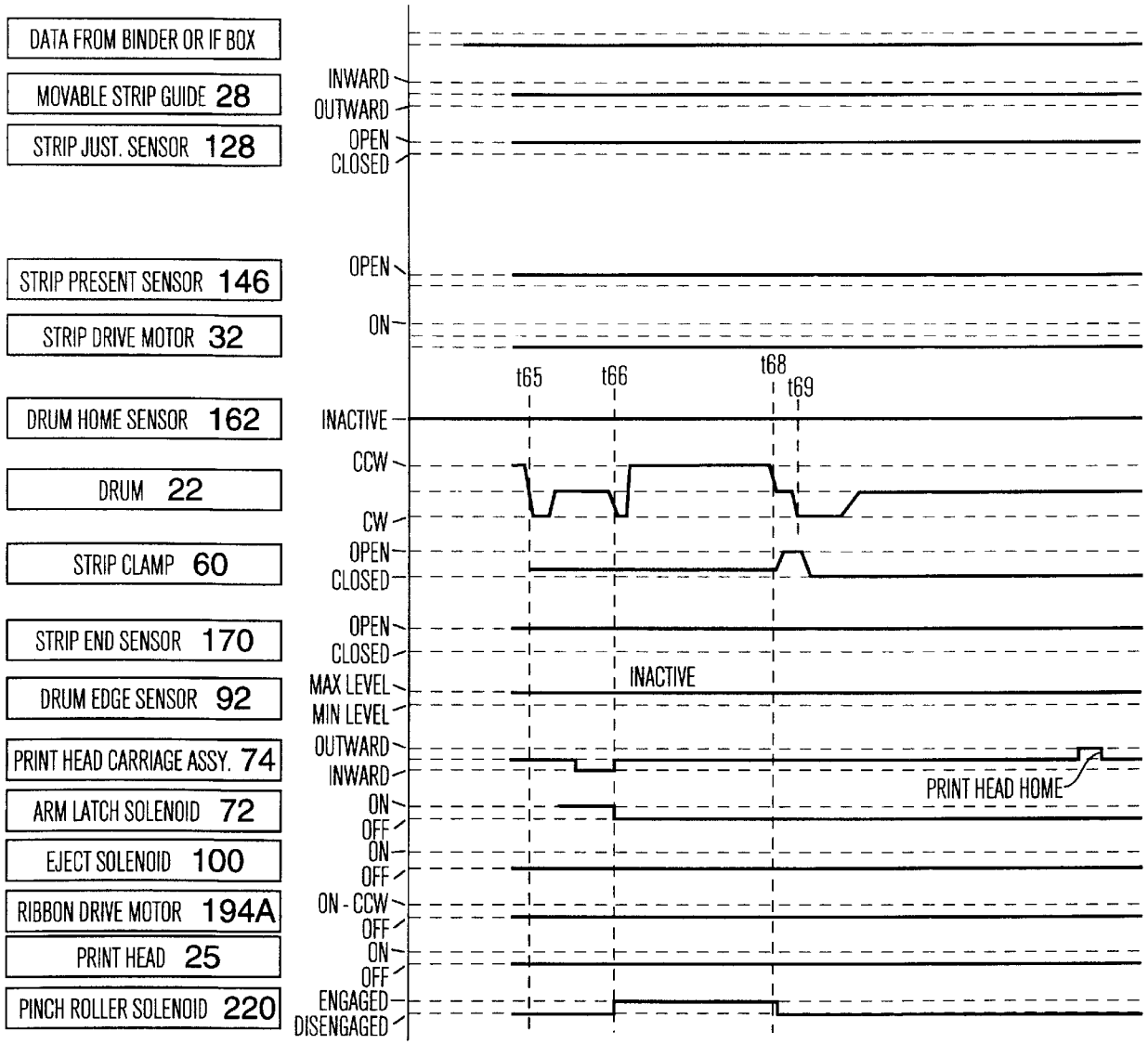
FIG. 46 is timing diagram illustrating the sequence for ejecting the binder strip at the front of the printer.
Figure 47A:
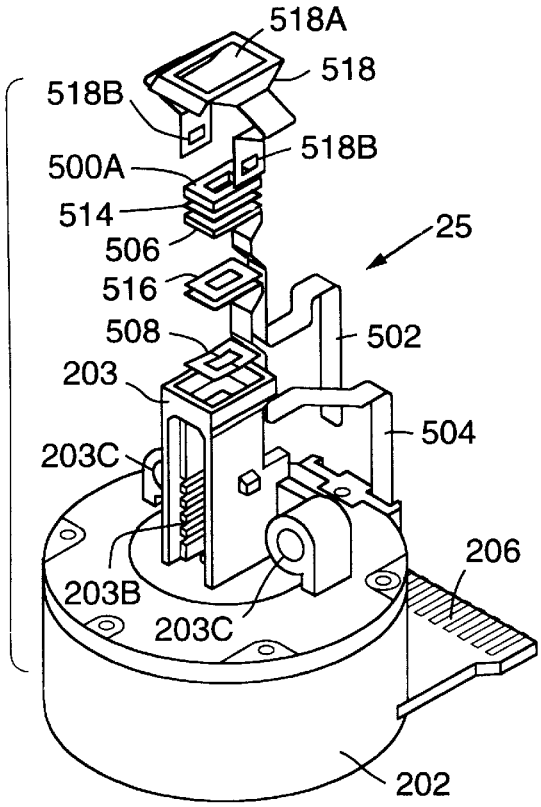
FIGS. 47A, 47B, 47C and 47D are various exploded views of the print head mechanism used in the subject Printer.
Figure 47B:
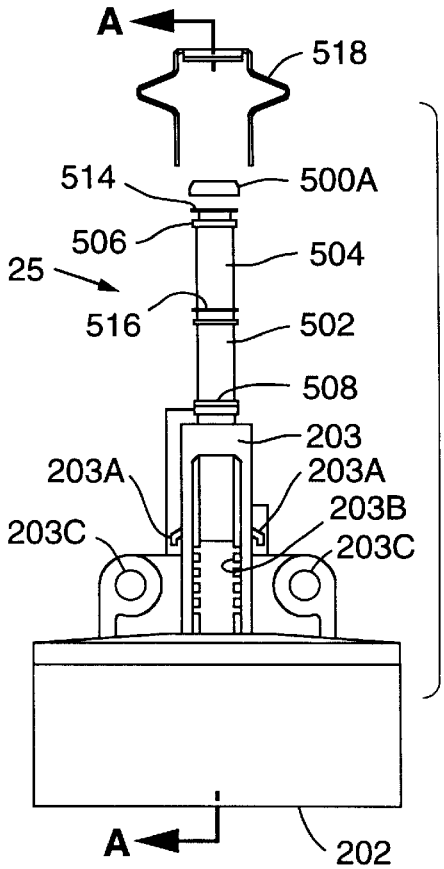
Figure 47C:
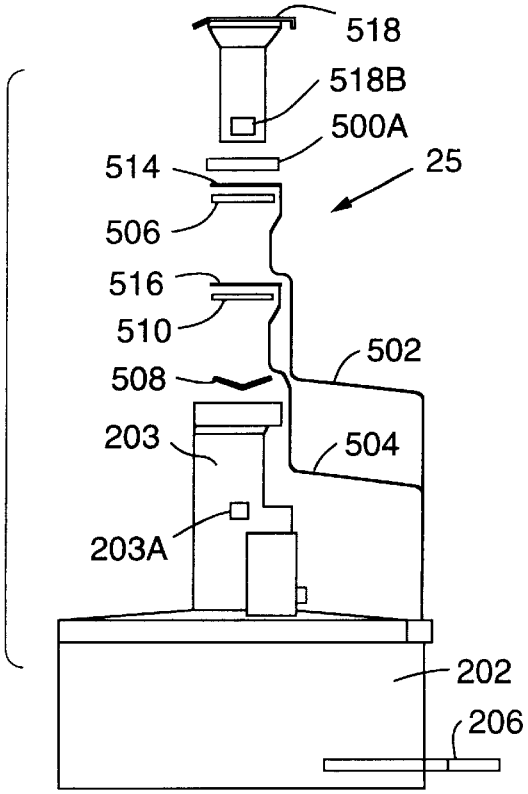
Figure 47D:
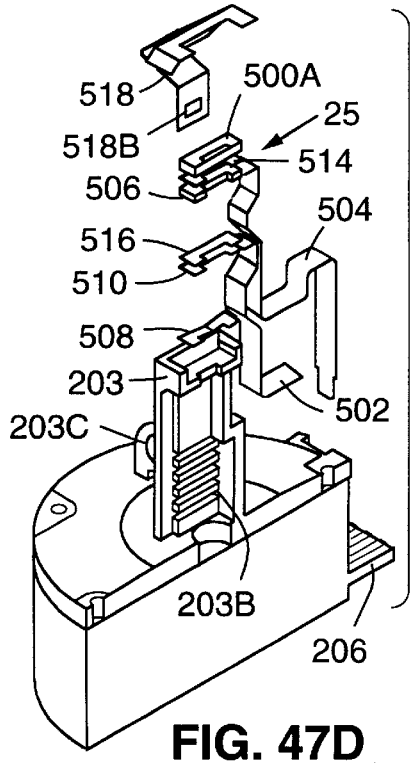

FIG. 46 is a timing diagram illustrating a printing sequence where the printed binder strip is ejected forward to the user through the front slot 19 in the Printer housing 16 rather than through the rear opening 20 as previously described. Forward eject is typically used when the Printer is not docked with a binding machine or when a user wishes to inspect a printer strip 14 prior to binding.

The forward eject printing sequence is the same as the rear eject sequence up until the time the binder strip has been printed at time T56 (FIG. 45). At this time, Drum 22 has just completed the last pass in the CCW direction. At time T65 (FIG. 46), the Drum direction is reversed and driven in the CW direction in preparation for locking the scraper arm 66. At this time, the arm latch solenoid in on so that the locking pin 180C on the scraper arm will be free to move past the arm latch 182. In addition, the Carriage Assembly 74 is driven in the inward direction so that it will not interfere with the clamp actuate arm 62.

Figure 24:
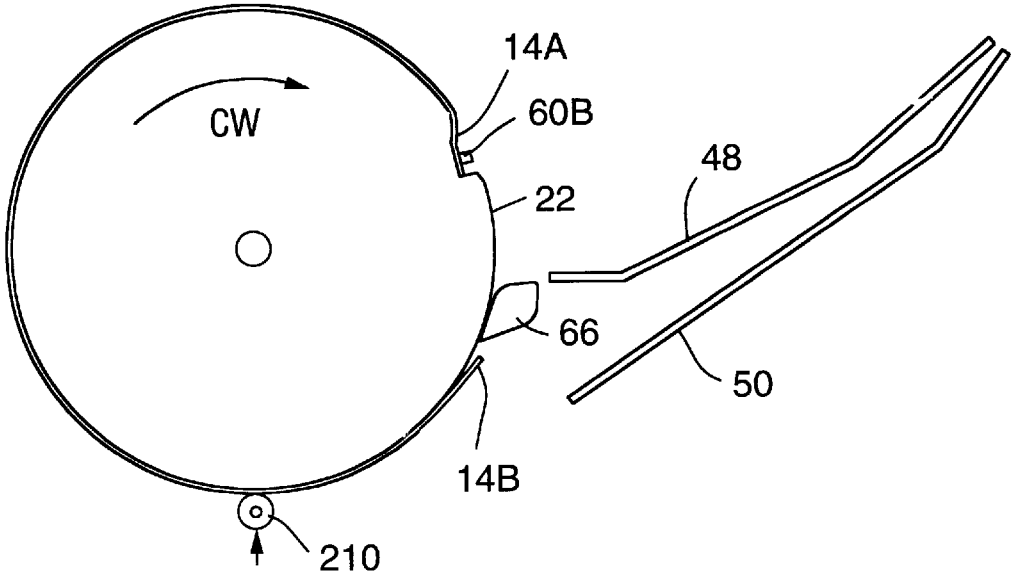
FIG. 24 is a schematic diagram of an initial stage of a binder strip being ejected to the front of the Printer.

At about time T66, the scraper arm 66 is positioned slightly above the arm latch 182 and latch solenoid 72 is turned off so that arm latch 182 is in a state for receiving the scraper arm locking pin 180C. In addition, the pinch roller solenoid is turned on so that the pinch roller 210 will move up and force the binder strip 14 against Drum 22. Drum 22 is then rotated slightly in the CW direction so that the locking pin 180C will move down a become locked in latch 182. Drum 22 will continue to rotate in the CW direction so that the trailing edge 14B of the binder strip moves out from beneath the fixed scraper arm 66 (FIG. 24). This action causes the trailing edge 14B to be released at time T67, with the strip clamp 60 and the pinch roller 210 functioning to support the binder strip 14.

Figure 25:
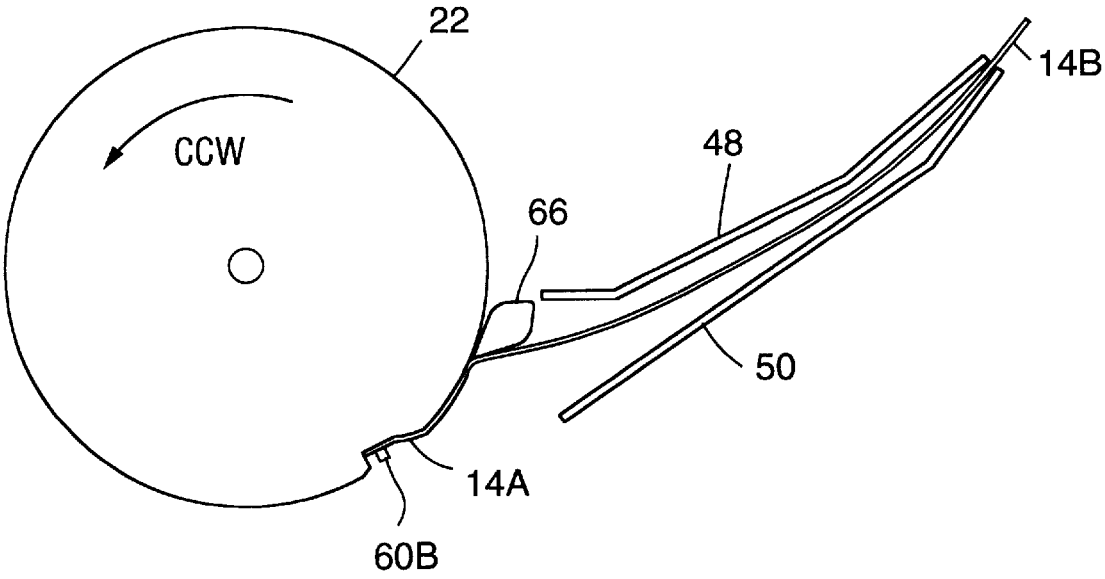
FIG. 25 is a schematic diagram of an final stage of a binder strip being ejected to the front of the Printer.

At time T67, Drum 22 proceeds to be driven in the CCW direction. The strip engaging edge 66B of the scraper arm will then pass between the trailing edge 14B of the strip and the Drum and will guide the trailing edge towards the space between the upper and lower eject guide members 48 and 50, respectively as shown in FIG. 25. Drum 22 will continue to rotate in the CCW direction thereby driving the binder strip 14 between the guide members 48 and 50, with the trailing edge 15B extending through the front slot 19 (not depicted) of the Printer housing. Eventually, at time T68, the clamp actuate arm 62 of the Clamp Mechanism 46 will contact the arm block 63 mounted on the frame. A slight further rotation of the Drum in the CCW direction will cause the movable strip clamp 60 to move to the eject position so that the leading edge 14A of the binder strip will be released although clamp 60 will continue to support the strip. Although not shown in the FIG. 46 timing diagram, it is preferably that the arm latch solenoid 72 be actuated sometime prior to time T68 so that the scraper arm 66 will be free to move in the CCW direction as the Drum is rotated so that arm will be displaced from clamp 60 when the clamp finally releases leading edge 14A of the strip so that the arm will not interfere with the release. However, arm 66 should remain latched for the majority of the binder strip 14 removal since the arm assists in guiding the strip away from the Drum. The display 248 will then indicate to the user that the printed strip has been ejected can be manually removed from the Strip Load Assembly 24. Once the strip 14 has been lifted out of the Strip Load Assembly, the removal of the strip will be detected by the strip ejected forward sensor 140. This will cause the Drum 22 to be rotated slightly in the CW direction and then stopped at time T69 so that the movable strip clamp 60 will move from the open to the closed position thereby ending the eject sequence.

Printer 10 is in a high power mode when strip 14 has been ejected and is presented for manual removal through slot 19 since a significant amount of torque is required to maintain the Clamp Mechanism 46 in the eject mode. If the strip 14 has not been manually removed after a set period of time, two minutes for example, Drum 22 will automatically be driven slightly in the CW direction. This will cause the Clamp Mechanism 46 to move to the closed position and will cause the strip 14 to be drawn back into the Printer thereby allowing the Printer to be in a reduced power consumption mode. Preferably, a message will then be shown on display 248 prompting the user to actuate the Eject key 254F (FIG. 43B) which will cause the strip 14 to be ejected a second time.

Thus, a novel binder strip printer has been disclosed. Although a preferred embodiment of the printer has been described in some detail, certain changes can be made by those skilled in the art without departing from the spirit and scope of the invention as defined by the appended claims.

We claim:

1. A printer for printing on an elongated substrate comprising:

a platen configured to support the substrate during printing;

a ribbon containing ink positioned adjacent the platen;

a print head mechanism positioned relative to the platen and the ribbon and configured to transfer the ink from the ribbon to the substrate during printing, with the print head mechanism including (a) a multiplicity of print pins configured to contact the ribbon and to force the ribbon against a substrate positioned on the platen;

(b) a driver coil associated with each of the print pins and configured to drive the associated print pin;

(c) a heating element for heating the print pins, wherein the heating element heats to a temperature of at least 100 degrees Centigrade;

a print head driver configured to transfer drive energy to the driver coils of the print head mechanism, with the drive energy being transferred such that a drive force is applied to the print pins up to a time at which the print pins have forced the ribbon against the substrate and for a predetermined minimum period after the time; and a print head controller configured to control the print head driver so as to carry out printing on the substrate.

2. The printer of claim 1 wherein the heating element includes a thermistor device.

3. A printer for printing on an elongated substrate comprising:

a platen configured to support the substrate during printing;

a ribbon containing ink positioned adjacent the platen;

a print head mechanism positioned relative to the platen and the ribbon and configured to transfer the ink from the ribbon to the substrate during printing, with the print head mechanism including (a) a multiplicity of print pins configured to contact the ribbon and to force the ribbon against a substrate positioned on the platen;

(b) a driver coil associated with each of the print pins and configured to drive the associated print pin;

(c) a heating element for heating the print pins;

a print head driver configured to transfer drive energy to the driver coils of the print head mechanism, with drive energy being transferred such that a drive force is applied to the print pins up to a time at which the print pins have forced the ribbon against the substrate and for a predetermined minimum period after the time; and a print head controller configured to control the print head driver so as to carry out printing on the substrate and wherein the print head controller is configured to cause the print head mechanism to operate at a predetermined maximum operating frequency and wherein the print head driver is configured to provide a drive current to the driver coils for at least 35% of a time period equal to the inverse of the operating frequency.

4. The printer of claim 3 wherein the print head driver is configured to provide a drive current to the driver coils for at least 40% of the time period.

5. The printer of claim 3 wherein the ribbon is a multilayer ribbon, which includes a base layer, an ink layer and a release layer intermediate the base and ink layers.

6. The printer of claim 5 wherein the release layer includes wax.

7. The printer of claim 5 wherein the ink layer includes a metallization layer.

8. The printer of claim 7 where the ink layer includes a color layer.

9. The printer of claim 3 wherein the print head driver is configured to apply an current during an initial portion of the at least 35% time period having a first magnitude and to apply current during a remainder portion of the at least 35% time period having a second magnitude which is less than 75% of the first magnitude.

10. The printer of claim 9 wherein the second magnitude is less than 50% of the first magnitude.

11. The printer of claim 3 wherein the print head driver is configured to provide the drive current by applying a drive voltage across selected ones of the driver coils.

12. The printer of claim 11 wherein a magnitude of the drive current is controlled by pulse width modulating the drive voltage.

13. The printer of claim 11 wherein the pulse width modulation is altered in response to changes in amplitude of the drive voltage so as to reduce changes in the magnitude of the drive current.

14. The printer of claim 11 wherein the print head controller is configured to cause the print driver to apply current for a predetermined drive period and wherein the drive voltage is pulse width modulated during the drive period, with the pulse width modulation being altered during the drive period so that the magnitude of the drive current is greater in an initial portion of the drive period than in a final portion of the drive period.

15. The printer of claim 14 wherein the pulse width modulation is altered in response to a number of the drive coils being driven at the same time.

16. A printer for printing on the first side of a binder strip which includes a heat-activated adhesive on the second side opposite the first side, said printer comprising:

a platen configured to support the binder strip during printing;

a multi-layer ribbon positioned adjacent the platen, said ribbon including a base layer, a release layer, a color layer and a metallic layer;

a print head assembly positioned relative to the platen and ribbon and configured to transfer part of the color and the metallic layer from the ribbon to the binder strip during printing by application of pressure and heat to the ribbon for a sufficient duration to cause the transfer without activating the adhesive.

17. A printer for printing on the first side of a binder strip which includes an adhesive on the second side opposite the first side, said printer comprising:

a platen configured to support the binder strip during printing;

a multi-layer ribbon positioned adjacent the platen, said ribbon including a base layer, a release layer, a color layer and a metallic layer;

a print head assembly positioned relative to the platen and ribbon and configured to transfer part of the color and metallic layers from the ribbon to the binder strip during printing by application of pressure and heat to the ribbon for a sufficient duration to cause the transfer, with the print head assembly including (a) a multiplicity of print pins configured to contact the ribbon and to force the ribbon against a binder strip positioned on the platen;

(b) a driver coil associated with each of the print pins and configured to drive the associated print pin;

(c) a heating element for heating the print pins, with the heating element heating to a temperature of at least 100 degrees Centigrade;

(d) a print head controller configured to control the print head driver so as to carry out printing in the binder strip; and (e) a print head driver configured to provide drive energy to the driver coils, with the drive energy being applied such that a drive force is applied to the print pins up to a time at which the print pins have forced the ribbon against the binder strip and for a predetermined minimum period after the time.

18. The printer of claim 17 wherein the heating element includes a thermistor device.

19. The printer of claim 17 wherein the print head controller is configured to cause the print head mechanism to operate at a predetermined maximum operating frequency and wherein the print head driver is configured to provide a drive current to the driver coils for at least 35% of a time period equal to the inverse of the operating frequency.

20. The printer of claim 19 wherein the print head driver is configured to provide a drive current to the driver coils for at least 40% of the time period.

21. The printer of claim 19 wherein the print head driver is configured to apply a current during an initial portion of the at least 35% time period having a first magnitude and to apply current during a remainder portion of the at least 35% time period having a second magnitude which is less than 75% of the first magnitude.

22. The printer of claim 21 wherein the first magnitude is less than 50% of the first magnitude.

23. The printer of claim 19 wherein the print head driver is configured to provide the drive current by applying a drive voltage across selected ones of the driver coils.

24. The printer of claim 23 wherein a magnitude of the drive current is controlled by pulse width modulating the drive voltage.

25. The printer of claim 24 wherein the pulse width modulation is altered in response to changes in amplitude of the drive voltage so as to reduce changes in the magnitude of the drive current.

26. The printer of claim 17 wherein the print head controller is configured to cause the print head driver to apply current for a predetermined drive period and wherein the drive voltage is pulse width modulated during the drive period, with the pulse width modulation being altered during the drive period so that the magnitude of the drive current is greater in an initial portion of the drive period than in a final portion of the drive period.

27. The printer of claim 26 wherein the pulse width modulation is altered in response to a number of the drive coils being driven at the same time.

28. A printer for printing on the first side of a binder strip which includes an adhesive on the second side opposite the first side, said printer comprising:

a platen configured to support the binder strip during printing;

a multi-layer ribbon positioned adjacent the platen, said ribbon including a base layer, a release layer and a metallic layer;

a print head mechanism positioned relative to the platen and ribbon and including (a) a multiplicity of print pins configured to contact the ribbon and to force the ribbon against a binder strip positioned on the platen;

(b) a driver coil associated with each of the print pins and configured to drive the associated print pin;

(c) a heating element for heating the print pins;

a print head driver configured to provide drive energy to the driver coils of the print head mechanism by applying a drive voltage across selected ones of the drive coils so as to provide a drive current through the coils having an amplitude controlled by pulse width modulating the drive voltage, with the drive current being applied to the selected ones of the drive coils for a drive period, with the drive current magnitude during an final portion of the drive period being less than 50% of the drive current magnitude during an initial portion of the drive period; and a print head controller configured to control the print head driver so that sufficient pressure and heat are applied to the ribbon for a sufficient duration so as to transfer part of the metallic layer to the binder strip.

29. A printer for printing on the first side of a binder strip which includes an adhesive on the second side opposite the first side, said printer comprising:

a platen configured to support the binder strip during printing;

a multi-layer ribbon positioned adjacent the platen, said ribbon including a base layer, a release layer and a metallic layer;

a print head mechanism positioned relative to the platen and ribbon and including (a) a multiplicity of print pins configured to contact the ribbon and to force the ribbon against a binder strip positioned on the platen;

(b) a driver coil associated with each of the print pins and configured to drive the associated print pin;

(c) a heating element for heating the print pins;

a print head driver configured to provide drive energy to the driver coils of the print head mechanism by applying a drive voltage across selected ones of the drive coils so as to provide a drive current through the coils having an amplitude controlled by pulse width modulating the drive voltage, wherein the drive current is applied to selected ones of the drive coils while the print pins are moving towards the ribbon and for a predetermined minimum period after the print pins have forced the ribbon against the binder strip; and a print head controller configured to control the print head driver so that sufficient pressure and heat are applied to the ribbon for a sufficient duration so as to transfer part of the metallic layer to the binder strip.

* * * * *

UNITED STATES PATENT AND TRADEMARK OFFICE

CERTIFICATE OF CORRECTION

PATENT NO.: 6,027,265
DATED: February 22, 2000
INVENTOR(S): Kevin P. Parker ET AL.

It is certified that an error appears in the above-identified patent and that said Letters Patent is hereby corrected as shown below:

In Col. 48, Line 24 (1st line of Claim 22), "first" should be replaced by --second--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*